US011311062B2

(12) United States Patent
Roque et al.

(10) Patent No.: US 11,311,062 B2
(45) Date of Patent: Apr. 26, 2022

(54) IMPACT REDUCTION SYSTEM

(71) Applicant: Point Blank Enterprises, Inc., Pompano Beach, FL (US)

(72) Inventors: Leomar Roque, Coconut Creek, FL (US); Matthew Asher, Aventura, FL (US); Randall Jered LeMarbe, Coral Springs, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 1379 days.

(21) Appl. No.: 15/141,369

(22) Filed: Apr. 28, 2016

(65) Prior Publication Data

US 2016/0316830 A1 Nov. 3, 2016

Related U.S. Application Data

(60) Provisional application No. 62/155,336, filed on Apr. 30, 2015, provisional application No. 62/155,329, filed on Apr. 30, 2015.

(51) Int. Cl.
*A41D 13/05* (2006.01)
*A41D 13/015* (2006.01)
(Continued)

(52) U.S. Cl.
CPC ..... *A41D 13/0518* (2013.01); *A41D 13/015* (2013.01); *A41D 13/0562* (2013.01); *A41D 27/28* (2013.01); *F41H 1/02* (2013.01)

(58) Field of Classification Search
CPC ..... A41D 13/0518; A41D 13/015; A41D 13/0562; A41D 27/28; A41D 13/0531;
(Continued)

(56) References Cited

U.S. PATENT DOCUMENTS 1,898,606 A * 2/1933 Whitley ..... A63B 71/12 2/465
2,629,094 A * 2/1953 Goldsmith ..... A41D 13/0575 2/465
(Continued)

OTHER PUBLICATIONS

Extended European Search Report for European Application No. 16167787.7 dated Sep. 19, 2016.
(Continued)

*Primary Examiner* — Heather Mangine
(74) *Attorney, Agent, or Firm* — Honigman LLP

(57) ABSTRACT

A torso load distribution assembly. The torso load distribution assembly includes one or more plate portions and a plate engaging member. The one or more plate portions includes a body having a front surface, a rear surface and a side surface. The side surface joins the front surface to the rear surface. The body includes a plurality of body portions that are spaced apart from a substantially central body portion. The plate engaging member includes a body having central body portion, a first body portion connected to the central body portion and a second body portion connected to the central body portion. Each of the first body portion and the second body portion that attach to the plurality of body portions of the one or more plate portions. The body of the plate engaging member is configured to be slightly smaller dimensionally than dimensions formed by the side surface of the body of the one or more plate portions for maintaining the body of the one or more plate portions of the plate engaging member in a bowed orientation when the plurality of body portions of the one or more plate portions are attached to the plate engaging member. An assembly configured for arrangement about a torso of a user is also disclosed. Methods for assembling the same are also disclosed. Another torso load distribution assembly is also
(Continued)

disclosed, and, a method for forming the same is also disclosed.

21 Claims, 33 Drawing Sheets

(51) Int. Cl.
*A41D 27/28* (2006.01)
*F41H 1/02* (2006.01)

(58) Field of Classification Search
CPC ..... A41D 13/0575; A63B 2071/1208; F16H 1/02
See application file for complete search history.

(56) References Cited

U.S. PATENT DOCUMENTS 3,135,961 A * 6/1964 Roderick ..... A41D 13/015 2/463
4,074,839 A 2/1978 Wood et al.
4,926,503 A * 5/1990 Wingo, Jr. ..... A63B 71/12 2/267
5,105,473 A * 4/1992 Valtakari ..... A41D 13/015 2/22
5,366,126 A * 11/1994 Dausien ..... A45F 3/04 224/630
5,497,511 A * 3/1996 Zade ..... A41D 13/015 2/22
5,596,768 A * 1/1997 Wang ..... A41D 13/0153 2/462
5,729,832 A * 3/1998 Grilliot ..... A41D 13/00 2/2.5
5,754,982 A * 5/1998 Gainer ..... F41H 1/02 2/102
6,185,738 B1 * 2/2001 Sidebottom ..... F41H 1/02 2/102
6,233,737 B1 * 5/2001 Ditchfield ..... F41H 1/02 2/2.5
6,375,537 B1 * 4/2002 Jankowski ..... A41C 3/0057 2/463
6,823,529 B1 * 11/2004 Dako ..... F41H 1/02 2/2.5
6,892,915 B2 * 5/2005 Mares ..... A45F 3/04 224/148.5
7,636,948 B1 * 12/2009 Crye ..... A41D 31/12 2/2.5
8,182,439 B2 5/2012 Glenn
8,672,203 B2 3/2014 Staudecker et al.
8,875,314 B1 * 11/2014 Panetta ..... A41D 13/0012 2/102
8,875,319 B2 * 11/2014 Martin ..... A41D 13/015 2/459
8,991,671 B2 3/2015 Gill et al.
8,997,262 B2 4/2015 Klein
9,021,612 B1 * 5/2015 O'Neal ..... F41H 1/02 2/2.5
9,131,762 B2 * 9/2015 Buffinton ..... A45F 3/08
9,437,175 B2 * 9/2016 Sumner ..... G10D 13/02
9,562,746 B2 * 2/2017 Khandelwal ..... F41H 1/02
9,752,854 B1 * 9/2017 Rittenhouse, Jr. ... A41D 31/245
2003/0046752 A1 * 3/2003 Baumann ..... A63B 71/12 2/463
2004/0003448 A1 * 1/2004 Morrow ..... A63B 71/12 2/92
2005/0039245 A1 2/2005 Landi et al.
2006/0143763 A1 * 7/2006 Dawson ..... F41H 1/02 2/2.5
2007/0155283 A1 * 7/2007 McQueer ..... A41D 13/0017 450/39
2010/0116861 A1 5/2010 Burrowes
2011/0131694 A1 * 6/2011 Fearon ..... F41H 1/02 2/2.5
2011/0219510 A1 * 9/2011 Nuzzo ..... A41D 13/0575 2/16
2011/0252549 A1 * 10/2011 Jourde ..... A63B 71/12 2/463
2012/0174276 A1 7/2012 Craffey
2012/0187172 A1 7/2012 Heaword
2013/0047320 A1 * 2/2013 Gleason ..... A45F 3/14 2/312
2013/0097759 A1 * 4/2013 Strum ..... A41D 13/0518 2/2.5
2013/0133130 A1 * 5/2013 Crye ..... F41H 1/02 2/463
2013/0283492 A1 10/2013 Ernst, Jr. et al.
2013/0312152 A1 11/2013 Paul et al.
2014/0101810 A1 * 4/2014 Tirard ..... F41H 1/02 2/2.5
2014/0124561 A1 * 5/2014 Neibarger ..... A45F 3/04 224/625
2014/0151424 A1 6/2014 Hexels
2015/0082503 A1 * 3/2015 Beck ..... F41H 1/02 2/2.5
2015/0114212 A1 * 4/2015 Carlson ..... F41H 1/02 89/36.02
2015/0216705 A1 * 8/2015 Evans ..... A61F 5/03 602/19
2015/0257461 A1 * 9/2015 Conolly ..... A41D 13/0543 2/23
2015/0285594 A1 * 10/2015 Seuk ..... F41H 1/02 2/2.5
2015/0323289 A1 * 11/2015 Seuk ..... F41H 1/02 89/36.05
2016/0223295 A1 * 8/2016 Tepper ..... F41H 5/045
2016/0273886 A1 * 9/2016 O'Neal ..... F41H 1/02
2016/0316830 A1 * 11/2016 Roque ..... A41D 13/015
2016/0316895 A1 * 11/2016 Roque ..... A45F 3/04
2017/0153089 A1 * 6/2017 Bahu ..... B32B 27/065
2017/0291097 A1 * 10/2017 Schwanke ..... A63B 71/12
2019/0037936 A1 * 2/2019 Schmidt ..... A41D 13/0518
2019/0041167 A1 * 2/2019 Swan ..... A45F 3/14
2019/0357605 A1 * 11/2019 Homan ..... A41D 13/0518

OTHER PUBLICATIONS

European Examination Report for European Application No. 16167787.7 dated Jun. 16, 2020.
European Examination Report for European Application No. 16167787.7 dated Mar. 6, 2020.

* cited by examiner

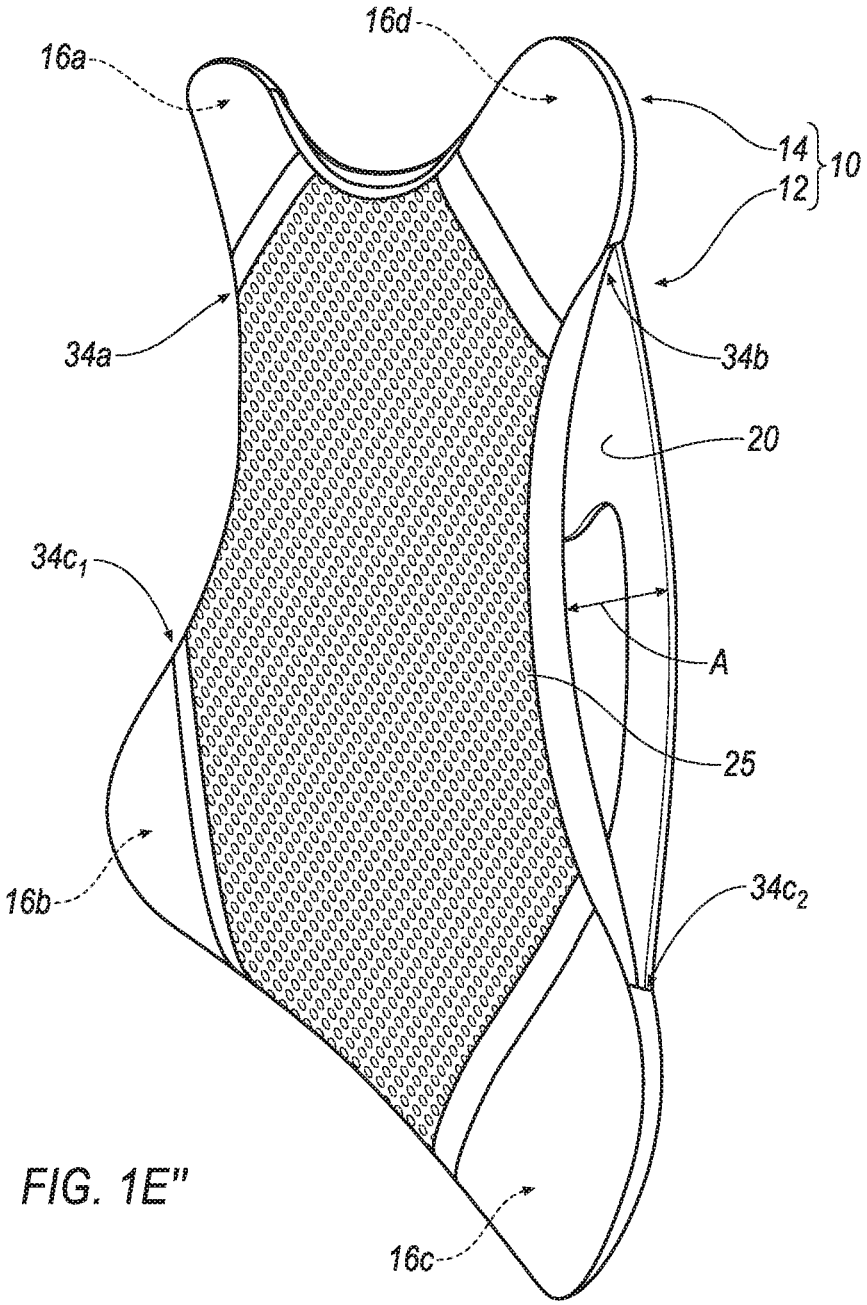
FIG. 1E"

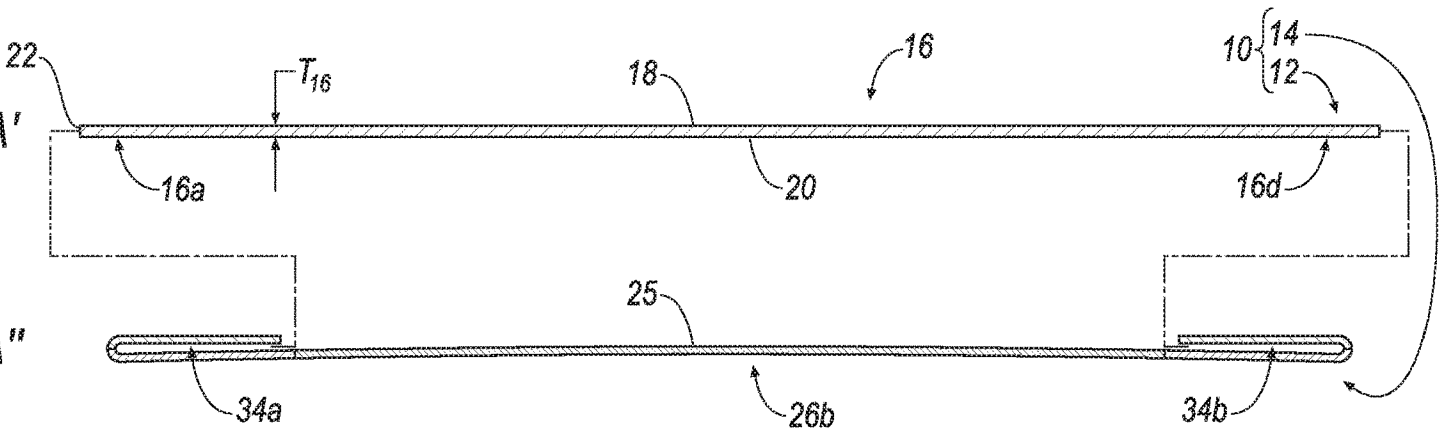
FIG. 2A'
FIG. 2A''
FIG. 2A
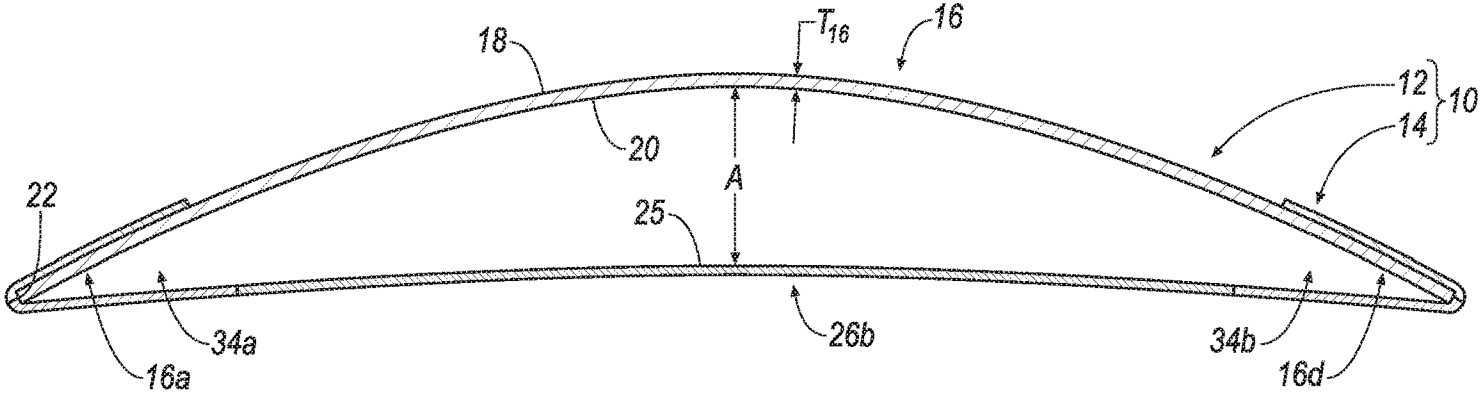
FIG. 2B

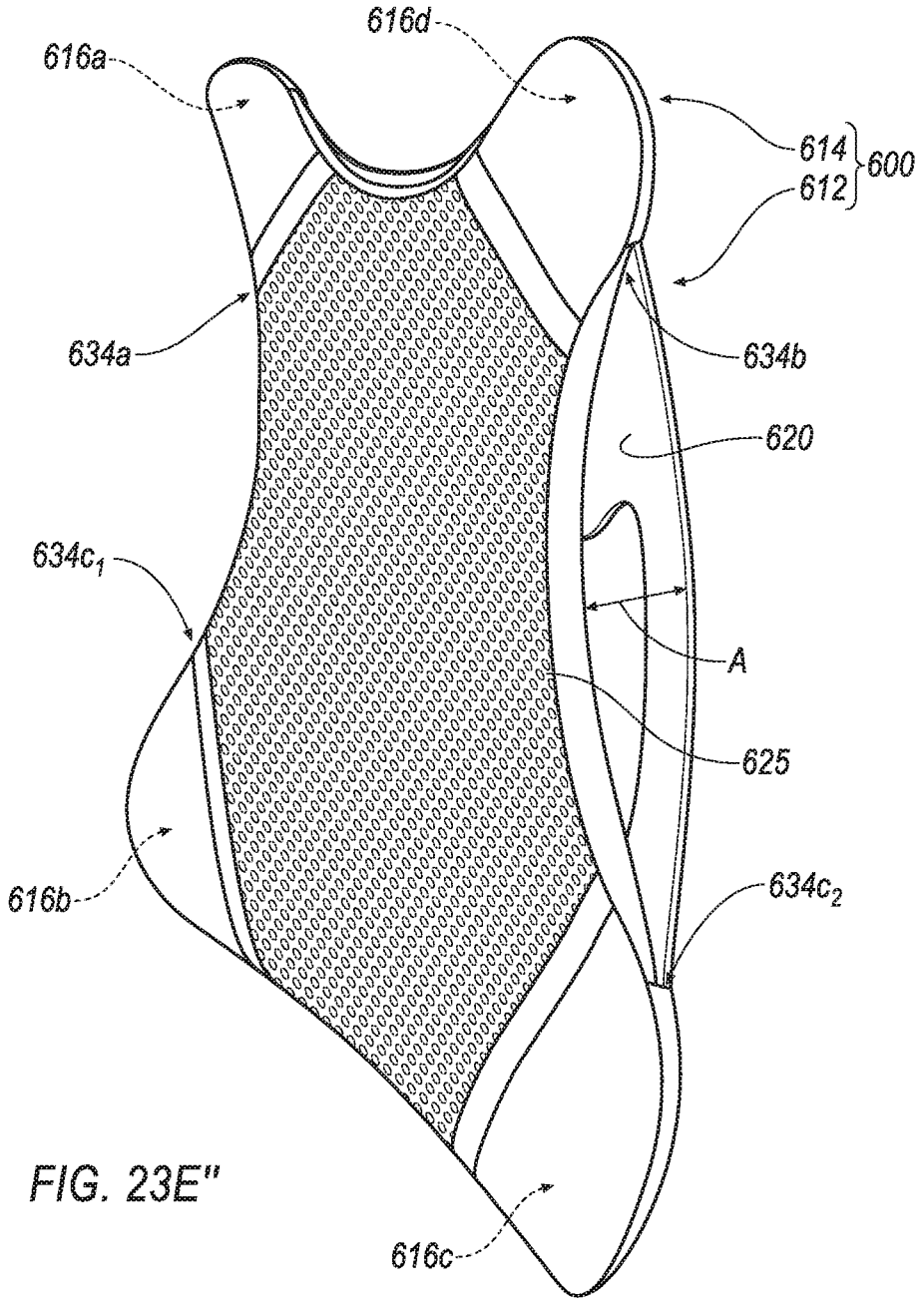
FIG. 23E"

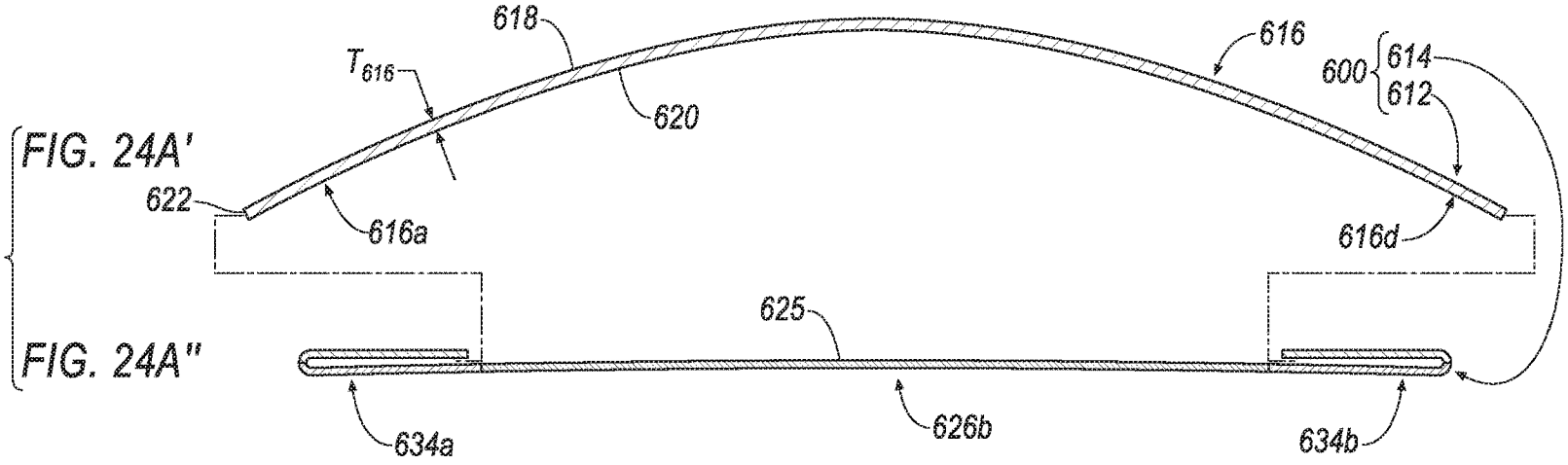
FIG. 24A'
FIG. 24A''
FIG. 24A
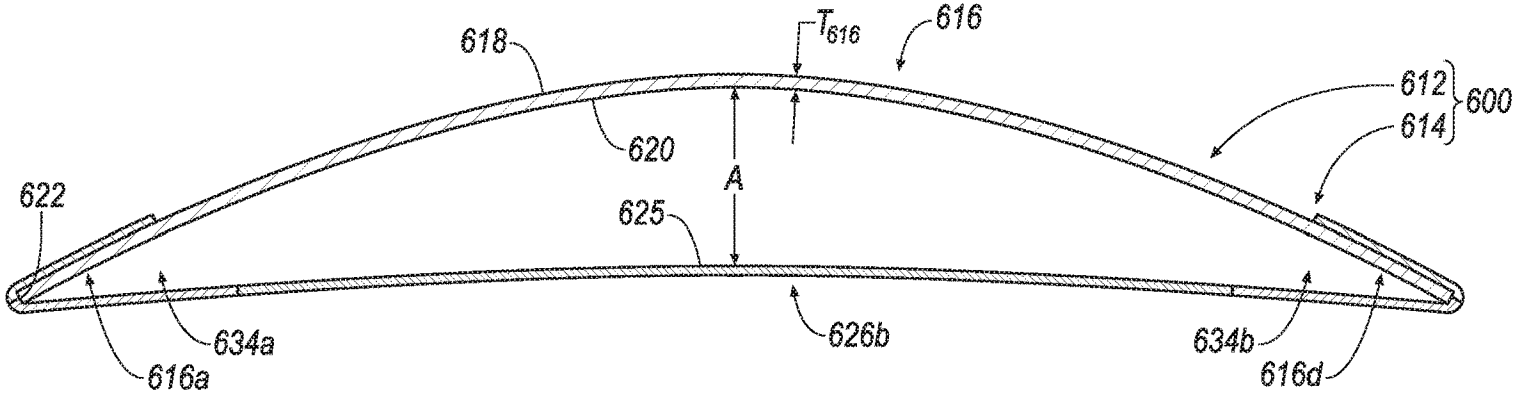
FIG. 24B

IMPACT REDUCTION SYSTEM

CROSS-REFERENCE TO RELATED APPLICATION

This U.S. patent application claims priority to U.S. Provisional Applications 62/155,329 and 62/155,336 both filed on Apr. 30, 2015.

TECHNICAL FIELD

This disclosure relates to an impact reduction system, a torso load distribution assembly, an assembly configured for arrangement about a torso of a user and methods for assembling the same.

BACKGROUND

Impact reduction systems and load distribution assemblies are known. While existing impact reduction systems and load distribution assemblies perform adequately for their intended purpose, improvements to impact reduction systems and load distribution assemblies are continuously being sought in order to advance the arts.

SUMMARY

One aspect of the disclosure provides a torso load distribution assembly including one or more plate portions and a plate engaging member. The one or more plate portions includes a body having a front surface, a rear surface and a side surface. The side surface joins the front surface to the rear surface. The body includes a plurality of body portions that are spaced apart from a substantially central body portion. The plate engaging member includes a body having central body portion, a first body portion connected to the central body portion and a second body portion connected to the central body portion. Each of the first body portion and the second body portion that attach to the plurality of body portions of the one or more plate portions. The body of the plate engaging member is configured to be slightly smaller dimensionally than dimensions formed by the side surface of the body of the one or more plate portions for maintaining the body of the one or more plate portions of the plate engaging member in a bowed orientation when the plurality of body portions of the one or more plate portions are attached to the plate engaging member.

Implementations of the disclosure may include one or more of the following optional features. The plurality of body portions that are spaced apart from the substantially central body portion includes: an upper right body projection, a lower right body projection, a lower left body projection and an upper left body projection. The first body portion of the body of the plate engaging member is an upper body portion. The second body portion of the body of the plate engaging member is a lower body portion. Pockets formed by the upper body portion and the lower body portion includes: an upper right pocket formed by the upper body portion that is configured to receive the upper right body projection, an upper left pocket formed by the upper body portion that is configured to receive the upper left body projection, a lower pocket formed by the lower body portion. The lower pocket defines: a lower right pocket portion that is configured to receive the lower right body projection and a lower left pocket portion that is configured to receive the lower left body projection.

In some implementations, the upper body portion further defines an upper lip. The lower body portion further defines a lower lip. The upper lip is secured to the lower lip for selectively containing the one or more plate portions within the plate engaging member.

In some examples, the inner surface of the upper body portion defining the upper lip includes a patch of one of a hook material and a loop material that engages the other of the hook material and the loop material provided by the outer surface of the lower body portion defining the lower lip to provide a hook-and-loop connection of the upper lip and the lower lip.

In some implementations, the plurality of body portions that are spaced apart from the substantially central body portion includes: an upper central body projection, a lower right body projection and a lower left body projection. The first body portion of the body of the plate engaging member is an upper body portion. The second body portion of the body of the plate engaging member is a lower body portion. Pockets formed by the upper body portion and the lower body portion includes an upper central pocket and a lower pocket. The upper central pocket is formed by the upper body portion and is configured to receive the upper central body projection. The lower pocket is formed by the lower body portion. The lower pocket defines a lower right pocket portion that is configured to receive the lower right body projection. The lower pocket also defines a lower left pocket portion that is configured to receive the lower left body projection.

In some examples, the upper body portion further defines an upper lip. The lower body portion further defines a lower lip. The upper lip is secured to the lower lip for selectively containing the one or more plate portions within the plate engaging member.

In some implementations, the inner surface of the upper body portion defining the upper lip includes a patch of one of a hook material and a loop material that engages the other of the hook material and the loop material provided by the outer surface of the lower body portion defining the lower lip to provide a hook-and-loop connection of the upper lip and the lower lip.

In some examples, the plurality of body portions that are spaced apart from the substantially central body portion includes: an upper right body projection, a lower right body projection, a lower left body projection and an upper left body projection. The first body portion of the body of the plate engaging member is a right body portion. The second body portion of the body of the plate engaging member is a left body portion. Pockets formed by the right body portion and the left body portion includes: a right pocket and a left pocket. The right pocket is formed by the right body portion. The right pocket defines a lower right pocket portion that is configured to receive the lower right body projection and an upper right pocket portion that is configured to receive the upper right body projection. The left pocket is formed by the left body portion. The left pocket defines a lower left pocket portion that is configured to receive the lower left body projection and an upper left pocket portion that is configured to receive the upper left body projection.

In some implementations, the plurality of body portions that are spaced apart from the substantially central body portion includes: an upper right body projection, a lower right body projection, a lower left body projection and an upper left body projection. The first body portion of the body of the plate engaging member is a right body portion. The second body portion of the body of the plate engaging member is a left body portion. The right body portion includes a lower right body portion and an upper right body portion. The left body portion includes a lower left body portion and an upper left body portion. Pockets formed by the right body portion and the left body portion includes a right pocket and a left pocket. The right pocket is formed by the right body portion. The right pocket defines a lower right pocket portion formed by the lower right body portion that is configured to receive the lower right body projection and an upper right pocket portion formed by the upper right body portion that is configured to receive the upper right body projection. The left pocket is formed by the left body portion. The left pocket defines a lower left pocket portion formed by the lower left body portion that is configured to receive the lower left body projection and an upper left pocket portion is formed by the upper left body portion that is configured to receive the upper left body projection.

In some examples, the one or more plate portions includes a first plate portion and a second plate portion. The plurality of body portions that are spaced apart from the substantially central body portion of each of the first plate portion and the second plate portion includes: an upper right body projection, a lower right body projection, a lower left body projection, and an upper left body projection. The first body portion of the body of the plate engaging member is an upper body portion. The second body portion of the body of the plate engaging member is a lower body portion. Pockets formed by the upper body portion and the lower body portion includes: an upper right pocket, an upper left pocket and a lower pocket. The upper right pocket is formed by the upper body portion and is configured to receive the upper right body projection. The upper left pocket is formed by the upper body portion and is configured to receive the upper left body projection. The lower pocket is formed by the lower body portion. The lower pocket defines a lower right pocket portion that is configured to receive the lower right body projection and a lower left pocket portion that is configured to receive the lower left body projection.

The upper body portion further defines an upper lip. The lower body portion further defines a lower lip. The upper lip is secured to the lower lip for selectively containing the one or more plate portions within the plate engaging member.

The inner surface of the upper body portion defining the upper lip includes a patch of one of a hook material and a loop material that engages the other of the hook material and the loop material provided by the outer surface of the lower body portion defining the lower lip to provide a hook-and-loop connection of the upper lip and the lower lip.

Another aspect of the disclosure provides an assembly including torso apparel. The torso apparel includes at least one torso load distribution assembly and a carrier portion. The carrier portion includes at least one strap. The at least one strap includes a body having an inner surface and an outer surface. The inner surface of the body of the at least one strap proximate a first end of the body of the at least one strap is attached to a first portion of an outer surface of the plate engaging member of the at least one torso load distribution assembly. The inner surface of the body of the at least one strap proximate a second end of the body of the at least one strap is attached to a second portion of an outer surface of the plate engaging member of the at least one torso load distribution assembly.

This aspect may include one or more of the following optional features. In some implementations, the inner surface of the body of the at least one strap proximate the first end of the body of the at least one strap includes a first patch of one of a hook material and a loop material that engages the other of the hook material and the loop material provided by the first portion of the outer surface of the plate engaging member to provide a hook-and-loop connection of the first end of the body of the at least one strap to the first portion of the outer surface of the plate engaging member. The inner surface of the body of the at least one strap proximate the first end of the body of the at least one strap includes a second patch of one of a hook material and a loop material that engages the other of the hook material and the loop material provided by the second portion of the outer surface of the plate engaging member to provide a hook-and-loop connection of the second end of the body of the at least one strap to the second portion of the outer surface of the plate engaging member.

In some implementations, the at least one strap includes at least one shoulder strap.

In some examples, the at least one shoulder strap includes a first shoulder strap and a second shoulder strap.

In some implementations, the at least one strap includes at least one waist strap.

In some examples, the at least one waist strap includes a first waist strap and a second waist strap.

Yet another aspect of the disclosure provides an assembly configured for arrangement about a torso of a user. The assembly includes a chest area torso load distribution assembly, a back area torso load distribution assembly and a carrier portion. The carrier portion includes a first shoulder strap, a second shoulder strap, a first waist strap and a second waist strap. Each of the first shoulder strap, the second shoulder strap, the first waist strap and the second waist strap includes a body having an inner surface and an outer surface. The inner surface of the body of the first shoulder strap proximate a first end of the body of the first shoulder strap is attached to a first portion of an outer surface of the plate engaging member of the chest area torso load distribution assembly. The inner surface of the body of the first shoulder strap proximate a second end of the body of the first shoulder strap is attached to a first portion of an outer surface of the plate engaging member of the back area torso load distribution assembly. The inner surface of the body of the second shoulder strap proximate a first end of the body of the second shoulder strap is attached to a second portion of an outer surface of the plate engaging member of the chest area torso load distribution assembly. The inner surface of the body of the second shoulder strap proximate a second end of the body of the first shoulder strap is attached to a second portion of an outer surface of the plate engaging member of the back area torso load distribution assembly. The inner surface of the body of the first waist strap proximate a first end of the body of the first waist strap is attached to a third portion of an outer surface of the plate engaging member of the chest area torso load distribution assembly. The inner surface of the body of the first waist strap proximate a second end of the body of the first waist strap is attached to a third portion of an outer surface of the plate engaging member of the back area torso load distribution assembly. The inner surface of the body of the second waist strap proximate a first end of the body of the second waist strap is attached to a fourth portion of an outer surface of the plate engaging member of the chest area torso load distribution assembly. The inner surface of the body of the second waist strap proximate a second end of the body of the second waist strap is attached to a fourth portion of an outer surface of the plate engaging member of the back area torso load distribution assembly.

This aspect may include one or more of the following optional features. In some implementations, the inner surface of the body of each of the first shoulder strap, the second shoulder strap, the first waist strap and the second waist strap proximate the first end of the body of each of the first shoulder strap, the second shoulder strap, the first waist strap and the second waist strap includes a first patch of one of a hook material and a loop material that engages the other of the hook material and the loop material provided by each of the first portion, the second portion, the third portion and the fourth portion of the outer surface of the plate engaging member of each of the chest area torso load distribution assembly and the back area torso load distribution assembly to provide a hook-and-loop connection of the first end of the body of each of the first shoulder strap, the second shoulder strap, the first waist strap and the second waist strap to each of the first portion, the second portion, the third portion and the fourth portion of the outer surface of the plate engaging member of each of the chest area torso load distribution assembly and the back area torso load distribution assembly. The inner surface of the body of each of the first shoulder strap, the second shoulder strap, the first waist strap and the second waist strap proximate the second end of the body of each of the first shoulder strap, the second shoulder strap, the first waist strap and the second waist strap includes a second patch of one of a hook material and a loop material that engages the other of the hook material and the loop material provided by each of the first portion, the second portion, the third portion and the fourth portion of the outer surface of the plate engaging member of each of the chest area torso load distribution assembly and the back area torso load distribution assembly to provide a hook-and-loop connection of the second end of the body of each of the first shoulder strap, the second shoulder strap, the first waist strap and the second waist strap to each of the first portion, the second portion, the third portion and the fourth portion of the outer surface of the plate engaging member of each of the chest area torso load distribution assembly and the back area torso load distribution assembly.

Yet another aspect of the disclosure provides a method for providing a torso load distribution assembly. The method includes arranging one or more plate portions within a plate engaging member. The plate engaging member includes at least one dimension that is configured to be slightly smaller dimensionally than at least one dimension of the one or more plate portions for maintaining the one or more plate portions from a non-bowed orientation when the one or more plate portions is not arranged within the plate engaging member in a bowed orientation when the one or more plate portions is arranged within the plate engaging member for forming a spacing between a surface of the one or more plate portions and a surface of the plate engaging member.

This aspect may include one or more of the following optional features. In some implementations, the method also includes providing a torso apparel by attaching a carrier portion to an outer surface of the plate engaging member.

In some implementations, the carrier portion includes at least one strap. The at least one strap includes a body having an inner surface and an outer surface.

The attaching the carrier portion to the outer surface of the plate engaging member may include: attaching the inner surface of the body of the at least one strap proximate a first end of the body of the at least one strap to a first portion of the outer surface of the plate engaging member of the torso load distribution assembly and attaching the inner surface of the body of the at least one strap proximate a second end of the body of the at least one strap to a second portion of the outer surface of the plate engaging member of the torso load distribution assembly.

Yet another aspect of the disclosure provides a torso load distribution assembly. The torso load distribution assembly includes one or more plate portions and a plate engaging member. The one or more plate portions includes a body having a front surface, a rear surface and a side surface that joins the front surface to the rear surface. The body includes a plurality of body portions that are spaced apart from a substantially central body portion. The body is preformed to define an at-rest, non-flat, bowed orientation. The plate engaging member includes a body having central body portion, a first body portion connected to the central body portion and a second body portion connected to the central body portion. Each of the first body portion and the second body portion that attach to the plurality of body portions of the one or more plate portions. The body of the plate engaging member is configured to be stretched about the body of the one or more plate portions when the plurality of body portions of the one or more plate portions are attached to the plate engaging member.

This aspect may include one or more of the following optional features. In some implementations, the plurality of body portions that are spaced apart from the substantially central body portion includes: an upper right body projection, a lower right body projection, a lower left body projection and an upper left body projection. The first body portion of the body of the plate engaging member is an upper body portion. The second body portion of the body of the plate engaging member is a lower body portion. Pockets formed by the upper body portion and the lower body portion includes: an upper right pocket, an upper left pocket and a lower pocket. The upper right pocket is formed by the upper body portion and is configured to receive the upper right body projection. The upper left pocket is formed by the upper body portion and is configured to receive the upper left body projection. The lower pocket is formed by the lower body portion. The lower pocket defines a lower right pocket portion that is configured to receive the lower right body projection and a lower left pocket portion that is configured to receive the lower left body projection.

In some implementations, the upper body portion further defines an upper lip. The lower body portion further defines a lower lip. The upper lip is secured to the lower lip for selectively containing the one or more plate portions within the plate engaging member.

In some examples, the inner surface of the upper body portion defines the upper lip to include a patch of one of a hook material and a loop material that engages the other of the hook material and the loop material provided by the outer surface of the lower body portion defining the lower lip to provide a hook-and-loop connection of the upper lip and the lower lip.

Yet another aspect of the disclosure provides an assembly. The assembly includes torso apparel. The torso apparel includes at least one torso load distribution assembly and a carrier portion. The load distribution assembly includes one or more plate portions having a body that is preformed to define an at-rest, non-flat, bowed orientation. The carrier portion includes at least one strap. The at least one strap includes a body having an inner surface and an outer surface. The inner surface of the body of the at least one strap proximate a first end of the body of the at least one strap is attached to a first portion of an outer surface of the plate engaging member of the at least one torso load distribution assembly. The inner surface of the body of the at least one strap proximate a second end of the body of the at least one strap is attached to a second portion of an outer surface of the plate engaging member of the at least one torso load distribution assembly.

This aspect may include one or more of the following optional features. In some implementations, the inner surface of the body of the at least one strap proximate the first end of the body of the at least one strap includes a first patch of one of a hook material and a loop material that engages the other of the hook material and the loop material provided by the first portion of the outer surface of the plate engaging member to provide a hook-and-loop connection of the first end of the body of the at least one strap to the first portion of the outer surface of the plate engaging member. The inner surface of the body of the at least one strap proximate the first end of the body of the at least one strap includes a second patch of one of a hook material and a loop material that engages the other of the hook material and the loop material provided by the second portion of the outer surface of the plate engaging member to provide a hook-and-loop connection of the second end of the body of the at least one strap to the second portion of the outer surface of the plate engaging member.

In some implementations, the at least one strap includes: at least one shoulder strap.

In some examples, the at least one shoulder strap includes: a first shoulder strap and a second shoulder strap.

In some implementations, the at least one strap includes: at least one waist strap.

In some examples, the at least one waist strap includes: a first waist strap and a second waist strap.

This aspect may include one or more of the following optional features. In some implementations, the inner surface of the body of each of the first shoulder strap, the second shoulder strap, the first waist strap and the second waist strap proximate the first end of the body of each of the first shoulder strap, the second shoulder strap, the first waist strap and the second waist strap includes a first patch of one of a hook material and a loop material that engages the other of the hook material and the loop material provided by each of the first portion, the second portion, the third portion and the fourth portion of the outer surface of the plate engaging member of each of the chest area torso load distribution assembly and the back area torso load distribution assembly to provide a hook-and-loop connection of the first end of the body of each of the first shoulder strap, the second shoulder strap, the first waist strap and the second waist strap to each of the first portion, the second portion, the third portion and the fourth portion of the outer surface of the plate engaging member of each of the chest area torso load distribution assembly and the back area torso load distribution assembly. The inner surface of the body of each of the first shoulder strap, the second shoulder strap, the first waist strap and the second waist strap proximate the second end of the body of each of the first shoulder strap, the second shoulder strap, the first waist strap and the second waist strap includes a second patch of one of a hook material and a loop material that engages the other of the hook material and the loop material provided by each of the first portion, the second portion, the third portion and the fourth portion of the outer surface of the plate engaging member of each of the chest area torso load distribution assembly and the back area torso load distribution assembly to provide a hook-and-loop connection of the second end of the body of each of the first shoulder strap, the second shoulder strap, the first waist strap and the second waist strap to each of the first portion, the second portion, the third portion and the fourth portion of the outer surface of the plate engaging member of each of the chest area torso load distribution assembly and the back area torso load distribution assembly.

Yet another aspect of the disclosure provides a method for providing a torso load distribution assembly. The method includes arranging one or more plate portions within a plate engaging member. The one or more plate portions has a body that is preformed to define at at-rest, non-flat, bowed orientation, for stretching the plate engaging member from a substantially flat, non-stretched orientation when the one or more plate portions is not arranged within the plate engaging member to a substantially non-flat, stretched orientation when the one or more plate portions is arranged within the plate engaging member for forming a spacing between a surface of the one or more plate portions and a surface of the plate engaging member.

This aspect may include one or more of the following optional features. In some implementations, the method also includes providing a torso apparel by attaching a carrier portion to an outer surface of the plate engaging member.

In some implementations, the carrier portion includes at least one strap. The at least one strap includes a body having an inner surface and an outer surface.

In some examples, the step of attaching the carrier portion to the outer surface of the plate engaging member includes: attaching the inner surface of the body of the at least one strap proximate a first end of the body of the at least one strap to a first portion of the outer surface of the plate engaging member of the torso load distribution assembly and attaching the inner surface of the body of the at least one strap proximate a second end of the body of the at least one strap to a second portion of the outer surface of the plate engaging member of the torso load distribution assembly.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 2A is a cross-sectional view of the torso load distribution assembly according to line 2A of FIG. 1A.

FIG. 2A' is a cross-sectional view of a plate portion of the torso load distribution assembly according to line 2A'-2A' of FIG. 1A.

FIG. 2A" is a cross-sectional view of a plate container portion of the torso load distribution assembly according to line 2A"-2A" of FIG. 1A.

FIG. 2B is a cross-sectional view of the torso load distribution assembly according to line 2B-2B of FIG. 1E'.

FIG. 24A is a cross-sectional view of the torso load distribution assembly according to line 24A of FIG. 23A.

FIG. 24A' is a cross-sectional view of a plate portion of the torso load distribution assembly according to line 24A'-24A' of FIG. 23A.

FIG. 24A" is a cross-sectional view of a plate container portion of the torso load distribution assembly according to line 24A"-24A" of FIG. 23A.

FIG. 24B is a cross-sectional view of the torso load distribution assembly according to line 24B-24B of FIG. 24E'.

DETAILED DESCRIPTION

Figure 9A:
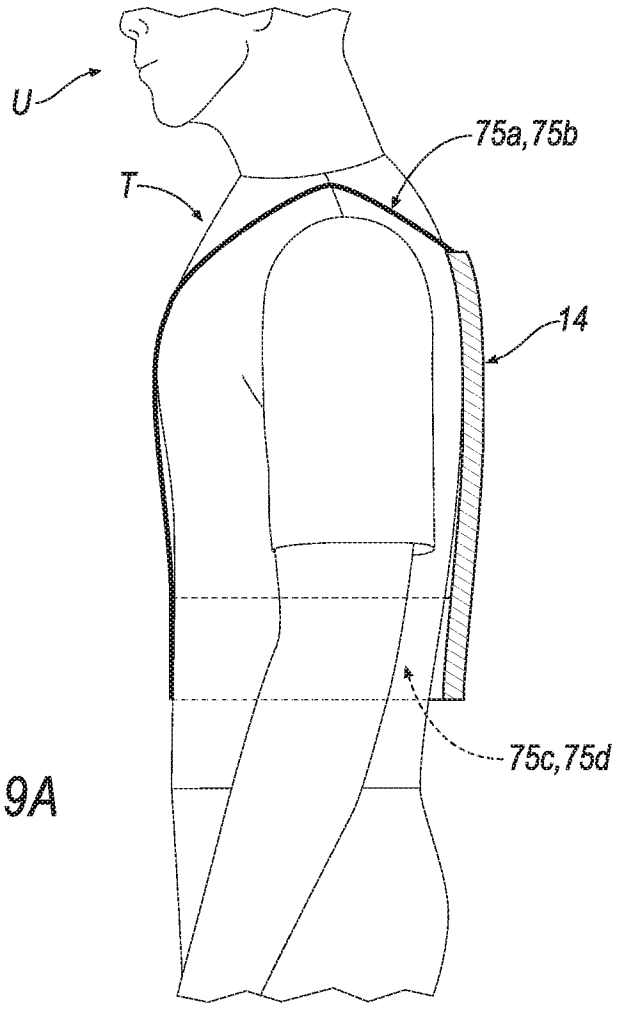
FIG. 9A is a side cross-sectional view of exemplary torso apparel disposed upon a torso of a user whereby the torso apparel includes: a plate container portion without a plate portion disposed therein that is arranged over a back portion of the user's torso.
Figure 9B:
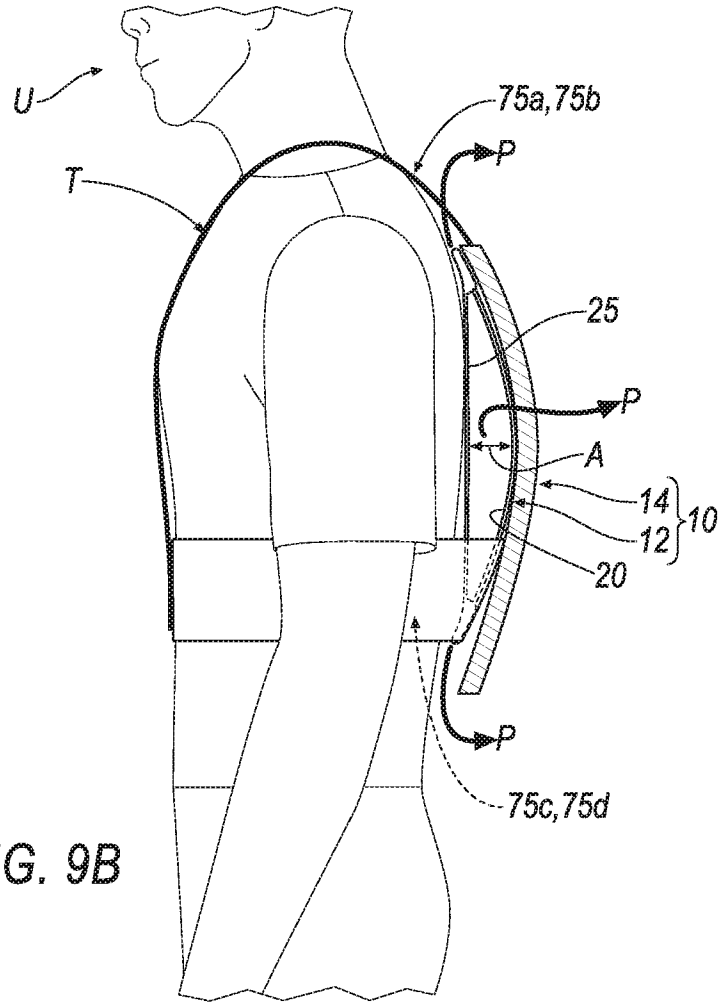
FIG. 9B is a side cross-sectional view of exemplary torso apparel disposed upon a torso of a user whereby the torso apparel includes: a torso load distribution assembly arranged over a back portion of the user's torso.
Figure 8B:
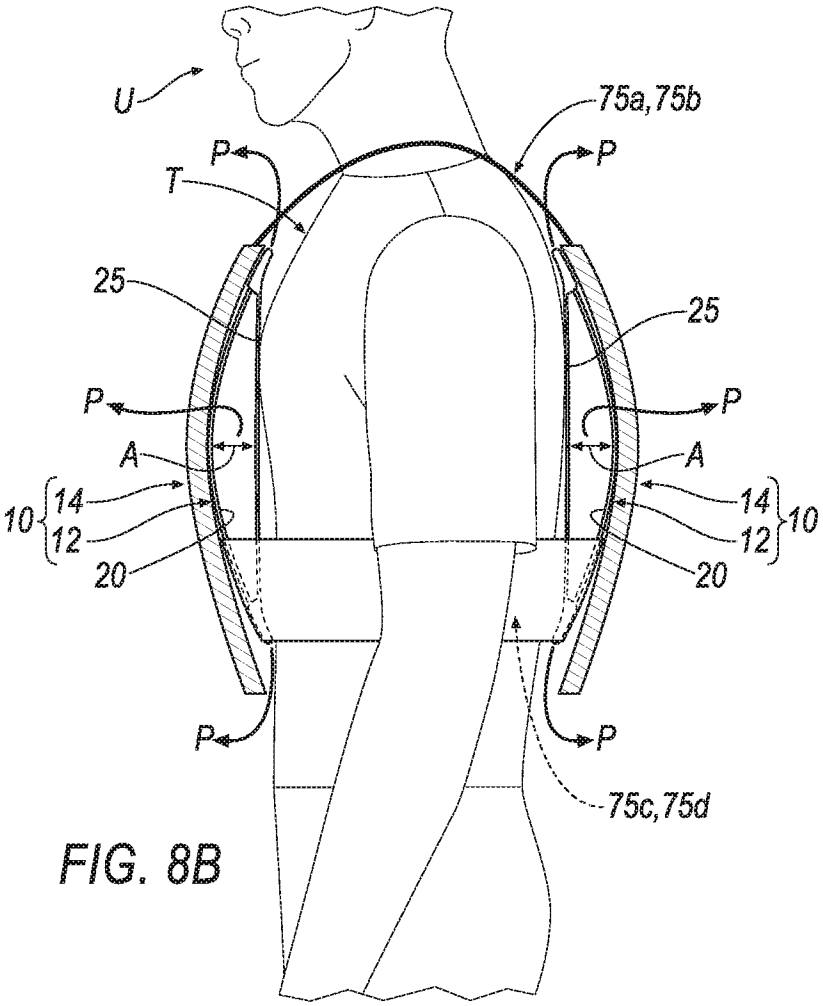
FIG. 8B is a side cross-sectional view of exemplary torso apparel disposed upon a torso of a user whereby the torso apparel includes: (1) a torso load distribution assembly arranged over a chest portion of the user's torso, and (2) a torso load distribution assembly arranged over a back portion of the user's torso.
Figure 12A:
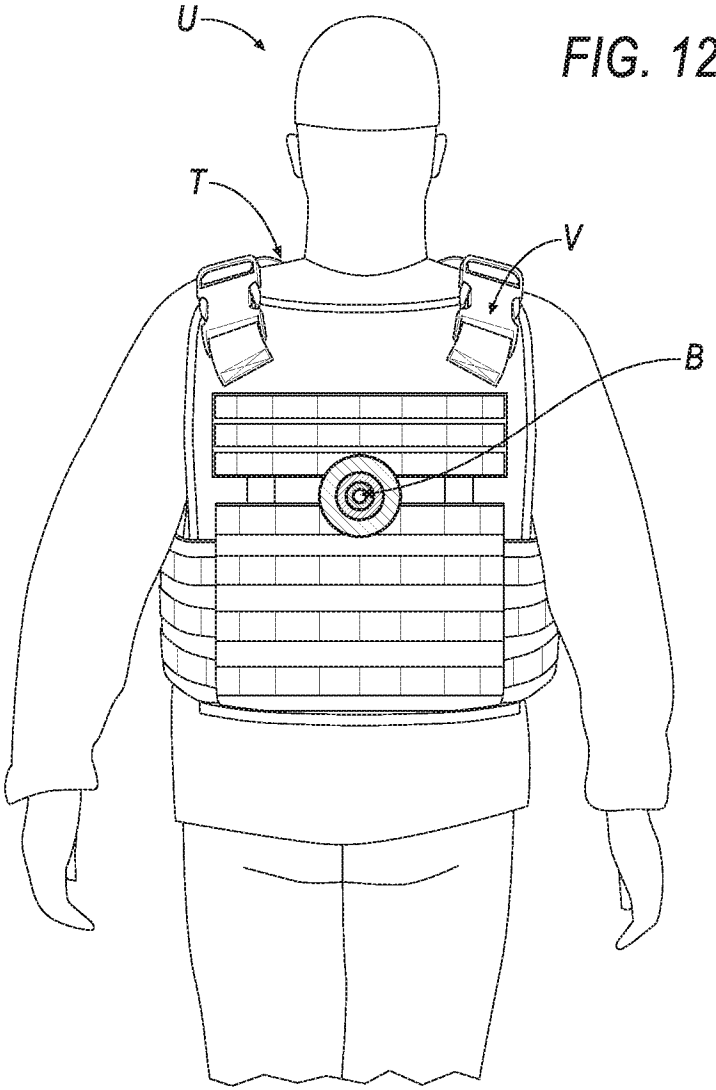
FIG. 12A is a rear view of the torso apparel of FIG. 11A and corresponding distribution of the impact force over the concentrated area of the back portion of the user's torso.
Figure 11A:
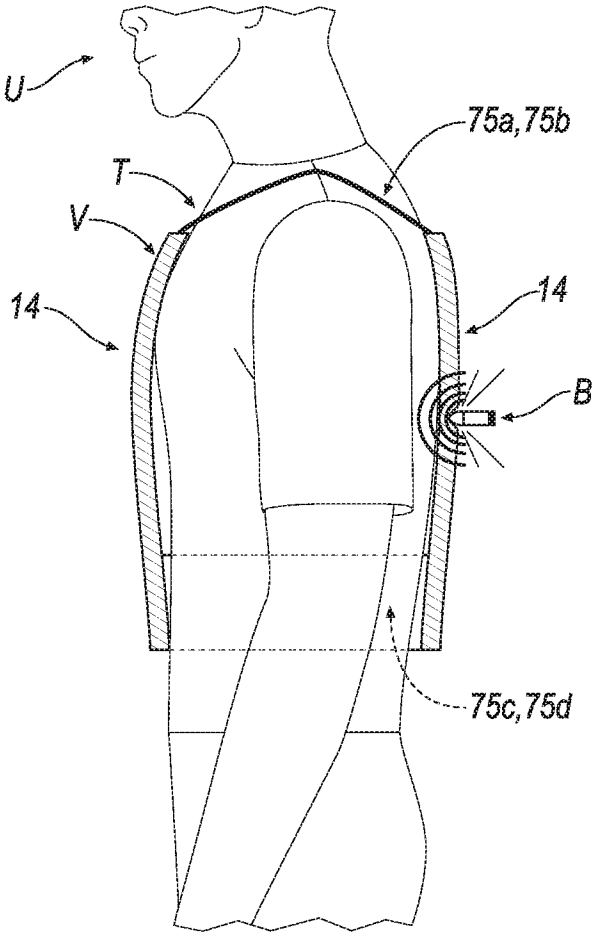
FIG. 11A is a side cross-sectional view of exemplary torso apparel disposed upon a torso of a user whereby the torso apparel includes: (1) a plate container portion without a plate portion disposed therein that is arranged over a chest portion of the user's torso, and (2) a plate container portion without a plate portion disposed therein that is arranged over a back portion of the user's torso that is distributing an impact force is imparted to a concentrated area of the back portion of the user's torso.
Figure 12B:
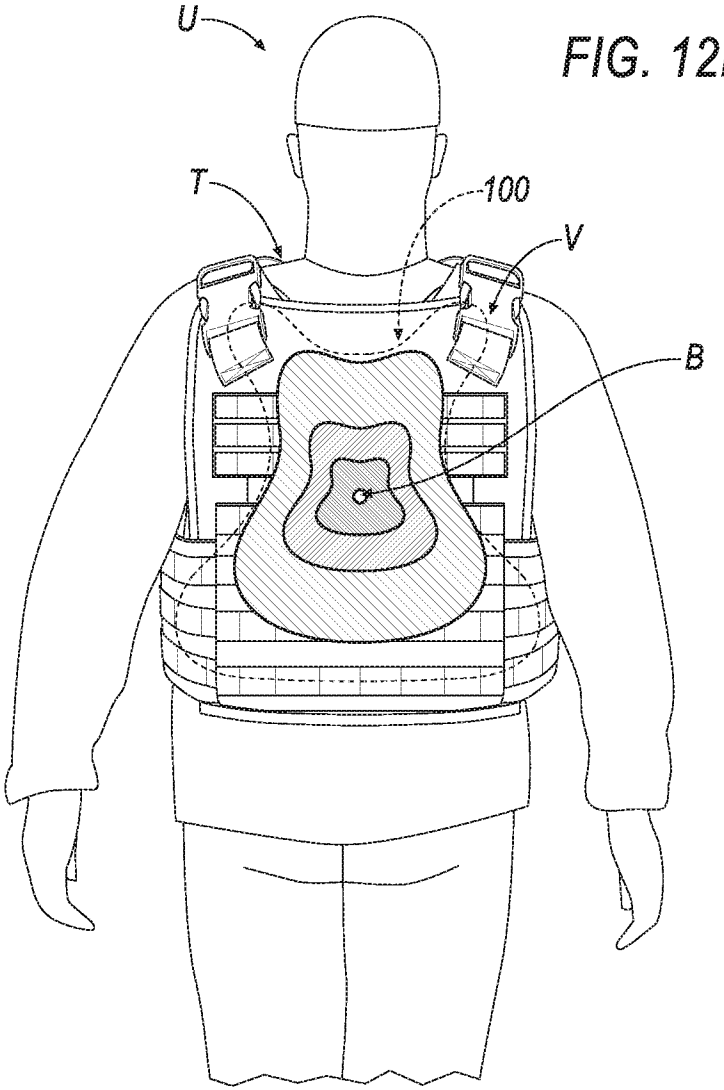
FIG. 12B is a rear view of the torso apparel of FIG. 11B and corresponding distribution of the impact force over the large area of the back portion of the user's torso.

FIGS. 1A-2B illustrate an exemplary torso load distribution assembly 10 (which may alternatively referred to as an impact reduction system). The torso load distribution assembly 10 includes a plate portion 12 (see also, e.g., FIGS. 2A', 3) and a plate container portion 14 (see also, e.g., FIGS. 2A", 4A-4B). As will be described in the following disclosure at FIG. 5, at least one (e.g., two) torso load distribution assembly 10 may be attached to a carrier portion 75 for forming torso apparel 100. As will be described in the following disclosure at FIGS. 6-9B, when torso apparel 100 is disposed upon a torso T (see, e.g., FIG. 6) of a user U (see, e.g., FIG. 6), at least one torso load distribution assembly 10 included therein forms a spacing or air gap A (see, e.g., FIGS. 7A-7C, 8B, 9B) between a surface (see, e.g., reference numeral 20) of the plate portion 12 and a surface (see, e.g., reference numeral 25) of the plate container portion 14. In one example, the spacing or air gap A provides a plurality of air flow paths P (see, e.g., FIGS. 8B, 9B) that permit heat generated by the torso T of the user U to easily escape to surrounding atmosphere. Furthermore, as will be described in the following disclosure at FIGS. 10-13C, when torso apparel 100 is disposed upon a torso T (see, e.g., FIG. 10) of a user U (see, e.g., FIG. 10), the at least one torso load distribution assembly 10 included therein (which also includes a spacing or air gap A) assists in distributing an impact force imparted to an outboard surface of the at least one torso load distribution assembly 10 such that most of the impact force is distributed by the at least one torso load distribution assembly 10, and ultimately, over a large area (as seen in, e.g., FIGS. 11B, 12B) of the torso T of the user U rather than a concentrated area (as seen in, e.g., FIGS. 11A, 12A) of the torso T of the user U.

Figure 1A:
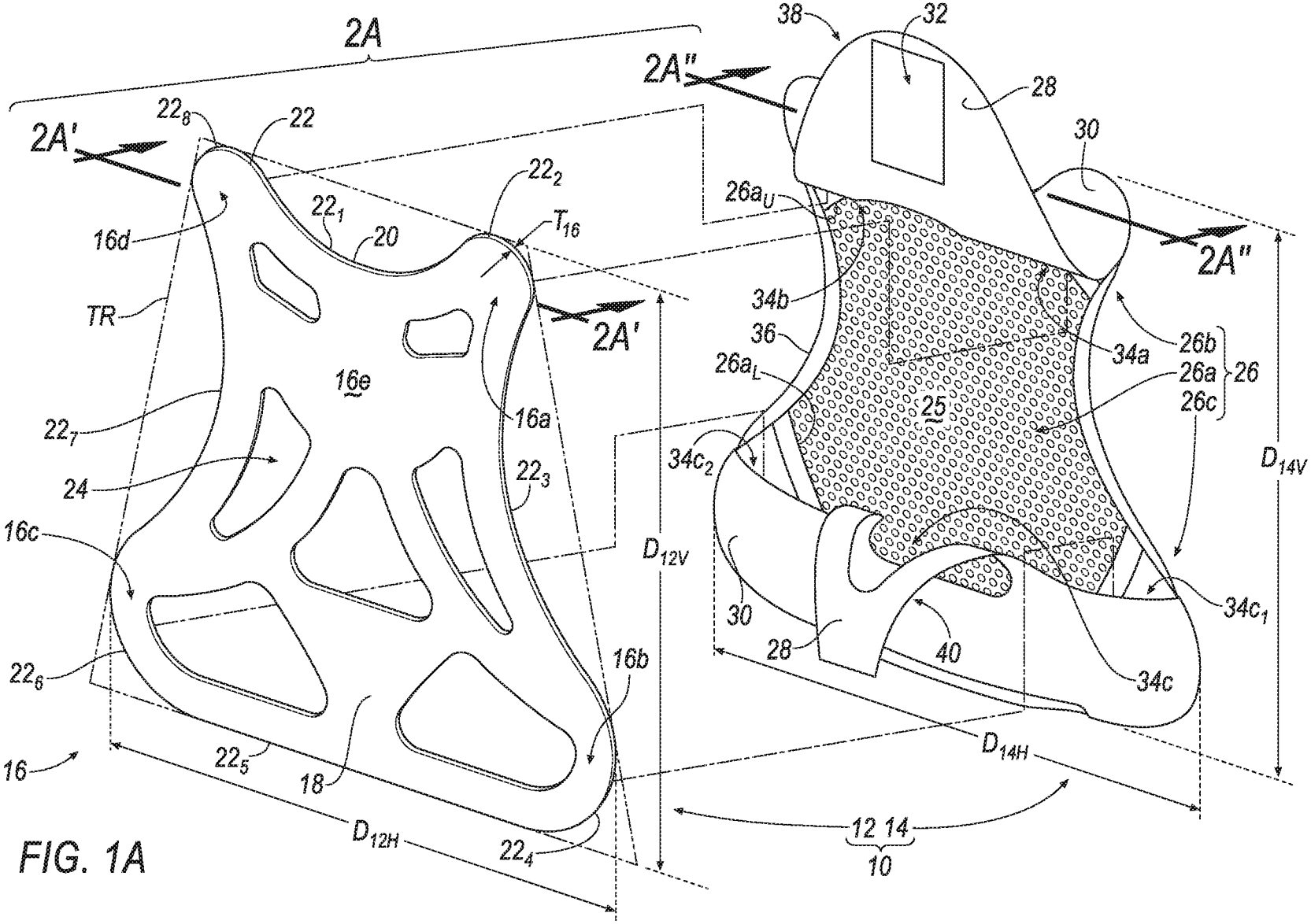
FIGS. 1A-1F illustrate views of an exemplary torso load distribution assembly.

Referring to FIG. 1A, the plate portion 12 includes a body 16 having a front surface 18 and a rear surface 20 and a side surface 22 that joins the front surface 18 to the rear surface 20. The body 16 is substantially flat; however, the body 16 may be formed by a flexible material (e.g., any desirable plastic material or KEVLAR®-impregnated resin) that permits the body 16 to be manipulated from an at-rest, substantially flat orientation (as seen in, e.g., FIGS. 1A-1C) to a flexed or bowed orientation (as seen in, e.g., FIGS. 1D-1E").

The body 16 is defined by a thickness $T_{16}$ extending between the front 18 surface and the rear surface 20. The body 16 forms a plurality (e.g., seven) of passages 24; the plurality of passages 24 extend through the thickness $T_{16}$ of the body 16. The plurality of passages 24 may reduce the weight of the plate portion 12 and provide additional air flow paths P.

The side surface 22 of the body 16 is defined by a plurality of side surface segments $\mathbf{22}_1$-$\mathbf{22}_8$. In one example, the plurality of side surface portions segments $\mathbf{22}_1$-$\mathbf{22}_8$ includes a combination of at least one concave surface segment (see, e.g., $\mathbf{22}_2$, $\mathbf{22}_4$, $\mathbf{22}_6$, $\mathbf{22}_8$), at least one convex surface segment (see, e.g., $\mathbf{22}_1$, $\mathbf{22}_3$, $\mathbf{22}_7$) and at least one substantially straight surface segment (see, e.g., $\mathbf{22}_5$).

In an example, an exemplary side surface 22 of the body 16 of the plate portion 12 may include the following geometry. At approximately a "twelve o'clock" location of the side surface 22, the side surface 22 includes a convex surface segment $\mathbf{22}_1$ that is connected to a concave surface segment $\mathbf{22}_2$ that is located at approximately a "one o'clock" location of the side surface 22. At approximately a "three o'clock" location of the side surface 22, the side surface 22 includes a convex surface segment $\mathbf{22}_3$ that is connected to the concave surface segment $\mathbf{22}_2$ that is located at approximately the "one o'clock" location of the side surface 22. At approximately a "four o'clock" location of the side surface 22, the side surface 22 includes a concave surface segment $\mathbf{22}_4$ that is connected to the convex surface segment $\mathbf{22}_3$ that is located at approximately the "three o'clock" location of the side surface 22. At approximately a "six o'clock" location of the side surface 22, the side surface 22 includes a substantially straight surface segment $\mathbf{22}_5$ that is connected to the concave surface segment $\mathbf{22}_4$ that is located at approximately the "four o'clock" location of the side surface 22. At approximately an "eight o'clock" location of the side surface 22, the side surface 22 includes a concave surface segment $\mathbf{22}_6$ that is connected to the substantially straight surface segment $\mathbf{22}_5$ that is located at approximately the "six o'clock" location of the side surface 22. At approximately a "nine o'clock" location of the side surface 22, the side surface 22 includes a convex surface segment $\mathbf{22}_7$ that is connected to the concave surface segment $\mathbf{22}_6$ that is located at approximately the "eight o'clock" location of the side surface 22. At approximately an "eleven o'clock" location of the side surface 22, the side surface 22 includes a concave surface segment $\mathbf{22}_8$ that is connected to the convex surface segment $\mathbf{22}_7$ that is located at approximately the "nine o'clock" location of the side surface 22. The concave surface segment $\mathbf{22}_8$ that is located at approximate the "eleven o'clock" location of the side surface 22 is connected to the convex surface segment $\mathbf{22}_1$ that is located at approximately the "twelve o'clock" location of the side surface 22.

Although the exemplary side surface 22 of the body 16 of the plate portion 12 described above includes one substantially straight surface segment (see, e.g., the substantially straight surface segment $\mathbf{22}_5$) and a plurality of arcuate surface segments (see, e.g., the convex surface segments $\mathbf{22}_1$, $\mathbf{22}_3$, $\mathbf{22}_7$ and the concave surface segments $\mathbf{22}_2$, $\mathbf{22}_4$, $\mathbf{22}_6$, $\mathbf{22}_8$), the plurality of side surface segments $\mathbf{22}_1$-$\mathbf{22}_8$ may be selectively shaped to form a plate portion 12 having any desirable shape. In an example, the plurality of side surface segments $\mathbf{22}_1$-$\mathbf{22}_8$ may be selectively shaped such that the plurality of side surface segments $\mathbf{22}_1$-$\mathbf{22}_8$ are collectively bound by a substantially trapezoidal-shaped area (see, e.g., trapezoidal shaped dashed line TR surrounding the side surface 22 of the body 16 of the plate portion 12).

Furthermore, the exemplary side surface 22 of the body 16 of the plate portion 12 described above may shape the body 16 to define a plurality of body projections 16*a*-16*d* (or, alternatively, body portions) that extend away or are spaced apart from a substantially central body portion 16*e*. The plurality of body projections 16*a*-16*d* may include an upper right body projection 16*a*, a lower right body projection 16*b*, a lower left body projection 16*c* and an upper left body projection 16*d*. The upper right body projection 16*a* may be defined by a portion of the convex surface segment $\mathbf{22}_1$, the concave surface segment $\mathbf{22}_2$ and a portion of the convex surface segment $\mathbf{22}_3$. The lower right body projection 16*b* may be defined by a portion of the convex surface segment $\mathbf{22}_3$, the concave surface segment $\mathbf{22}_4$ and a portion of the substantially straight surface segment $\mathbf{22}_5$. The lower left body projection 16*c* may be defined by a portion of the substantially straight surface segment $\mathbf{22}_5$, the concave surface segment $\mathbf{22}_6$ and a portion of the convex surface segment $\mathbf{22}_7$. The upper left body projection 16*d* may be defined by a portion of the convex surface segment $\mathbf{22}_7$, the concave surface segment $\mathbf{22}_8$ and a portion of the convex surface segment $\mathbf{22}_1$.

With continued reference to FIG. 1A, the plate container portion 14 (or, alternatively, a plate engaging member) includes a body 26 having a central body portion 26*a*, an upper body portion 26*b* and a lower body portion 26*c*. The upper body portion 26*b* is connected to an upper end $\mathbf{26}a_U$ of the central body portion 26*a*. The lower body portion 26*c* is connected to a lower end $\mathbf{26}a_L$ of the central body portion 26*a*. Each of the upper body portion 26*b* and the lower body portion 26*c* may be connected, respectively, to the upper end $\mathbf{26}a_U$ and the lower end $\mathbf{26}a_L$ of the central body portion 26*a* by stitching, glue, welding or the like.

In some instances, the central body portion 26*a* may include a stretchable fabric mesh material including a plurality of passages. In some examples, each of the upper body portion 26*b* and the lower body portion 26*c* may include a fabric material having an inner surface 28 and an outer surface 30. The inner surface 28 may be defined by a canvas material. The outer surface 30 may be defined by a "loop" material that may cooperate with a "hook" material (see, e.g., reference numeral 32) to define to "hook-and-loop" connection (e.g., VELCRO®). In some examples, the inner surface 28 of at least one of the upper body portion 26*b* and the lower body portion 26*c* includes a patch of material 32; the patch of material 32 may be defined by a "hook" material that may cooperate with a "loop" material (see, e.g., reference numeral 30) to define to "hook-and-loop" connection (e.g., VELCRO®).

The upper body portion 26*b* defines the plate container portion 14 to include an upper right pocket 34*a* and an upper left pocket 34*b*. The lower body portion 26*c* defines the plate container portion 14 to include a lower pocket 34*c*; the lower pocket 34*c* defines a lower right pocket portion $\mathbf{34}c_1$ and a lower left pocket portion $\mathbf{34}c_2$.

The body 26 of the plate container portion 14 includes a substantially similar shape with respect to the body 16 of the plate portion 12. For example, the body 26 of the plate container portion 14 is defined by a side surface 36 that is substantially similar to the geometry of the side surface 22 of the body 16 of the plate portion 12 (i.e., the side surface 36 of the plate container portion 14 includes a similar combination of: (1) at least one concave surface segment (corresponding to the concave surface segments $\mathbf{22}_2$, $\mathbf{22}_4$, $\mathbf{22}_6$, $\mathbf{22}_8$ of the side surface 22 of the body 16 of the plate portion 12), (2) at least one convex surface segment (corresponding to the convex surface segments $\mathbf{22}_1$, $\mathbf{22}_3$, $\mathbf{22}_7$ of the side surface 22 of the body 16 of the plate portion 12), and (3) at least one substantially straight surface segment (corresponding to the substantially straight surface segment $\mathbf{22}_5$ of the side surface 22 of the body 16 of the plate portion 12). Although the side surface 36 of the body 26 of the plate container portion 14 includes a substantially similar shape with respect to the side surface 22 of the body 16 of the plate portion 12, the side surface 36 of the body 26 of the plate container portion 14 is defined by slightly smaller dimensions (e.g., a vertical distance dimension $D_{14V}$ and a horizontal distance dimension $D_{14H}$) than dimensions (e.g., a vertical distance dimension $D_{12V}$ and a horizontal distance dimension $D_{12H}$) formed by the side surface 22 of the body 16 of the plate portion 12.

With continued reference to FIG. 1A, the upper body portion 26*b* defines an upper lip 38 of the body 26 of the plate container portion 14. The lower body portion 26*c* defines a lower lip 40 of the body 26 of the plate container portion 14. The upper lip 38 of the upper body portion 26*b* is also defined by the inner surface 28 and the outer surface 30 as described above. In some examples, the inner surface 28 of the upper lip 38 may include the patch of material 32 that is defined by the "hook" material of a "hook-and-loop" connection; as will be described in the following disclosure at FIGS. 1D-1E", the "hook" material provided by the patch of material 32 upon of the upper lip 38 may cooperate with the "loop" material provided by the outer surface 30 of the lower lip 40 of the body 26 of the plate container portion 14 to provide a "hook-and-loop" connection (e.g., VELCRO®) for selectively connecting the upper lip 38 to the lower lip 40.

Referring to FIGS. 1B-1E", a method for assembling the exemplary torso load distribution assembly 10 is described. In some instances, the plate container portion 14 is configured to contain the plate portion 12. In other examples, the plate engaging member 14 is attached to the plate portion 12.

Figure 1B:
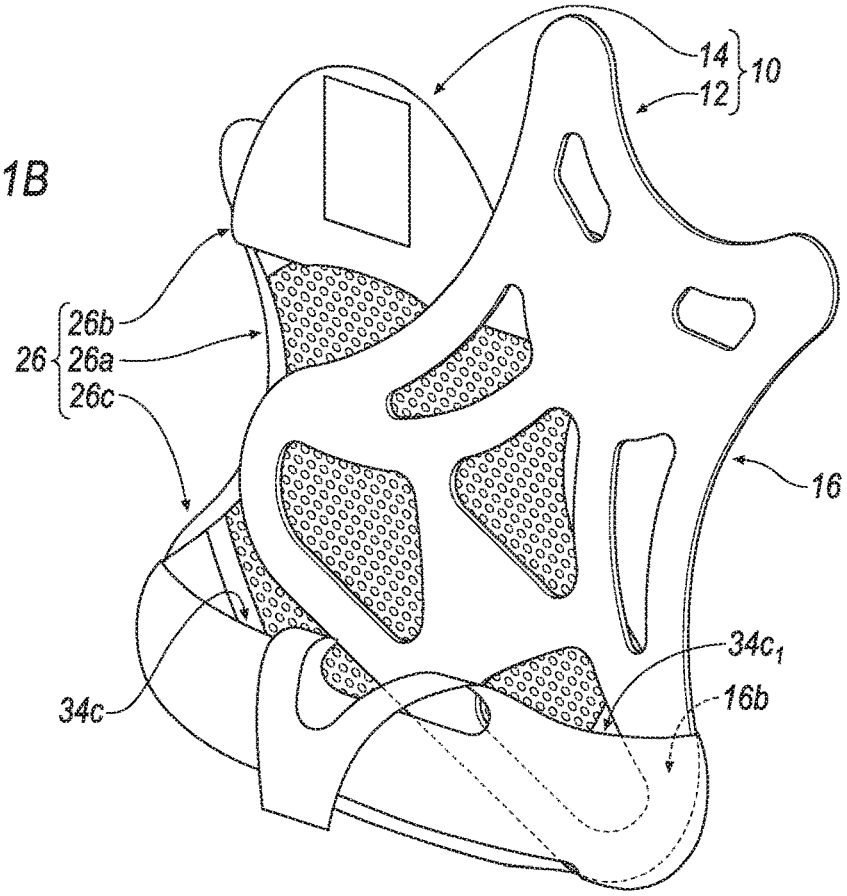
Figure 1C:
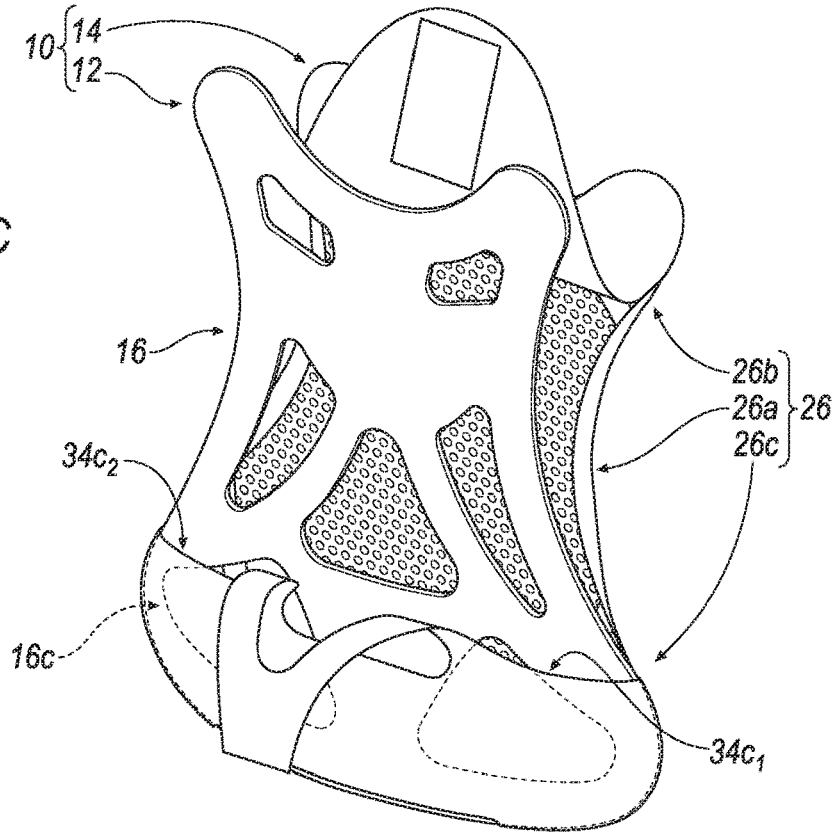

Firstly, as seen at FIG. 1B, the lower right body projection 16*b* of the body 16 of the plate portion 12 is disposed within the lower right pocket portion $\mathbf{34}c_1$ of the lower pocket 34*c* formed by the lower body portion 26*c* of the body 26 of the plate container portion 14. Then, as seen at FIG. 1C, the lower left body projection 16*c* of the body 16 of the plate portion 12 is disposed within the lower left pocket portion $\mathbf{34}c_2$ of the lower pocket 34*c* formed by the lower body portion 26*c* of the body 26 of the plate container portion 14.

Figure 1D:
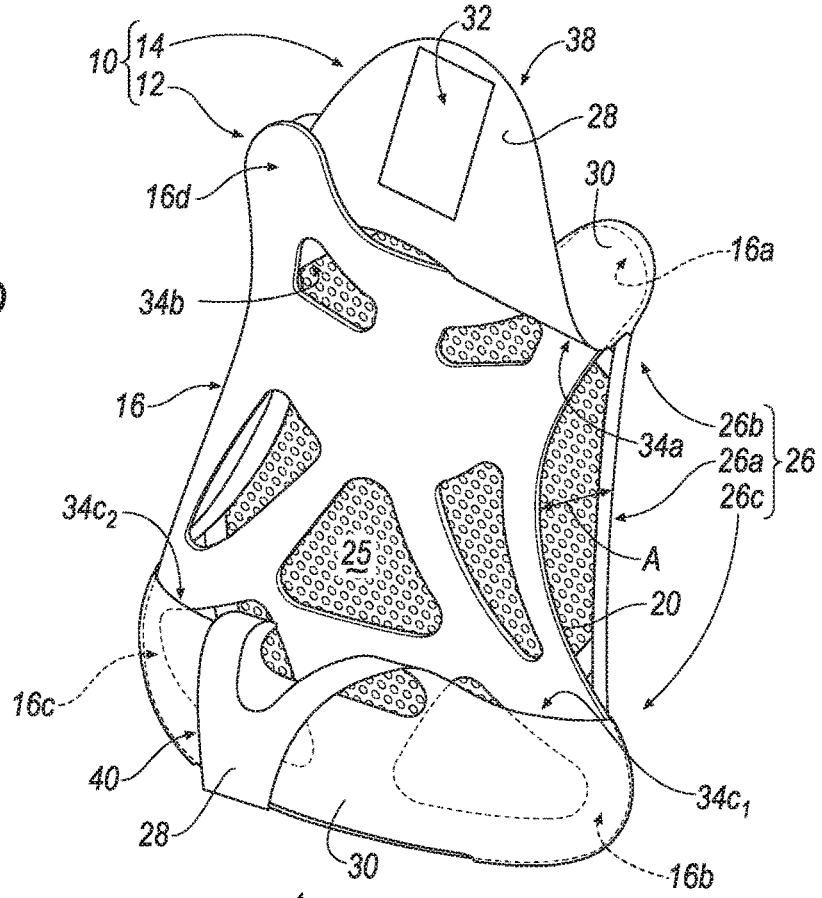

Then, referring to FIG. 1D, the upper right body projection 16*a* of the body 16 of the plate portion 12 is disposed within the upper right pocket 34*a* formed by the upper body portion 26*b* of the body 26 of the plate container portion 14. Then, referring to FIGS. 1D-1E', the upper left body projection 16*d* of the body 16 of the plate portion 12 is disposed within the upper left pocket 34*b* formed by the upper body portion 26*b* of the body 26 of the plate container portion 14.

Figure 1E:
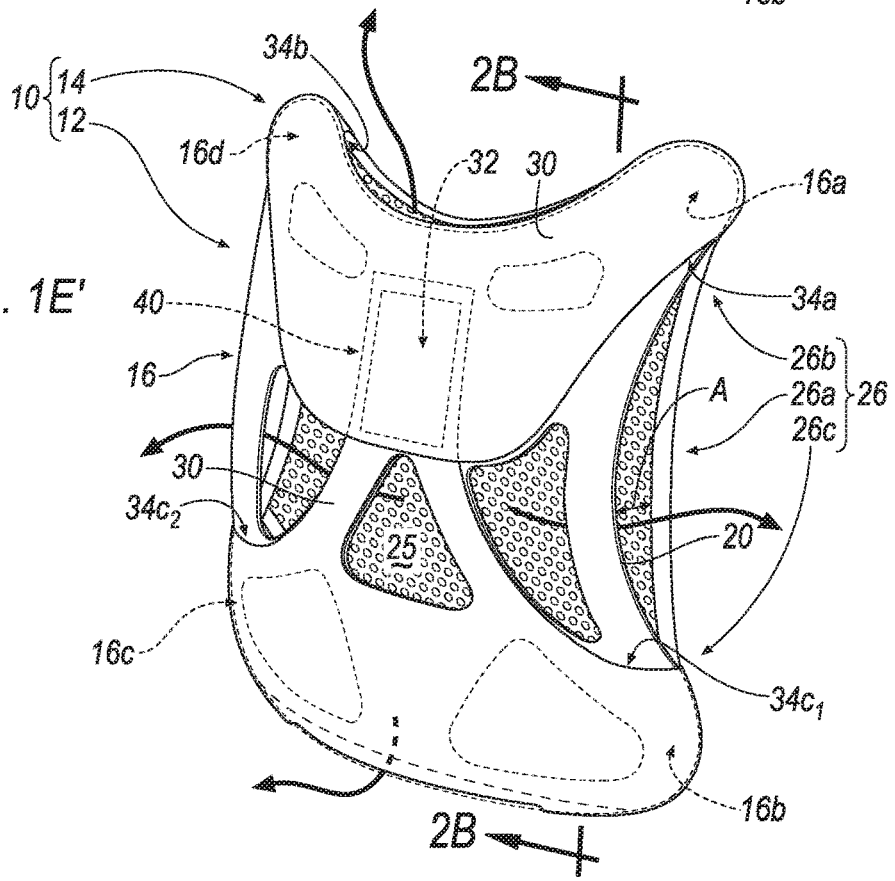
Figure 1F:
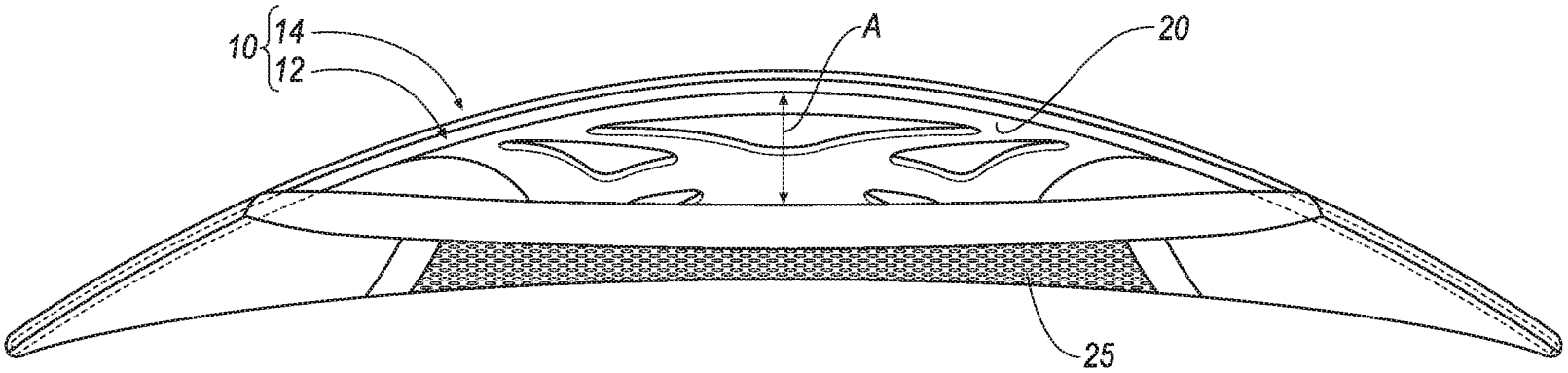

With reference to FIGS. 1D and 1E'-1E", once all of the plurality of body projections 16*a*-16*d* of the plate portion 12 are arranged within the pockets 34*a*, 34*b*, $\mathbf{34}c_1$, $\mathbf{34}c_2$ formed by the plate container portion 14 as described above, the lower lip 40 of the lower body portion 26*c* of the body 26 of the plate container portion 14 is arranged over the substantially central body portion 16*e* of the body 16 of the plate portion 12. Then, the upper lip 38 of the upper body portion 26*b* of the body 26 of the plate container portion 14 is arranged over the lower lip 40 of the of the lower body portion 26*c* of the body 26 of the plate container portion 14 and the substantially central body portion 16*e* of the body 16 of the plate portion 12 such that the patch of material 32 including the "hook" material provided upon of the inner surface 28 of the upper lip 38 may cooperate with the "loop" material provided by the outer surface 30 of the lower lip 40 to provide a "hook-and-loop" connection (e.g., VELCRO®) for selectively connecting the upper lip 38 to the lower lip 40 (as seen in, e.g., FIG. 1E') and thereby selectively containing the plate portion 12 within the plate container portion 14.

As seen in FIGS. 1D-1F and 2B, once at least three body projections (see, e.g., at least the lower right body projection 16*b*, the lower left body projection 16*c* and the upper right body projection 16*a* in FIG. 1D) of the plurality of body projections 16*a*-16*d* are respectively arranged within three pockets (see, e.g., the lower right pocket portion $\mathbf{34}c_1$ of the lower pocket 34*c*, the lower left pocket portion $\mathbf{34}c_2$ of the lower pocket 34*c* and the upper right pocket 34*a*) of the plate container portion 14, the body 16 of the plate portion 12 is manipulated from an at-rest, substantially flat orientation (as seen in, e.g., FIGS. 1A-1C) to a flexed or bowed orientation (as seen in, e.g., FIGS. 1D-1E") due to the side surface 36 of the body 26 of the plate container portion 14 being defined to be slightly smaller dimensionally (see, e.g., $D_{14V}$, $D_{14H}$) than dimensions (see, e.g., $D_{12V}$, $D_{12H}$) formed by the side surface 22 of the body 16 of the plate portion 12. Therefore, as seen in FIGS. 1D, 1E', 1E", 1F, and 2B, as a result of the flexing or bowing of the plate portion 12, the rear surface 20 of the plate portion 12 is biased away from an inner surface 25 of the central body portion 26*a* of the body 26 of the plate container portion 14 for forming a spacing or air gap A there-between.

Although an implementation of the torso load distribution assembly 10 is directed to the plate portion 12 being contained within the plate container portion 14 by way of pockets 34*a*, 34*b*, 34*c* for attaching the plate portion 12 to the plate container portion 14, attachment of the plate portion 12 to the plate container portion 14 is not limited to disposing the plate portion 12 within pockets 34*a*, 34*b*, 34*c* formed by the plate container portion 14. Accordingly, the plate portion 12 may be attached to the plate container portion 14 utilizing any desirable mechanical and/or chemical means. In some instances, the plate portion 12 may be attached to the plate container portion 14 by way of one or more of, for example: straps, belts, clips, buttons, zippers, snap fasteners, adhesive, ultrasonic welding or the like.

Figure 5:
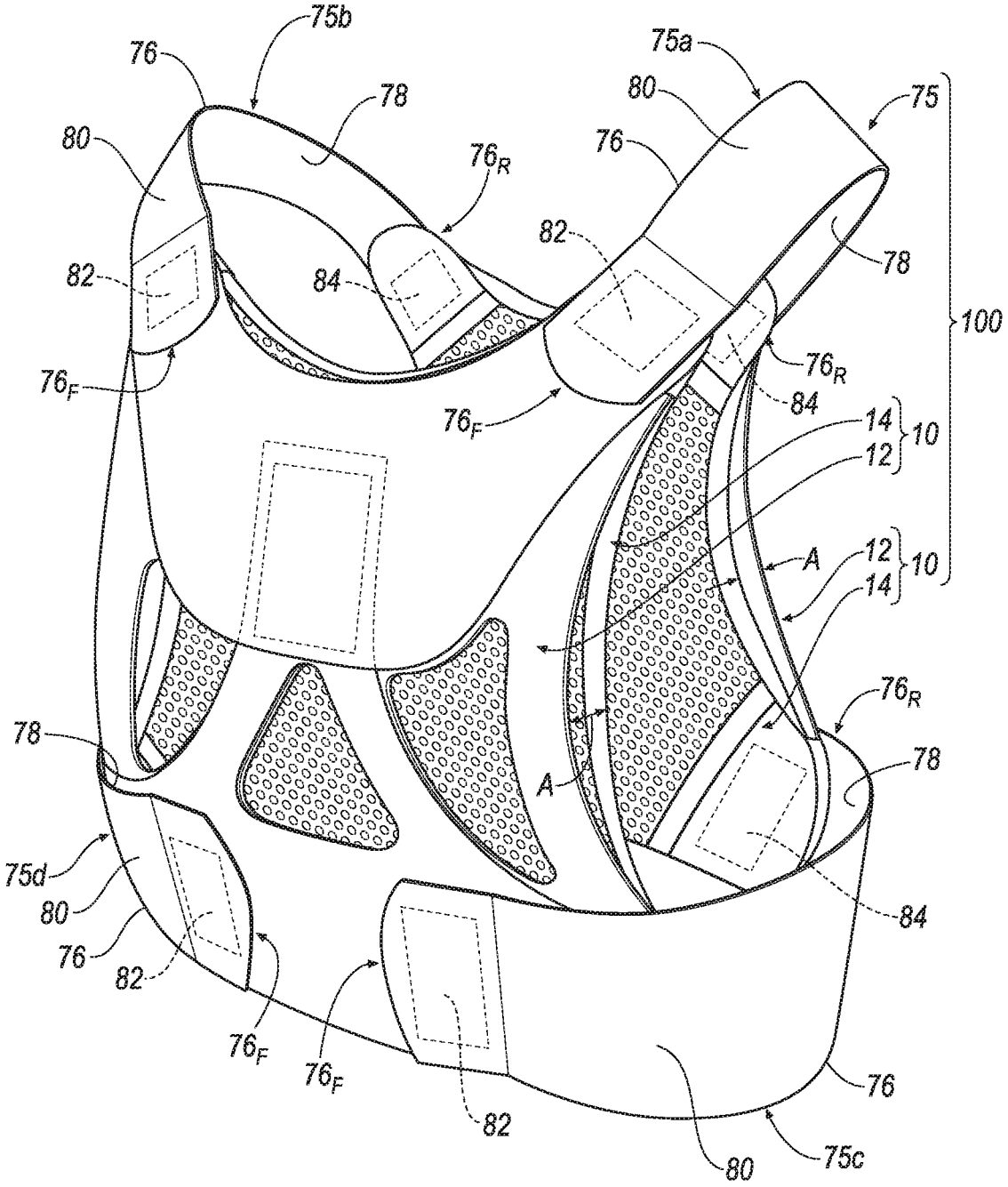
FIG. 5 is a perspective view of torso apparel including: (1) a first torso load distribution assembly of FIGS. 1A-1F attached to a carrier portion that is arranged for disposal over a chest area of a torso of a user, and (2) a second torso load distribution assembly of FIGS. 1A-1F attached to the carrier portion that is arranged for disposal over a back area of a torso of a user.
Figure 6:
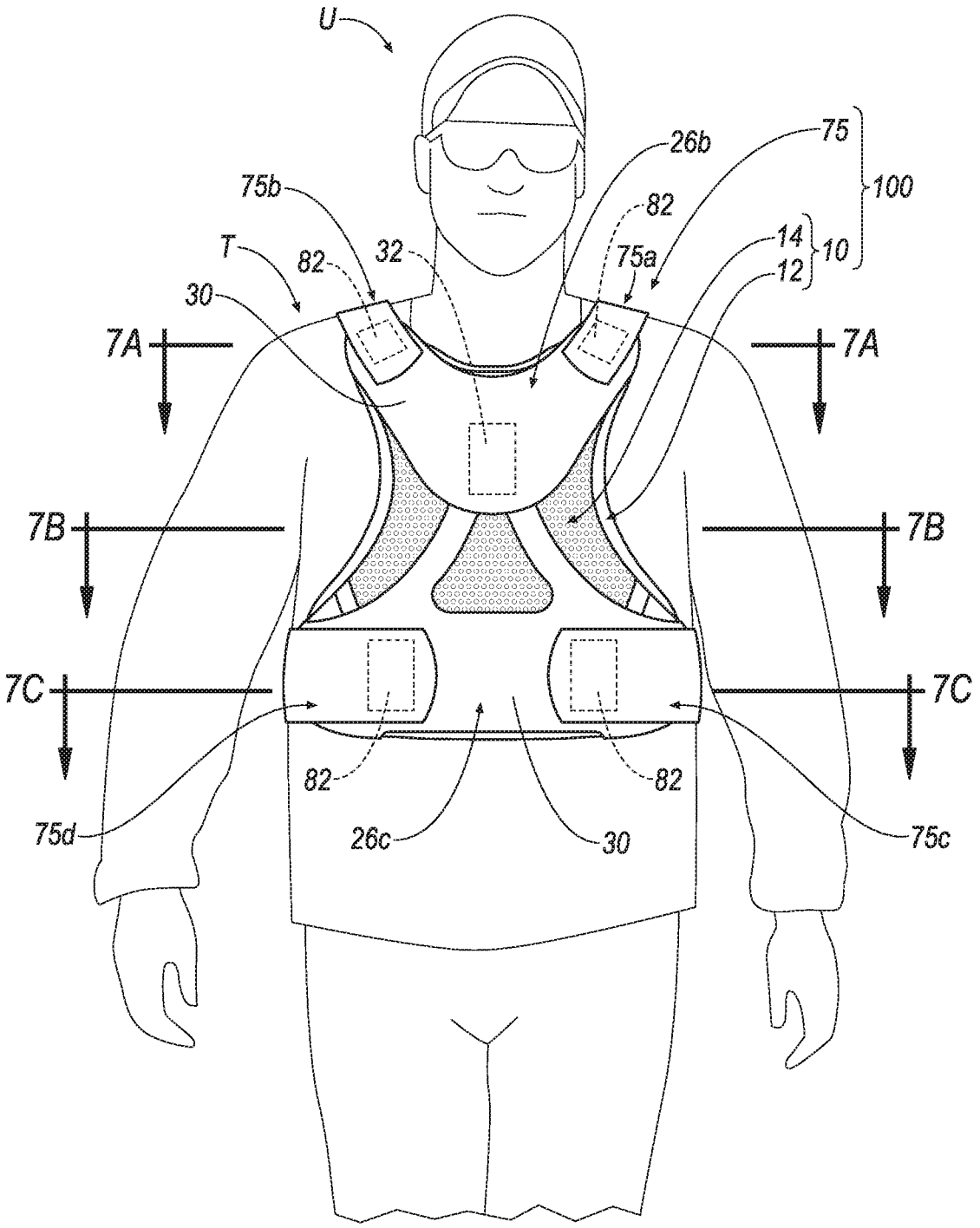
FIG. 6 is a front view of the torso apparel of FIG. 5 disposed upon a torso of a user.
Figure 7A:
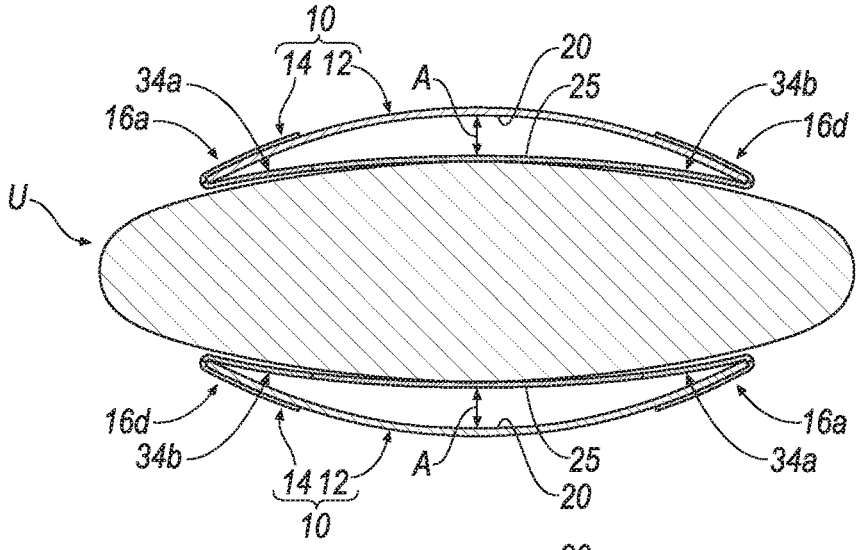
FIG. 7A is a cross-sectional view according to line 7A-7A of FIG. 6.
Figure 7B:
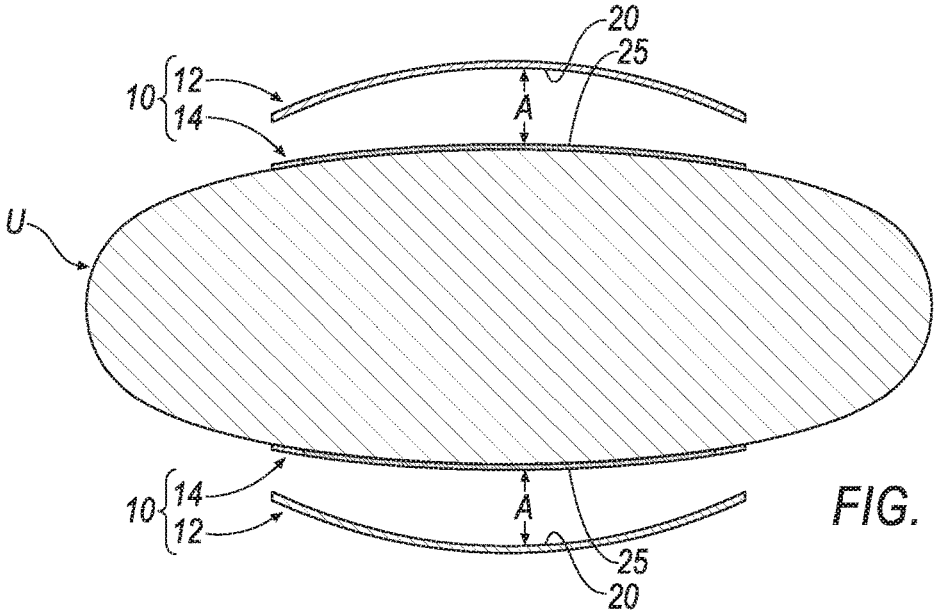
FIG. 7B is a cross-sectional view according to line 7B-7B of FIG. 6.
Figure 7C:
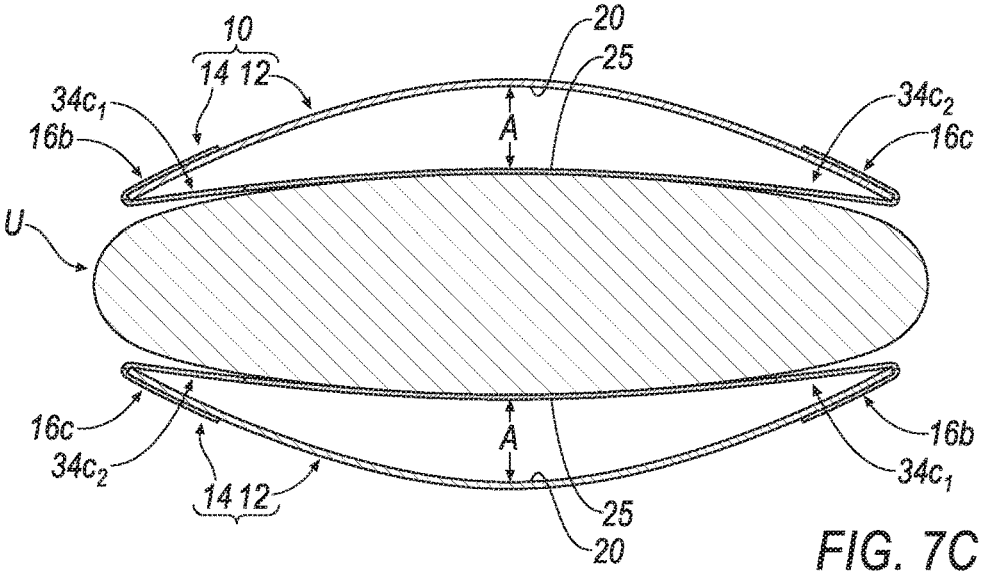
FIG. 7C is a cross-sectional view according to line 7C-7C of FIG. 6.
Figure 8A:
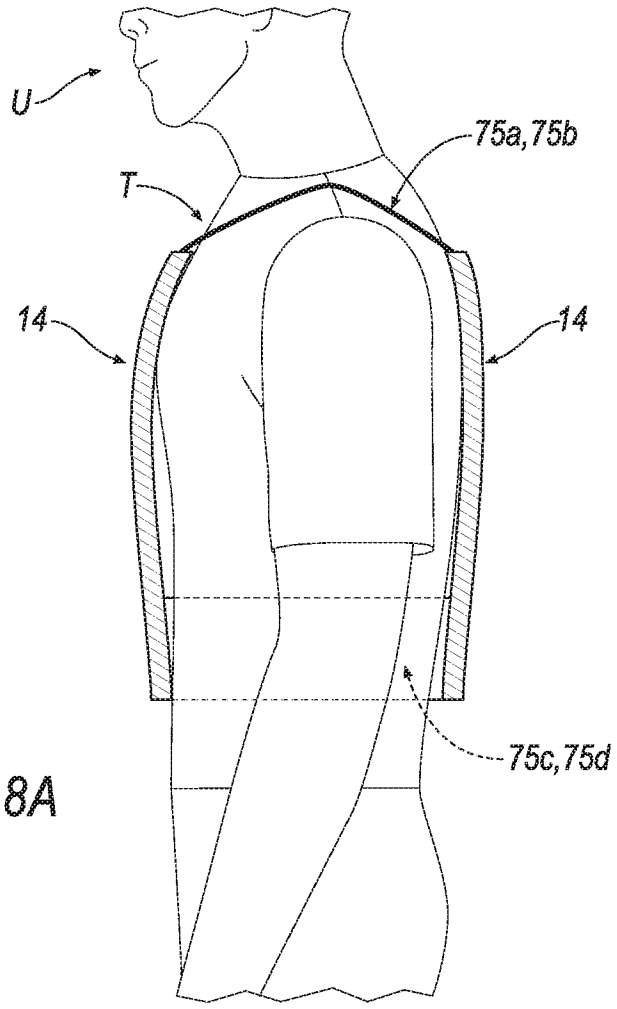
FIG. 8A is a side cross-sectional view of exemplary torso apparel disposed upon a torso of a user whereby the torso apparel includes: (1) a plate container portion without a plate portion disposed therein that is arranged over a chest portion of the user's torso, and (2) a plate container portion without a plate portion disposed therein that is arranged over a back portion of the user's torso.

Referring to FIG. 5, torso apparel is shown generally at 100. The torso apparel 100 may include at least one torso load distribution assembly 10 that is attached to a carrier portion 75. In an example, the at least one torso load distribution assembly 10 may be substantially similar to the torso load distribution assembly 10 described above at FIGS. 1A-2B.

The exemplary torso apparel 100 includes a first torso load distribution assembly 10 and a second torso load distribution assembly 10. The first torso load distribution assembly 10 may be alternatively referred to as a "front torso load distribution assembly" or a "chest area torso load distribution assembly." The second torso load distribution assembly 10 may be alternatively referred to as a "rear torso load distribution assembly" or a "back area torso load distribution assembly."

The carrier portion 75 may include at least one strap 75*a*-75*d*. The at least one strap 75*a*-75*d* may include a first strap 75*a*, a second strap 75*b*, a third strap 75*c* and a fourth strap 75*d*. The first strap 75*a* may be alternatively referred to as a right shoulder strap. The second strap 75*b* may be alternatively referred to as a left shoulder strap. The third strap 75*c* may be alternatively referred to as a right waist strap. The fourth strap 75*d* may be alternatively referred to as a left waist strap.

Each of the first strap 75*a*, the second strap 75*b*, the third strap 75*c*, the fourth strap 75*d* may include a body 76. The body 76 may include a front end $\mathbf{76}_F$ and a rear end $\mathbf{76}_R$. The body 76 may also be defined by an inner surface 78 and an outer surface 80.

Each of the inner surface 78 and the outer surface 80 may be defined by a canvas material. A portion of the inner surface 78 near the front end $\mathbf{76}_F$ of the body 76 may include a first patch of material 82, which may be alternatively referred to as a front end patch of material. A portion of the inner surface 78 near the rear end $\mathbf{76}_R$ of the body 76 may include a second patch of material 84, which may be alternatively referred to as a rear end patch of material. Each of the first patch of material 82 and the second patch of material 84 may be defined by a "hook" material that may cooperate with a "loop" material (see, e.g., reference numeral 30 defining the outer surface of each of the upper body portion 26*b* and the lower body portion 26*c* of the body 26 of the plate container portion 14) to define to "hook-and-loop" connection (e.g., VELCRO®).

When a user U (see, e.g., FIG. 6) wishes to arrange the at least one torso load distribution assembly 10 upon his/her body (e.g., his/her torso T) the user U may connect the at least one strap 75*a*-75*d* to the outer surface 30 of at least one of the upper body portion 26*b* and the lower body portion 26*c* of the body 26 of the plate container portion 14.

In some examples, when a user wishes to arrange a chest area torso load distribution assembly 10 and a back area torso load distribution assembly 10 upon his/her torso T such that the chest area torso load distribution assembly 10 is arranged over a chest area of the torso and the back area torso load distribution assembly 10 is arranged over a back area of the torso, the at least one strap 75*a*-75*d* may be utilized to connect the first torso load distribution assembly 10 to the second torso load distribution assembly 10 as follows. In an example as seen in FIG. 5: (1) the first patch of material 82 of the first strap 75*a* may be connected to the outer surface 30 of a right-side portion of the upper body portion 26*b* of the body 26 of the plate container portion 14 of the chest area torso load distribution assembly 10, and, the second patch of material 84 of the first strap 75*a* may be connected to the outer surface 30 of a left-side portion of the upper body portion 26*b* of the body of the plate container portion 14 of the back area torso load distribution assembly 10; (2) the first patch of material 82 of the second strap 75*b* may be connected to the outer surface 30 of a left-side portion of the upper body portion 26*b* of the body 26 of the plate container portion 14 of the chest area torso load distribution assembly 10, and, the second patch of material 84 of the second strap 75*b* may be connected to the outer surface 30 of a right-side portion of the upper body portion 26*b* of the body of the plate container portion 14 of the back area torso load distribution assembly 10; (3) the first patch of material 82 of the third strap 75*c* may be connected to the outer surface 30 of a right-side portion of the lower body portion 26*c* of the body 26 of the plate container portion 14 of the chest area torso load distribution assembly 10, and, the second patch of material 84 of the third strap 75*c* may be connected to the outer surface 30 of a left-side portion of the lower body portion 26*c* of the body of the plate container portion 14 of the back area torso load distribution assembly 10; (4) the first patch of material 82 of the fourth strap 75*d* may be connected to the outer surface 30 of a left-side portion of the lower body portion 26*c* of the body 26 of the plate container portion 14 of the chest area torso load distribution assembly 10, and, the fourth patch of material 84 of the fourth strap 75*d* may be connected to the outer surface 30 of a right-side portion of the lower body portion 26*c* of the body of the plate container portion 14 of the back area torso load distribution assembly 10.

As seen in FIGS. 6 and 7A-7C, when the user U utilizes the at least one strap 75*a*-75*d* for connecting the first torso load distribution assembly 10 to the second torso load distribution assembly 10 such that both of the first torso load distribution assembly 10 to the second torso load distribution assembly 10 are arranged over his/her chest area and back area, each of the first torso load distribution assembly 10 and the second torso load distribution assembly 10 provides the spacing or air gap A described above. As seen in FIGS. 8B-9B, the spacing or air gap A provides a plurality of air flow paths P that permit heat generated by the torso T of the user U to easily escape to surrounding atmosphere (whereas, comparatively, as seen in FIGS. 8A-9A, when the plate portion 12 is not included in each of the first torso load distribution assembly 10 and the second torso load distribution assembly 10, no spacing or air gap A is provided, thereby not providing an air flow path P, which would undesirably trap heat upon the torso T of the user U).

Figure 10:
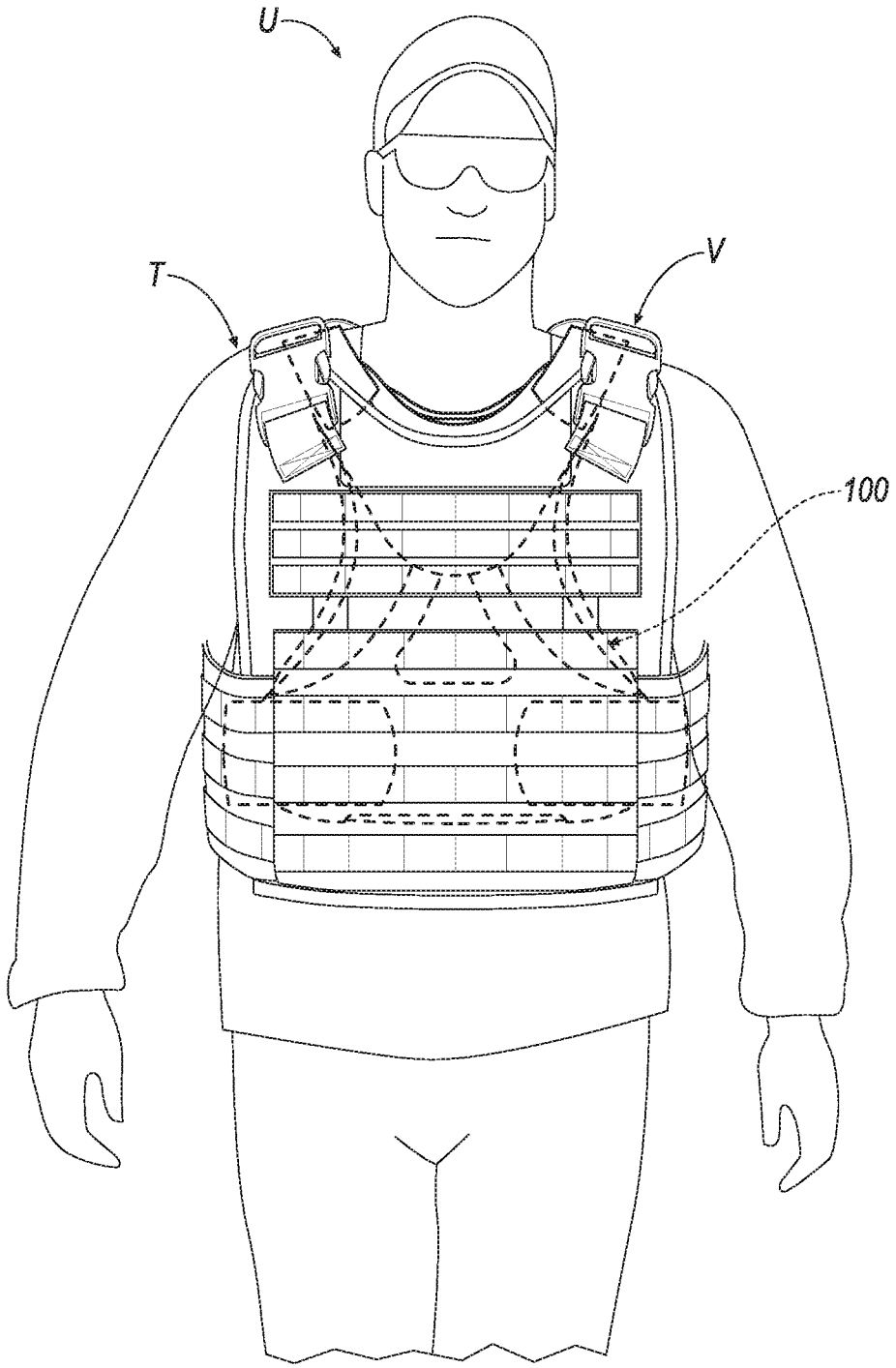
FIG. 10 is a front view of exemplary torso apparel disposed upon a torso of a user.
Figure 11B:
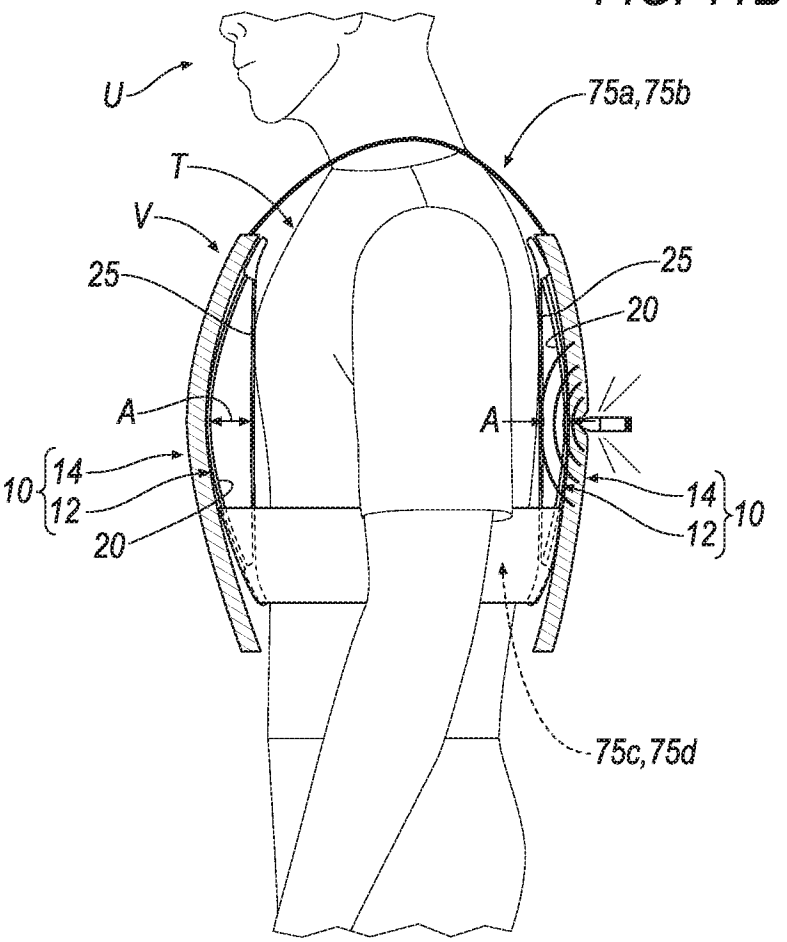
FIG. 11B is a side cross-sectional view of exemplary torso apparel disposed upon a torso of a user whereby the torso apparel includes: (1) a torso load distribution assembly arranged over a chest portion of the user's torso, and (2) a torso load distribution assembly arranged over a back portion of the user's torso that is distributing an impact force is imparted over a large area of the torso of the user.

Referring to FIG. 10, torso apparel is shown generally at 100. The torso apparel 100 of FIG. 10 may be substantially similar to the torso apparel 100 described above at FIGS. 5-6 and includes at least one torso load distribution assembly 10 that is attached to a carrier portion 75. In an example, the at least one torso load distribution assembly 10 of the torso apparel 100 of FIG. 10 may be substantially similar to the torso load distribution assembly 10 described above at FIGS. 1A-2B. The exemplary torso apparel 100 of FIG. 10 includes a first torso load distribution assembly 10 and a second torso load distribution assembly 10. The first torso load distribution assembly 10 may be alternatively referred to as a "front torso load distribution assembly" or a "chest area torso load distribution assembly." The second torso load distribution assembly 10 may be alternatively referred to as a "rear torso load distribution assembly" or a "back area torso load distribution assembly."

When a user U (see, e.g., FIG. 10) wishes to arrange the at least one torso load distribution assembly 10 upon his/her body (e.g., his/her torso T) the user U may connect the at least one strap 75*a*-75*d* to the outer surface 30 of at least one of the upper body portion 26*b* and the lower body portion 26*c* of the body 26 of the plate container portion 14.

Furthermore, in some instances, the user U may wish to arrange projectile-resistant clothing V over the torso apparel 100. In some examples, the projectile-resistant clothing V may include a vest, such as, for example, a military vest or tactical vest. The military vest V or tactical vest V may include, for example, armor plating, KEVLAR® or other projectile-resistant material for resisting forces imparted thereto by, for example, a projectile B such as, for example, a bullet.

Figure 13B:
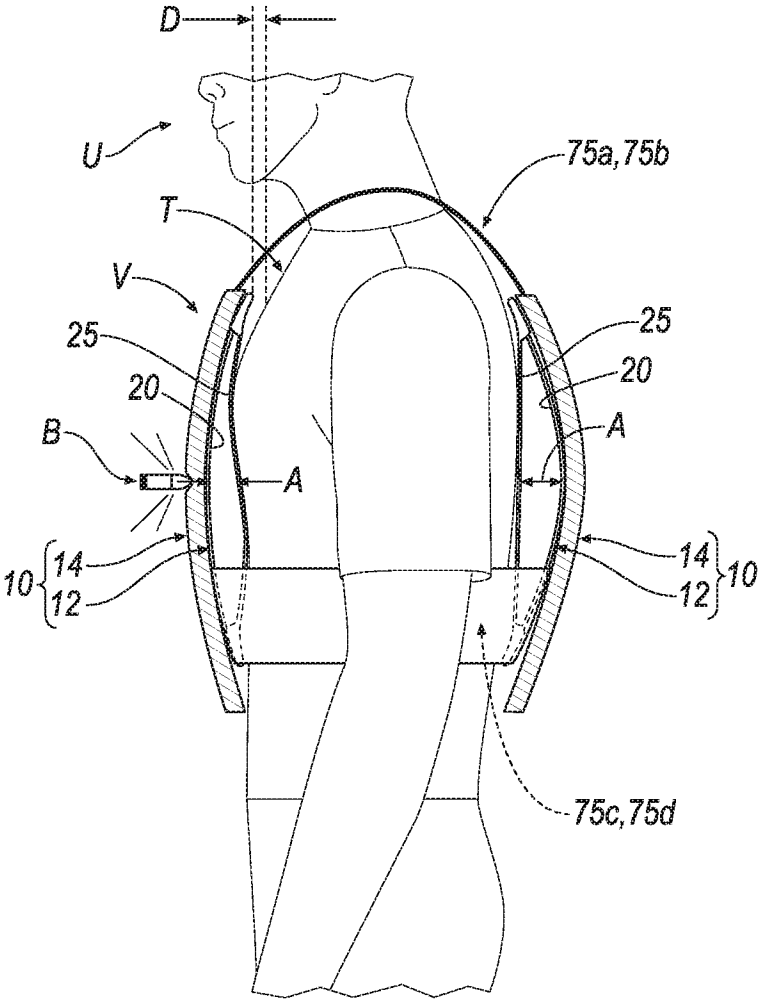
FIG. 13B is a further view according to FIG. 13A, illustrating the projectile further traveling in the direction toward and initially impacting the torso load distribution assembly that is arranged over the chest portion of the user's torso.
Figure 13A:
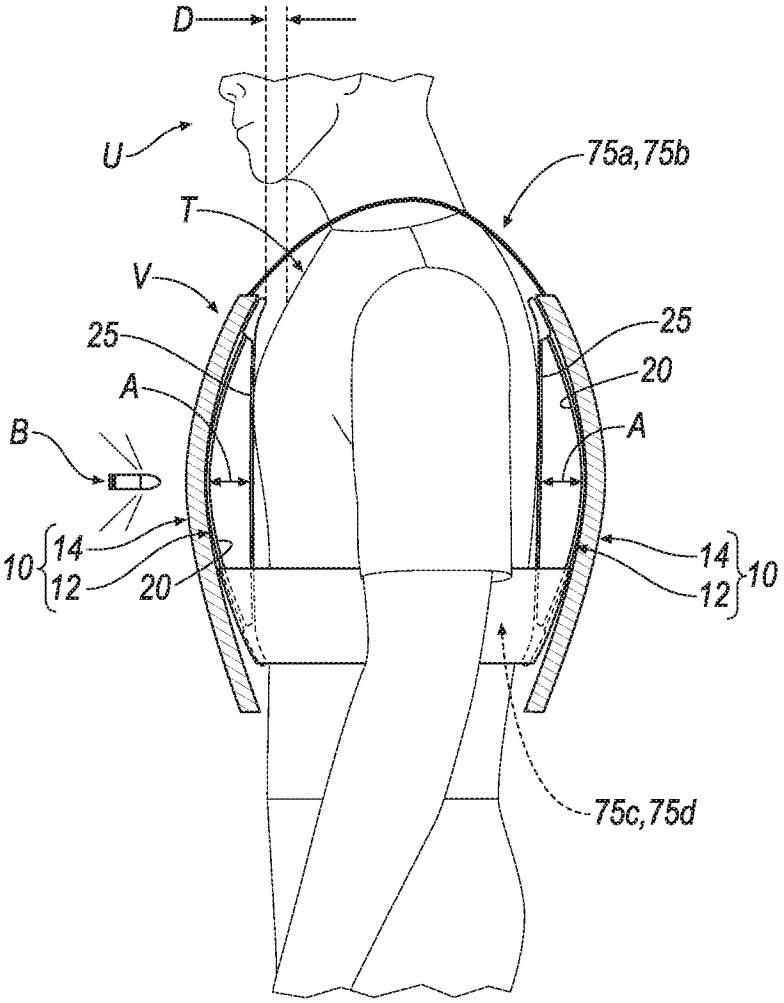
FIG. 13A is a side cross-sectional view of exemplary torso apparel disposed upon a torso of a user whereby the torso apparel includes: (1) a torso load distribution assembly arranged over a chest portion of the user's torso, and (2) a torso load distribution assembly arranged over a back portion of the user's torso; furthermore, FIG. 13A also illustrates a projectile that is traveling in a direction toward the torso load distribution assembly arranged over the chest portion of the user's torso.
Figure 13C:
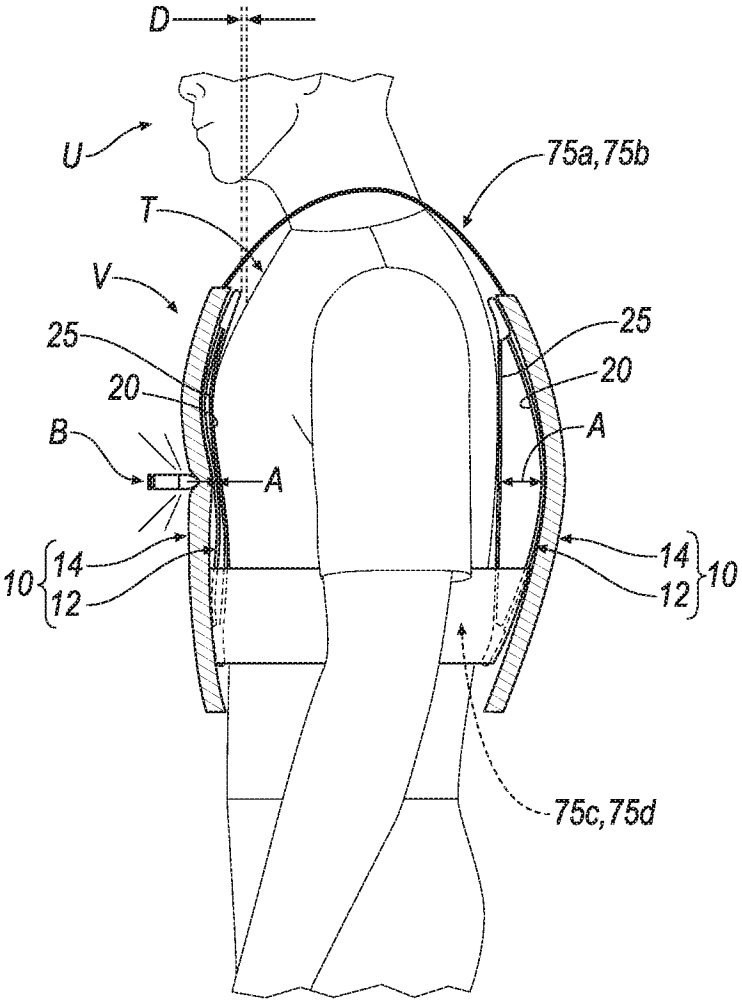
FIG. 13C is a further view according to FIGS. 13A-13B, illustrating the projectile further traveling in the direction toward and further impacting the torso load distribution assembly that is arranged over the chest portion of the user's torso.

As seen in FIGS. 11B-12B, when the user U arranges the first torso load distribution assembly 10 and the second torso load distribution assembly 10 upon his/her torso T with the at least one strap 75*a*-75*d* for connecting the first torso load distribution assembly 10 to the second torso load distribution assembly 10 such that both of the first torso load distribution assembly 10 to the second torso load distribution assembly 10 are arranged over his/her chest area and back area, each of the first torso load distribution assembly 10 and the second torso load distribution assembly 10 provides the spacing or air gap A described above. As seen in FIGS. 11B-12B, when the user U arranges the military vest V or tactical vest V over the torso apparel 100, in addition to the spacing or air gap A providing a plurality of air flow paths P that permit heat generated by the torso T of the user U to easily escape to surrounding atmosphere, the spacing or air gap A in combination with the military vest V or tactical vest V may distribute an impact force from a projectile B over a large area of the torso T of the user U (whereas, comparatively, as seen in FIGS. 11A-12A, when the plate portion 12 is not included in each of the first torso load distribution assembly 10 and the second torso load distribution assembly 10, no spacing or air gap A is provided, thereby arranging the military vest V or tactical vest V closer to the torso T of the user U and thereby resulting in the military vest V or tactical vest V distributing an impact force from a projectile B over a concentrated area of the back portion of the torso T or the user U). Furthermore, as seen in FIGS. 13A-13C, as a projectile B impacts upon the military vest V or tactical V, the rear surface 20 of the body 16 of the plate portion 12 proximate terminal ends of the plate portion 12 (which may be located proximately, for example, the convex surface segment $\mathbf{22}_1$, the concave surface segment $\mathbf{22}_2$, $\mathbf{22}_4$, $\mathbf{22}_6$, $\mathbf{22}_8$, and the substantially straight surface segment $\mathbf{22}_5$ of the side surface 22 of the body 16 of the plate portion 12) may be arranged in a spaced-apart relationship from the torso T of the user U at a distance D.

Figure 14:
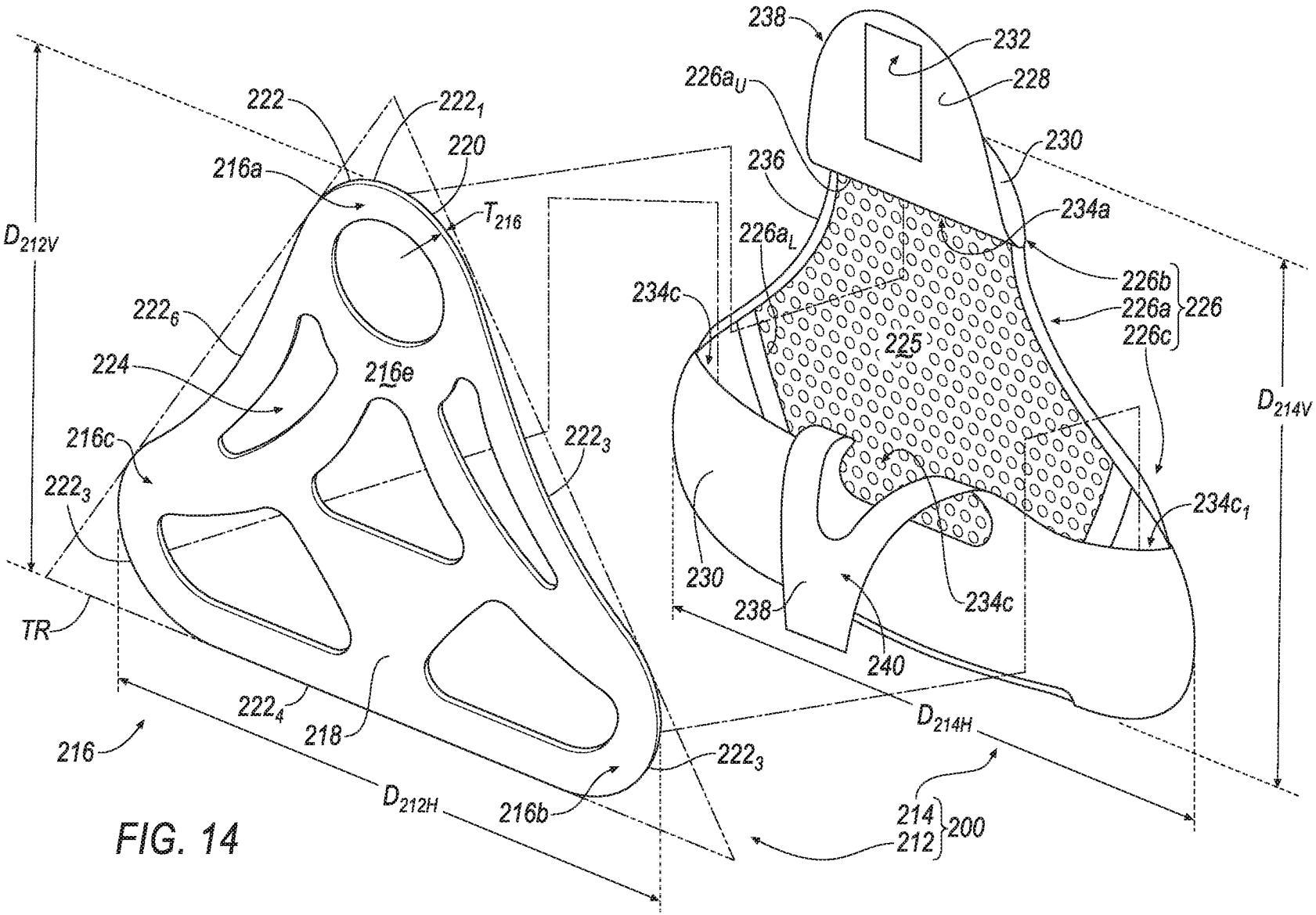
FIG. 14 is an exploded perspective view of an exemplary torso load distribution assembly.
Figure 15:
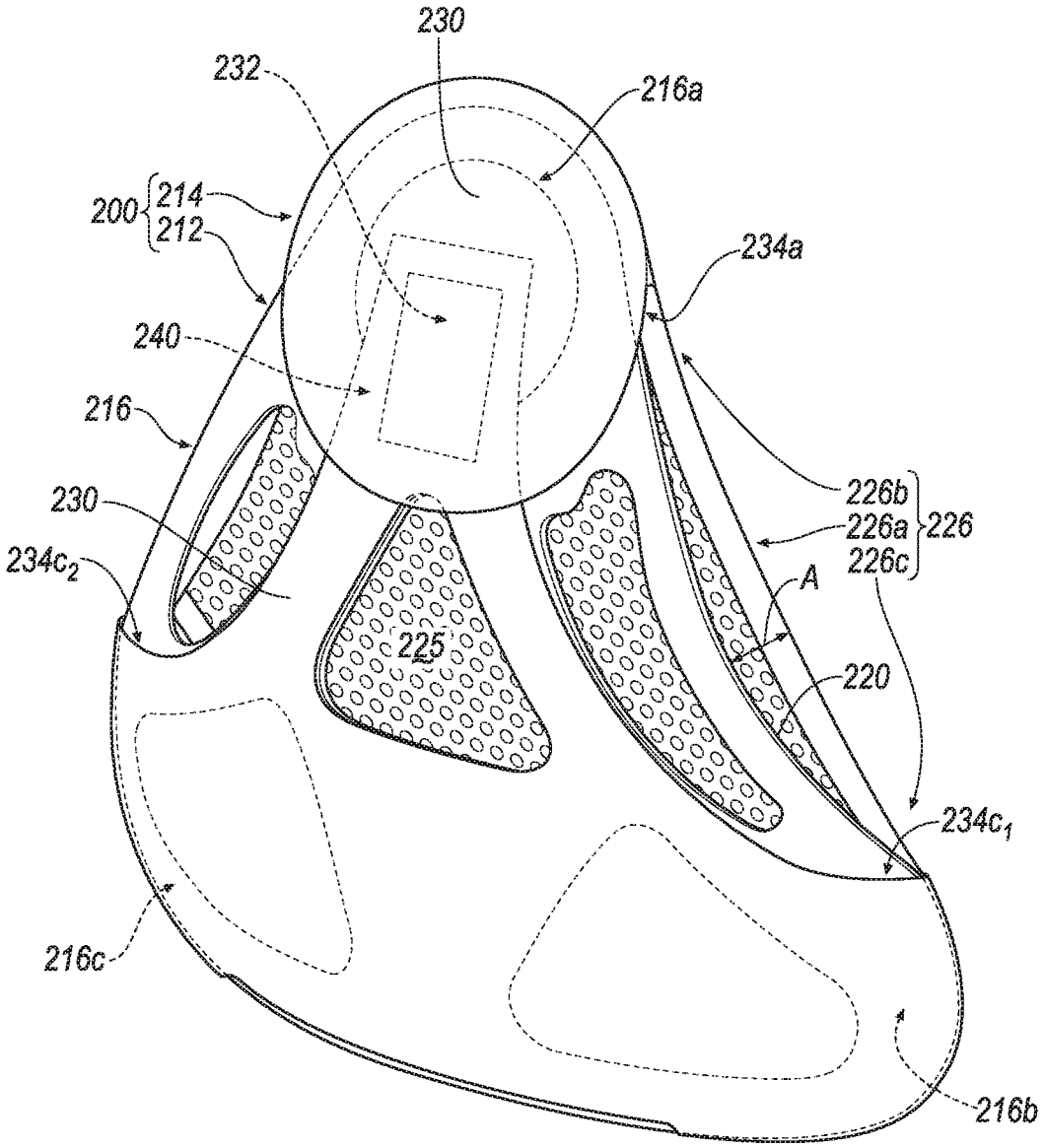
FIG. 15 is an assembled perspective view of the torso load distribution assembly of FIG. 14.

FIGS. 14-15 illustrate an exemplary torso load distribution assembly 200 (which may alternatively referred to as an impact reduction system). The torso load distribution assembly 200 includes a plate portion 212 and a plate container portion 214. The torso load distribution assembly 200 may be attached to a carrier portion (see, e.g., reference numeral 75 described above) for forming torso apparel 100 (see, e.g., FIG. 5). When the torso apparel 100 is disposed upon a torso T (see, e.g., FIG. 6) of a user U (see, e.g., FIG. 6), the torso load distribution assembly 200 included therein forms a spacing or air gap A (see, e.g., FIGS. 7A-7C, 8B, 9B) between a surface (see, e.g., reference numeral 220) of the plate portion 212 and a surface (see, e.g., reference numeral 225) of the plate container portion 214. In one example, the spacing or air gap A provides a plurality of air flow paths (see, e.g., reference numeral P described above) that permit heat generated by the torso T of the user U to easily escape to surrounding atmosphere. Furthermore, when torso apparel 100 is disposed upon a torso T of a user U, the torso load distribution assembly 200 included therein (which also includes a spacing or air gap A) assists in distributing an impact force imparted to an outboard surface of the at least one torso load distribution assembly 200 such that most of the impact force is distributed by the at least one torso load distribution assembly 200, and ultimately, over a large area of the torso T of the user U rather than a concentrated area of the torso T of the user U.

Referring to FIG. 14, the plate portion 212 includes a body 216 having a front surface 218 and a rear surface 220 and a side surface 222 that joins the front surface 218 to the rear surface 220. The body 216 is substantially flat; however, the body 216 may be formed by a flexible material (e.g., any desirable plastic material or KEVLAR®-impregnated resin) that permits the body 216 to be manipulated from an at-rest, substantially flat orientation (as seen in, e.g., FIG. 14) to a flexed or bowed orientation (as seen in, e.g., FIG. 15).

The body 216 is defined by a thickness $T_{216}$ extending between the front 218 surface and the rear surface 220. The body 216 forms a plurality (e.g., six) of passages 224; the plurality of passages 224 extend through the thickness $T_{216}$ of the body 216. The plurality of passages 224 may reduce the weight of the plate portion 212 and provide additional air flow paths P.

The side surface 222 of the body 216 is defined by a plurality of side surface segments $\mathbf{222}_1$-$\mathbf{222}_6$. In one example, the plurality of side surface portions segments $\mathbf{22}_1$-$\mathbf{22}_6$ includes a combination of at least one concave surface segment (see, e.g., $\mathbf{222}_1$, $\mathbf{222}_3$, $\mathbf{222}_5$), at least one convex surface segment (see, e.g., $\mathbf{222}_2$, $\mathbf{222}_6$) and at least one substantially straight surface segment (see, e.g., $\mathbf{222}_4$).

In an example, an exemplary side surface 222 of the body 216 of the plate portion 212 may include the following geometry. At approximately a "twelve o'clock" location of the side surface 222, the side surface 222 includes a concave surface segment $\mathbf{222}_1$ that is connected to a convex surface segment $\mathbf{222}_2$ that is located at approximately a "three o'clock" location of the side surface 222. At approximately a "five o'clock" location of the side surface 222, the side surface 222 includes a concave surface segment $\mathbf{222}_3$ that is connected to the convex surface segment $\mathbf{222}_2$ that is located at approximately the "three o'clock" location of the side surface 222. At approximately a "six o'clock" location of the side surface 222, the side surface 222 includes a substantially straight surface segment $\mathbf{222}_4$ that is connected to the concave surface segment $\mathbf{222}_3$ that is located at approximately the "five o'clock" location of the side surface 222. At approximately a "seven o'clock" location of the side surface 222, the side surface 222 includes a concave surface segment $\mathbf{222}_5$ that is connected to the substantially straight surface segment $\mathbf{222}_4$ that is located at approximately the "six o'clock" location of the side surface 222. At approximately a "nine o'clock" location of the side surface 222, the side surface 222 includes a convex surface segment $\mathbf{222}_6$ that is connected to the concave surface segment $\mathbf{222}_5$ that is located at approximately the "seven o'clock" location of the side surface 222. The convex surface segment $\mathbf{222}_6$ that is located at approximate the "nine o'clock" location of the side surface 222 is connected to the concave surface segment $\mathbf{222}_1$ that is located at approximately the "twelve o'clock" location of the side surface 222.

Although the exemplary side surface 222 of the body 216 of the plate portion 212 described above includes one substantially straight surface segment (see, e.g., the substantially straight surface segment $\mathbf{222}_4$) and a plurality of arcuate surface segments (see, e.g., the convex surface segments $\mathbf{222}_2$, $\mathbf{222}_6$ and the concave surface segments $\mathbf{222}_1$, $\mathbf{222}_3$, $\mathbf{222}_5$), the plurality of side surface segments $\mathbf{222}_1$-$\mathbf{222}_6$ may be selectively shaped to form a plate portion 212 having any desirable shape. In an example, the plurality of side surface segments $\mathbf{222}_1$-$\mathbf{222}_6$ may be selectively shaped such that the plurality of side surface segments $\mathbf{222}_1$-$\mathbf{222}_6$ are collectively bound by a substantially triangular-shaped area (see, e.g., triangular shaped dashed line TR surrounding the side surface 222 of the body 216 of the plate portion 212).

Furthermore, the exemplary side surface 222 of the body 216 of the plate portion 212 described above may shape the body 216 to define a plurality of body projections 216*a*-216*c* (or, alternatively, body portions) that extend away or are spaced apart from a substantially central body portion 216*e*. The plurality of body projections 216*a*-216*c* may include an upper central body projection 216*a*, a lower right body projection 216*b* and a lower left body projection 216*c*. The upper central body projection 216*a* may be defined by the concave surface segment $\mathbf{222}_1$, a portion of the convex surface segment $\mathbf{222}_2$ and a portion of the convex surface segment $\mathbf{222}_6$. The lower right body projection 216*b* may be defined by the concave surface segment $\mathbf{222}_3$, a portion of the convex surface segment $\mathbf{222}_2$ and a portion of the substantially straight surface segment $\mathbf{222}_4$. The lower left body projection 216*c* may be defined by the concave surface segment $\mathbf{222}_5$, a portion of the substantially straight surface segment $\mathbf{222}_4$ and a portion of the convex surface segment $\mathbf{222}_6$.

With continued reference to FIG. 14, the plate container portion 214 (or, alternatively, a plate engaging member) includes a body 226 having a central body portion 226*a*, an upper body portion 226*b* and a lower body portion 226*c*. The upper body portion 226*b* is connected to an upper end $\mathbf{226}a_U$ of the central body portion 226*a*. The lower body portion 226*c* is connected to a lower end $\mathbf{226}a_L$ of the central body portion 226*a*. Each of the upper body portion 226*b* and the lower body portion 226*c* may be connected, respectively, to the upper end $\mathbf{226}a_U$ and the lower end $\mathbf{226}a_L$ of the central body portion 226*a* by stitching, glue, welding or the like.

In some instances, the central body portion 226*a* may include a stretchable fabric mesh material including a plurality of passages. In some examples, each of the upper body portion 226*b* and the lower body portion 226*c* may include a fabric material having an inner surface 228 and an outer surface 230. The inner surface 228 may be defined by a canvas material. The outer surface 230 may be defined by a "loop" material that may cooperate with a "hook" material (see, e.g., reference numeral 232) to define to "hook-and-loop" connection (e.g., VELCRO®). In some examples, the inner surface 228 of at least one of the upper body portion 226*b* and the lower body portion 226*c* includes a patch of material 232; the patch of material 232 may be defined by a "hook" material that may cooperate with a "loop" material (see, e.g., reference numeral 230) to define to "hook-and-loop" connection (e.g., VELCRO®).

The upper body portion 226*b* defines the plate container portion 214 to include an upper central pocket 234*a*. The lower body portion 226*c* defines the plate container portion 214 to include a lower pocket 234*c*; the lower pocket 234*c* defines a lower right pocket portion $\mathbf{234}c_1$ and a lower left pocket portion $\mathbf{234}c_2$.

The body 226 of the plate container portion 214 includes a substantially similar shape with respect to the body 216 of the plate portion 212. For example, the body 226 of the plate container portion 214 is defined by a side surface 236 that is substantially similar to the geometry of the side surface 222 of the body 216 of the plate portion 212 (i.e., the side surface 236 of the plate container portion 214 includes a similar combination of: (1) at least one concave surface segment (corresponding to the concave surface segments $\mathbf{222}_1$, $\mathbf{222}_3$, $\mathbf{222}_5$ of the side surface 222 of the body 216 of the plate portion 212), (2) at least one convex surface segment (corresponding to the convex surface segments $\mathbf{222}_2$, $\mathbf{222}_6$ of the side surface 222 of the body 216 of the plate portion 212), and (3) at least one substantially straight surface segment (corresponding to the substantially straight surface segment $\mathbf{222}_4$ of the side surface 222 of the body 216 of the plate portion 212). Although the side surface 236 of the body 226 of the plate container portion 214 includes a substantially similar shape with respect to the side surface 222 of the body 216 of the plate portion 212, the side surface 236 of the body 226 of the plate container portion 214 is defined by slightly smaller dimensions (e.g., a vertical distance dimension $D_{214V}$ and a horizontal distance dimension $D_{214H}$) than dimensions (e.g., a vertical distance dimension $D_{212V}$ and a horizontal distance dimension $D_{212H}$) formed by the side surface 222 of the body 216 of the plate portion 212.

With continued reference to FIG. 14, the upper body portion 226*b* defines an upper lip 238 of the body 226 of the plate container portion 214. The lower body portion 226*c* defines a lower lip 240 of the body 226 of the plate container portion 214. The upper lip 238 of the upper body portion 226*b* is also defined by the inner surface 228 and the outer surface 230 as described above. In some examples, the inner surface 228 of the upper lip 238 may include the patch of material 232 that is defined by the "hook" material of a "hook-and-loop" connection; the "hook" material provided by the patch of material 232 upon of the upper lip 238 may cooperate with the "loop" material provided by the outer surface 230 of the lower lip 240 of the body 226 of the plate container portion 214 to provide a "hook-and-loop" connection (e.g., VELCRO®) for selectively connecting the upper lip 238 to the lower lip 240.

A method for assembling the exemplary torso load distribution assembly 200 is described. In some instances, the plate container portion 214 is configured to contain the plate portion 212. In other examples, the plate engaging member 214 is attached to the plate portion 212.

Firstly, the lower right body projection 216*b* of the body 216 of the plate portion 212 is disposed within the lower right pocket portion $\mathbf{234}c_1$ of the lower pocket 234*c* formed by the lower body portion 226*c* of the body 226 of the plate container portion 214. Then, the lower left body projection 216*c* of the body 216 of the plate portion 212 is disposed within the lower left pocket portion $\mathbf{234}c_2$ of the lower pocket 234*c* formed by the lower body portion 226*c* of the body 226 of the plate container portion 214. Then, the upper central body projection 216*a* of the body 216 of the plate portion 212 is disposed within the upper central pocket 234*a* formed by the upper body portion 226*b* of the body 226 of the plate container portion 214.

Once all of the plurality of body projections 216*a*-216*c* of the plate portion 212 are arranged within the pockets 234*a*, $\mathbf{234}c_1$, $\mathbf{234}c_2$ formed by the plate container portion 214 as described above, the lower lip 240 of the lower body portion 226*c* of the body 226 of the plate container portion 214 is arranged over the substantially central body portion 216*e* of the body 216 of the plate portion 212. Then, the upper lip 238 of the upper body portion 226*b* of the body 226 of the plate container portion 214 is arranged over the lower lip 240 of the of the lower body portion 226*c* of the body 226 of the plate container portion 214 and the substantially central body portion 216*e* of the body 216 of the plate portion 212 such that the patch of material 232 including the "hook" material provided upon of the inner surface 228 of the upper lip 238 may cooperate with the "loop" material provided by the outer surface 230 of the lower lip 240 to provide a "hook-and-loop" connection (e.g., VELCRO®) for selectively connecting the upper lip 238 to the lower lip 240 (as seen in, e.g., FIG. 15) and thereby selectively containing the plate portion 212 within the plate container portion 214.

As seen in FIG. 15, once at least three body projections (see, e.g., at least the lower right body projection 216*b*, the lower left body projection 216*c* and the upper central body projection 216*a*) of the plurality of body projections 216*a*-216*c* are respectively arranged within three pockets (see, e.g., the lower right pocket portion $\mathbf{234}c_1$ of the lower pocket 234*c*, the lower left pocket portion $\mathbf{234}c_2$ of the lower pocket 234*c* and the upper central pocket 234*a*) of the plate container portion 214, the body 216 of the plate portion 212 is manipulated from an at-rest, substantially flat orientation (as seen in, e.g., FIG. 14) to a flexed or bowed orientation (as seen in, e.g., FIG. 15) due to the side surface 236 of the body 226 of the plate container portion 214 being defined to be slightly smaller dimensionally (see, e.g., $D_{214V}$, $D_{214H}$) than dimensions (see, e.g., $D_{212V}$, $D_{212H}$) formed by the side surface 222 of the body 216 of the plate portion 212. Therefore, as seen in FIG. 15, as a result of the flexing or bowing of the plate portion 212, the rear surface 220 of the plate portion 212 is biased away from an inner surface 225 of the central body portion 226*a* of the body 226 of the plate container portion 214 for forming a spacing or air gap A there-between.

Although an implementation of the torso load distribution assembly 200 is directed to the plate portion 212 being contained within the plate container portion 214 by way of pockets 234*a*, 234*e* for attaching the plate portion 212 to the plate container portion 214, attachment of the plate portion 212 to the plate container portion 214 is not limited to disposing the plate portion 212 within pockets 234*a*, 234*e* formed by the plate container portion 214. Accordingly, the plate portion 212 may be attached to the plate container portion 214 utilizing any desirable mechanical and/or chemical means. In some instances, the plate portion 212 may be attached to the plate container portion 214 by way of one or more of, for example: straps, belts, clips, buttons, zippers, snap fasteners, adhesive, ultrasonic welding or the like.

Figure 16:
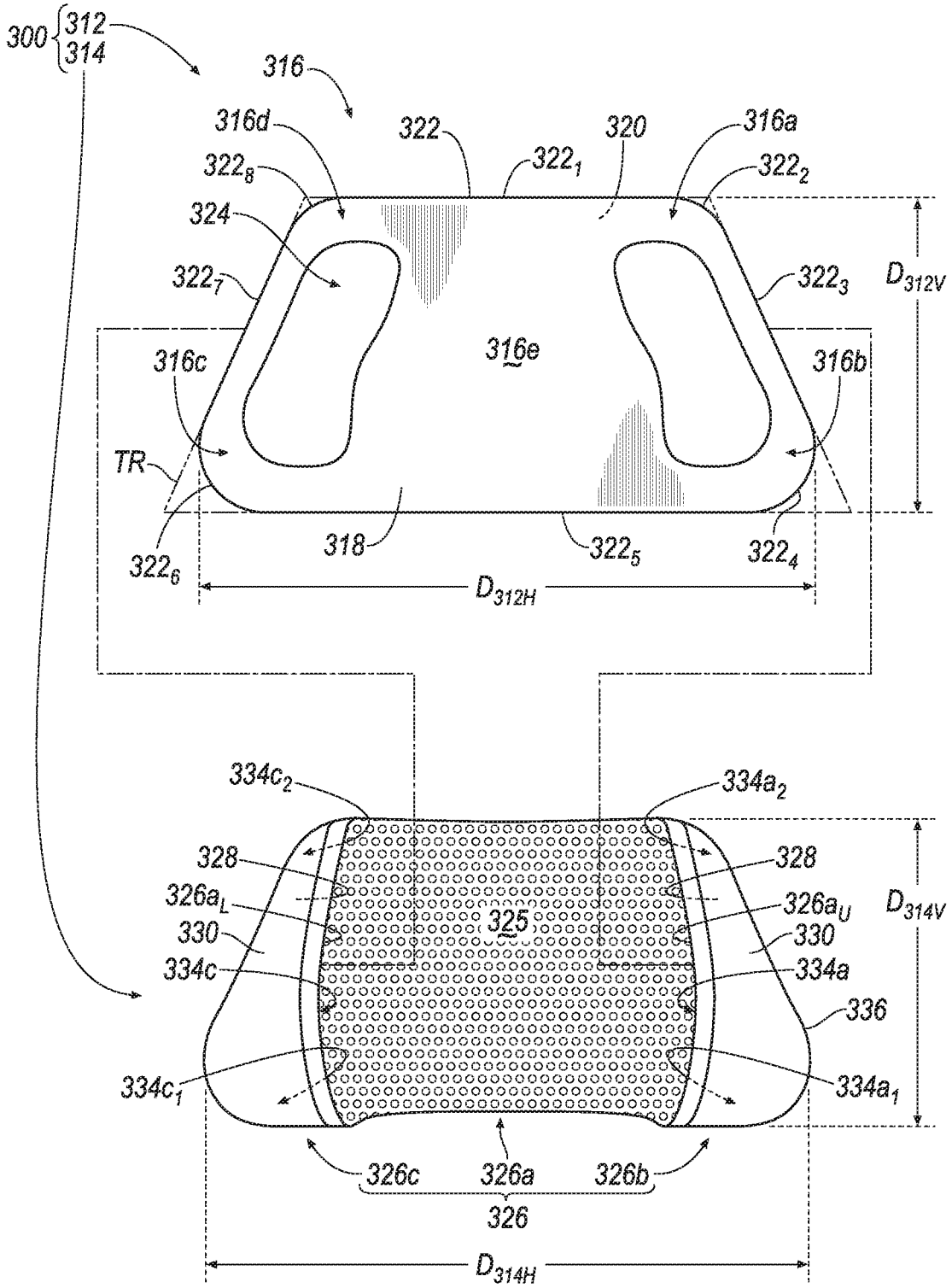
FIG. 16 is an exploded front view of an exemplary torso load distribution assembly.
Figure 17:
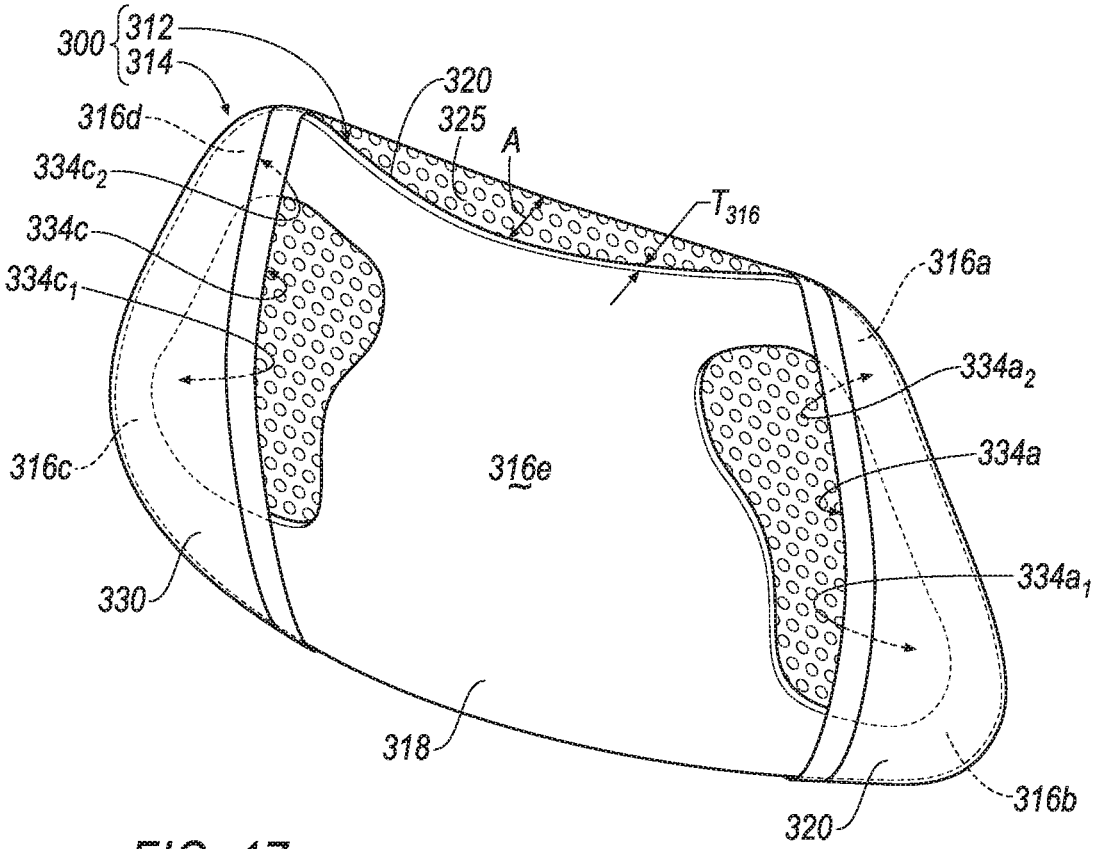
FIG. 17 is an assembled perspective view of the torso load distribution assembly of FIG. 16.

FIGS. 16-17 illustrate an exemplary torso load distribution assembly 300 (which may alternatively referred to as an impact reduction system). The torso load distribution assembly 300 includes a plate portion 312 and a plate container portion 314. The torso load distribution assembly 300 may be attached to a carrier portion (see, e.g., reference numeral 75 described above) for forming torso apparel 100 (see, e.g., FIG. 20). When the torso apparel 100 is disposed upon a torso T (see, e.g., FIG. 20) of a user U (see, e.g., FIG. 20), the torso load distribution assembly 300 included therein forms a spacing or air gap A (see, e.g., FIG. 20) between a surface (see, e.g., reference numeral 320) of the plate portion 312 and a surface (see, e.g., reference numeral 325) of the plate container portion 314. In one example, the spacing or air gap A provides a plurality of air flow paths (see, e.g., reference numeral P described above) that permit heat generated by the torso T of the user U to easily escape to surrounding atmosphere. Furthermore, when torso apparel 100 is disposed upon a torso T of a user U, the torso load distribution assembly 300 included therein (which also includes a spacing or air gap A) assists in distributing an impact force imparted to an outboard surface of the at least one torso load distribution assembly 300 such that most of the impact force is distributed by the at least one torso load distribution assembly 300, and ultimately, over a large area of the torso T of the user U rather than a concentrated area of the torso T of the user U.

Referring to FIG. 16, the plate portion 312 includes a body 316 having a front surface 318 and a rear surface 320 and a side surface 322 that joins the front surface 318 to the rear surface 320. The body 316 is substantially flat; however, the body 316 may be formed by a flexible material (e.g., any desirable plastic material or KEVLAR®-impregnated resin) that permits the body 316 to be manipulated from an at-rest, substantially flat orientation (as seen in, e.g., FIG. 16) to a flexed or bowed orientation (as seen in, e.g., FIG. 17).

The body 316 is defined by a thickness $T_{316}$ extending between the front 318 surface and the rear surface 320. The body 316 forms a plurality (e.g., two) of passages 324; the plurality of passages 324 extend through the thickness $T_{316}$ of the body 316. The plurality of passages 324 may reduce the weight of the plate portion 312 and provide additional air flow paths P.

The side surface 322 of the body 316 is defined by a plurality of side surface segments $\mathbf{322}_1$-$\mathbf{322}_8$. In one example, the plurality of side surface portions segments $\mathbf{322}_1$-$\mathbf{322}_8$ includes a combination of at least one concave surface segment (see, e.g., $\mathbf{322}_2$, $\mathbf{322}_4$, $\mathbf{322}_6$, $\mathbf{222}_8$) and at least one substantially straight surface segment (see, e.g., $\mathbf{322}_1$, $\mathbf{322}_3$, $\mathbf{322}_5$, $\mathbf{322}_7$).

In an example, an exemplary side surface 322 of the body 316 of the plate portion 312 may include the following geometry. At approximately a "twelve o'clock" location of the side surface 322, the side surface 322 includes a substantially straight surface segment $\mathbf{322}_1$ that is connected to a concave surface segment $\mathbf{322}_2$ that is located at approximately a "one o'clock" location of the side surface 322. At approximately a "three o'clock" location of the side surface 322, the side surface 322 includes a substantially straight surface segment $\mathbf{322}_3$ that is connected to the concave surface segment $\mathbf{322}_2$ that is located at approximately the "one o'clock" location of the side surface 322. At approximately a "five o'clock" location of the side surface 322, the side surface 322 includes a concave surface segment $\mathbf{322}_4$ that is connected to the substantially straight surface segment $\mathbf{322}_3$ that is located at approximately the "three o'clock" location of the side surface 322. At approximately a "six o'clock" location of the side surface 322, the side surface 322 includes a substantially straight surface segment $\mathbf{322}_5$ that is connected to the concave surface segment $\mathbf{322}_4$ that is located at approximately the "five o'clock" location of the side surface 322. At approximately a "seven o'clock" location of the side surface 322, the side surface 322 includes a concave surface segment $\mathbf{322}_6$ that is connected to the substantially straight surface segment $\mathbf{322}_5$ that is located at approximately the "six o'clock" location of the side surface 322. At approximately a "nine o'clock" location of the side surface 322, the side surface 322 includes a substantially straight surface segment $\mathbf{322}_7$ that is connected to the concave surface segment $\mathbf{322}_6$ that is located at approximately the "seven o'clock" location of the side surface 322. At approximately an "eleven o'clock" location of the side surface 322, the side surface 322 includes a concave surface segment $\mathbf{322}_8$ that is connected to the substantially straight surface segment $\mathbf{322}_7$ that is located at approximately the "nine o'clock" location of the side surface 322. The concave surface segment $\mathbf{322}_8$ that is located at approximate the "eleven o'clock" location of the side surface 322 is connected to the substantially straight surface segment $\mathbf{322}_1$ that is located at approximately the "twelve o'clock" location of the side surface 322.

Although the exemplary side surface 322 of the body 316 of the plate portion 312 described above includes four substantially straight surface segments (see, e.g., the substantially straight surface segments $\mathbf{322}_1$, $\mathbf{322}_3$, $\mathbf{322}_5$, $\mathbf{322}_7$) and a plurality of arcuate surface segments (see, e.g., the concave surface segments $\mathbf{322}_2$, $\mathbf{322}_4$, $\mathbf{322}_6$, $\mathbf{322}_8$), the plurality of side surface segments $\mathbf{322}_1$-$\mathbf{322}_8$ may be selectively shaped to form a plate portion 312 having any desirable shape. In an example, the plurality of side surface segments $\mathbf{322}_1$-$\mathbf{322}_8$ may be selectively shaped such that the plurality of side surface segments $\mathbf{322}_1$-$\mathbf{322}_8$ are collectively bound by a substantially trapezoidal-shaped area (see, e.g., trapezoidal shaped dashed line TR surrounding the side surface 322 of the body 316 of the plate portion 312).

Furthermore, the exemplary side surface 322 of the body 316 of the plate portion 312 described above may shape the body 316 to define a plurality of body projections 316*a*-316*d* (or, alternatively, body portions) that extend away or are spaced apart from a substantially central body portion 316*e*. The plurality of body projections 316*a*-316*d* may include an upper right body projection 316*a*, a lower right body projection 316*b*, a lower left body projection 316*c* and an upper left body projection 316*d*. The upper right body projection 316*a* may be defined by the concave surface segment $\mathbf{322}_2$, a portion of the substantially straight surface segment $\mathbf{322}_1$ and a portion of the substantially straight surface segment $\mathbf{322}_3$. The lower right body projection 316*b* may be defined by the concave surface segment $\mathbf{322}_4$, a portion of the substantially straight surface segment $\mathbf{322}_3$ and a portion of the substantially straight surface segment $\mathbf{322}_5$. The lower left body projection 316*c* may be defined by the concave surface segment $\mathbf{322}_6$, a portion of the substantially straight surface segment $\mathbf{322}_5$ and a portion of the substantially straight surface segment $\mathbf{322}_7$. The upper left body projection 316*d* may be defined by the concave surface segment $\mathbf{322}_8$, a portion of the substantially straight surface segment $\mathbf{322}_1$ and a portion of the substantially straight surface segment $\mathbf{322}_7$.

With continued reference to FIG. 16, the plate container portion 314 (or, alternatively, a plate engaging member) includes a body 326 having a central body portion 326*a*, a right body portion 326*b* and a left body portion 326*c*. The right body portion 326*b* is connected to a right end $\mathbf{326}a_U$ of the central body portion 326*a*. The left body portion 326*c* is connected to a left end $\mathbf{326}a_L$ of the central body portion 326*a*. Each of the right body portion 326*b* and the left body portion 326*c* may be connected, respectively, to the right end $\mathbf{326}a_U$ and the left end $\mathbf{326}a_L$ of the central body portion 326*a* by stitching, glue, welding or the like.

In some instances, the central body portion 326*a* may include a stretchable fabric mesh material including a plurality of passages. In some examples, each of the right body portion 326*b* and the left body portion 326*c* may include a fabric material having an inner surface 328 and an outer surface 330. The inner surface 328 may be defined by a canvas material.

The right body portion 326*b* defines the plate container portion 314 to include a right pocket 334*a*; the right pocket 334*a* defines a lower right pocket portion $\mathbf{334}a_1$ and an upper right pocket portion $\mathbf{334}a_2$. The left body portion 326*c* defines the plate container portion 314 to include a left pocket 334*c*; the left pocket 334*c* defines a lower left pocket portion $\mathbf{334}c_1$ and an upper left pocket portion $\mathbf{334}c_2$.

The body 326 of the plate container portion 314 includes a substantially similar shape with respect to the body 316 of the plate portion 312. For example, the body 326 of the plate container portion 314 is defined by a side surface 336 that is substantially similar to the geometry of the side surface 322 of the body 316 of the plate portion 312 (i.e., the side surface 336 of the plate container portion 314 includes a similar combination of: (1) at least one concave surface segment (corresponding to the concave surface segments $\mathbf{322}_2$, $\mathbf{322}_4$, $\mathbf{322}_6$, $\mathbf{322}_8$ of the side surface 322 of the body 316 of the plate portion 312) and (2) at least one substantially straight surface segment (corresponding to the substantially straight surface segments $\mathbf{322}_1$, $\mathbf{322}_3$, $\mathbf{322}_5$, $\mathbf{322}_7$ of the side surface 322 of the body 316 of the plate portion 312). Although the side surface 336 of the body 326 of the plate container portion 314 includes a substantially similar shape with respect to the side surface 322 of the body 316 of the plate portion 312, the side surface 336 of the body 326 of the plate container portion 314 is defined by slightly smaller dimensions (e.g., a vertical distance dimension $D_{314V}$ and a horizontal distance dimension $D_{314H}$) than dimensions (e.g., a vertical distance dimension $D_{212V}$ and a horizontal distance dimension $D_{212H}$) formed by the side surface 322 of the body 316 of the plate portion 312.

A method for assembling the exemplary torso load distribution assembly 300 is described. In some instances, the plate container portion 314 is configured to contain the plate portion 312. In other examples, the plate engaging member 314 is attached to the plate portion 312.

Firstly, both of the upper right body projection 316*a* and the lower right body projection 316*b* of the body 316 of the plate portion 312 are disposed within the right pocket 334*a* such that the lower right body projection 316*b* is disposed in the lower right pocket portion $\mathbf{334}a_1$ and the upper right body projection 316*a* is disposed in the upper right pocket portion $\mathbf{334}a_2$. Then, both of the lower left body projection 316*c* and the upper left body projection 316*d* of the body 316 of the plate portion 312 are disposed within the left pocket 334*c* such that the lower left body projection 316*c* is disposed in the lower left pocket portion $\mathbf{334}c_1$ and the upper left body projection 316*d* is disposed in the upper left pocket portion $\mathbf{334}c_2$. Once all of the plurality of body projections 316*a*-316*d* of the plate portion 312 are arranged within the pockets $\mathbf{334}a_1$, $\mathbf{334}a_2$, $\mathbf{334}c_1$, $\mathbf{334}c_2$ formed by the plate container portion 314 as described above, the plate portion 312 is selectively-contained within the plate container portion 314 (noting that, unlike the embodiments described above, the plate container portion 314 does not include an upper lip 38, 328 and a lower lip 40, 240).

As seen in FIG. 17, once at least four body projections (see, e.g., at least the upper right body projection 316*a*, the lower right body projection 316*b*, the lower left body projection 316*c* and the upper left body projection 316*d*) of the plurality of body projections 316*a*-316*d* are respectively arranged within four pockets (see, e.g., the lower right pocket portion $\mathbf{334}a_1$ of the right pocket 334*a*, the upper right pocket portion $\mathbf{334}a_2$ of the right pocket 334*a*, the lower left pocket portion $\mathbf{334}c_1$ of the left pocket 334*c*, the upper left pocket portion $\mathbf{334}c_2$ of the left pocket 334*c*) of the plate container portion 314, the body 316 of the plate portion 312 is manipulated from an at-rest, substantially flat orientation (as seen in, e.g., FIG. 16) to a flexed or bowed orientation (as seen in, e.g., FIG. 17) due to the side surface 336 of the body 326 of the plate container portion 314 being defined to be slightly smaller dimensionally (see, e.g., $D_{314V}$, $D_{314H}$) than dimensions (see, e.g., $D_{212V}$, $D_{212H}$) formed by the side surface 322 of the body 316 of the plate portion 312. Therefore, as seen in FIG. 17, as a result of the flexing or bowing of the plate portion 312, the rear surface 320 of the plate portion 312 is biased away from an inner surface 325 of the central body portion 326*a* of the body 326 of the plate container portion 314 for forming a spacing or air gap A there-between.

Although an implementation of the torso load distribution assembly 300 is directed to the plate portion 312 being contained within the plate container portion 314 by way of pockets 334*a*, 334*c* for attaching the plate portion 312 to the plate container portion 314, attachment of the plate portion 312 to the plate container portion 314 is not limited to disposing the plate portion 312 within pockets 334*a*, 334*c* formed by the plate container portion 314. Accordingly, the plate portion 312 may be attached to the plate container portion 314 utilizing any desirable mechanical and/or chemical means. In some instances, the plate portion 312 may be attached to the plate container portion 314 by way of one or more of, for example: straps, belts, clips, buttons, zippers, snap fasteners, adhesive, ultrasonic welding or the like.

Figure 18:
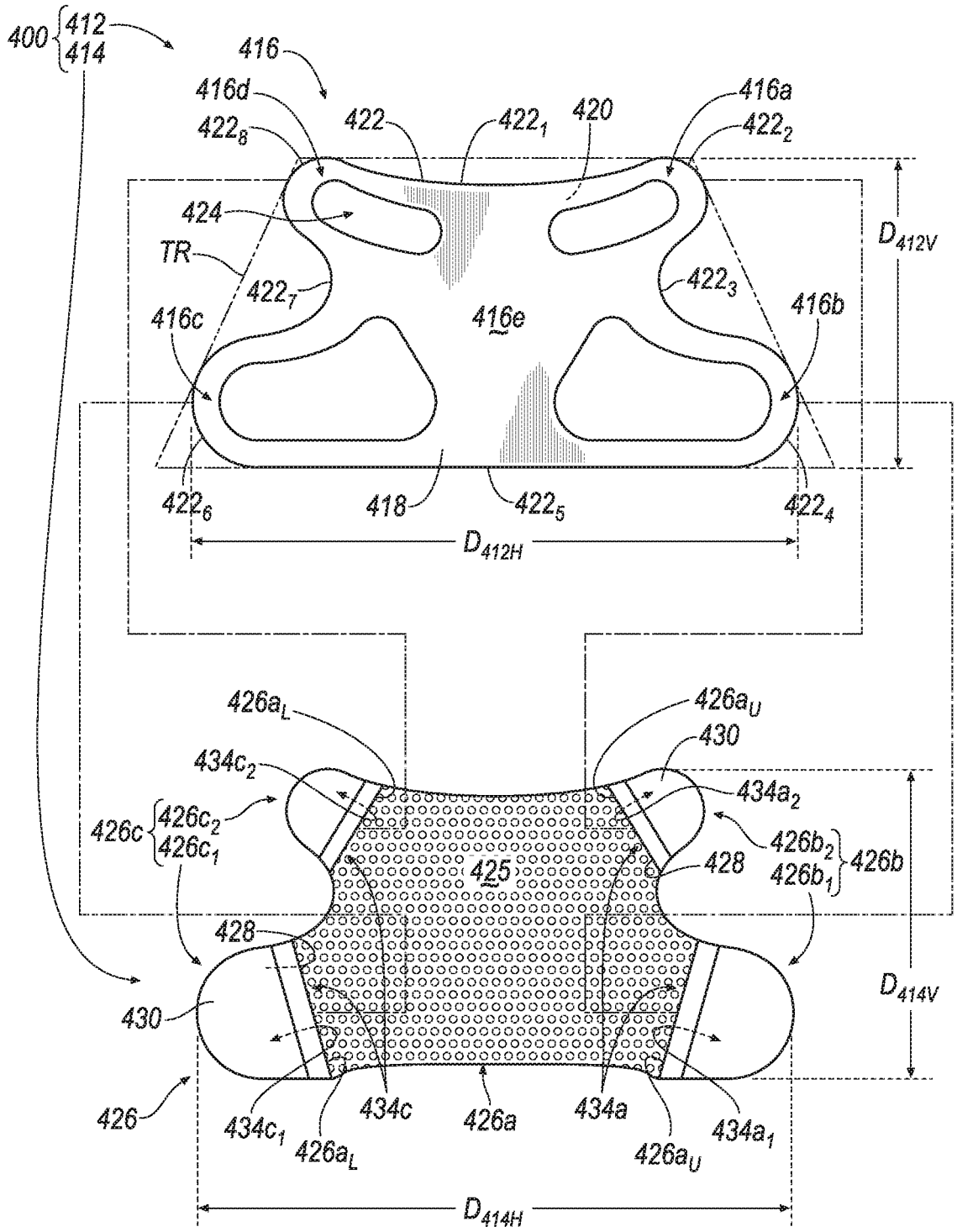
FIG. 18 is an exploded front view of an exemplary torso load distribution assembly.
Figure 19:
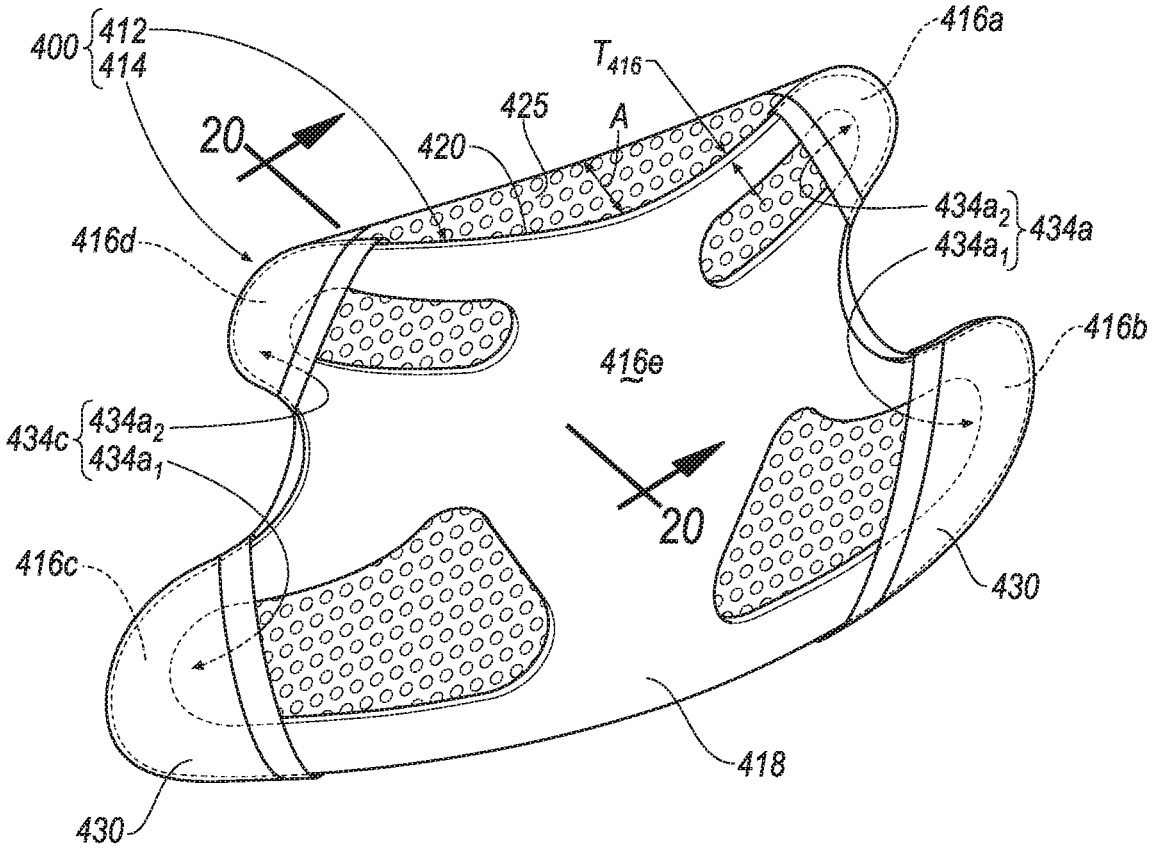
FIG. 19 is an assembled perspective view of the torso load distribution assembly of FIG. 18.

FIGS. 18-19 illustrate an exemplary torso load distribution assembly 400 (which may alternatively referred to as an impact reduction system). The torso load distribution assembly 400 includes a plate portion 412 and a plate container portion 414. The torso load distribution assembly 400 may be attached to a carrier portion (see, e.g., reference numeral 75 described above) for forming torso apparel 100 (see, e.g., FIG. 20). When the torso apparel 100 is disposed upon a torso T (see, e.g., FIG. 20) of a user U (see, e.g., FIG. 20), the torso load distribution assembly 400 included therein forms a spacing or air gap A (see, e.g., FIG. 20) between a surface (see, e.g., reference numeral 420) of the plate portion 412 and a surface (see, e.g., reference numeral 425) of the plate container portion 414. In one example, the spacing or air gap A provides a plurality of air flow paths (see, e.g., reference numeral P described above) that permit heat generated by the torso T of the user U to easily escape to surrounding atmosphere. Furthermore, when torso apparel 100 is disposed upon a torso T of a user U, the torso load distribution assembly 400 included therein (which also includes a spacing or air gap A) assists in distributing an impact force imparted to an outboard surface of the at least one torso load distribution assembly 400 such that most of the impact force is distributed by the at least one torso load distribution assembly 400, and ultimately, over a large area of the torso T of the user U rather than a concentrated area of the torso T of the user U.

Referring to FIG. 18, the plate portion 412 includes a body 416 having a front surface 418 and a rear surface 420 and a side surface 422 that joins the front surface 418 to the rear surface 420. The body 416 is substantially flat; however, the body 416 may be formed by a flexible material (e.g., any desirable plastic material or KEVLAR®-impregnated resin) that permits the body 416 to be manipulated from an at-rest, substantially flat orientation (as seen in, e.g., FIG. 18) to a flexed or bowed orientation (as seen in, e.g., FIG. 19).

The body 416 is defined by a thickness $T_{416}$ extending between the front 418 surface and the rear surface 420. The body 416 forms a plurality (e.g., four) of passages 424; the plurality of passages 424 extend through the thickness $T_{416}$ of the body 416. The plurality of passages 424 may reduce the weight of the plate portion 412 and provide additional air flow paths P.

The side surface 422 of the body 416 is defined by a plurality of side surface segments $\mathbf{422}_1$-$\mathbf{422}_8$. In one example, the plurality of side surface portions segments $\mathbf{422}_1$-$\mathbf{422}_8$ includes a combination of at least one concave surface segment (see, e.g., $\mathbf{422}_2$, $\mathbf{422}_4$, $\mathbf{422}_6$, $\mathbf{422}_8$), at least one convex surface segment (see, e.g., $\mathbf{422}_1$, $\mathbf{422}_3$, $\mathbf{422}_7$), and at least one substantially straight surface segment (see, e.g., $\mathbf{422}_5$).

In an example, an exemplary side surface 422 of the body 416 of the plate portion 412 may include the following geometry. At approximately a "twelve o'clock" location of the side surface 422, the side surface 422 includes a convex surface segment $\mathbf{422}_1$ that is connected to a concave surface segment $\mathbf{422}_2$ that is located at approximately a "one o'clock" location of the side surface 422. At approximately a "three o'clock" location of the side surface 422, the side surface 422 includes a convex surface segment $\mathbf{422}_3$ that is connected to the concave surface segment $\mathbf{422}_2$ that is located at approximately the "one o'clock" location of the side surface 422. At approximately a "five o'clock" location of the side surface 422, the side surface 422 includes a concave surface segment $\mathbf{422}_4$ that is connected to the convex surface segment $\mathbf{422}_3$ that is located at approximately the "three o'clock" location of the side surface 422. At approximately a "six o'clock" location of the side surface 422, the side surface 422 includes a substantially straight surface segment $\mathbf{422}_5$ that is connected to the concave surface segment $\mathbf{422}_4$ that is located at approximately the "five o'clock" location of the side surface 422. At approximately a "seven o'clock" location of the side surface 422, the side surface 422 includes a concave surface segment $\mathbf{422}_6$ that is connected to the substantially straight surface segment $\mathbf{422}_5$ that is located at approximately the "six o'clock" location of the side surface 422. At approximately a "nine o'clock" location of the side surface 422, the side surface 422 includes a convex surface segment $\mathbf{422}_7$ that is connected to the concave surface segment $\mathbf{422}_6$ that is located at approximately the "seven o'clock" location of the side surface 422. At approximately an "eleven o'clock" location of the side surface 422, the side surface 422 includes a concave surface segment $\mathbf{422}_8$ that is connected to the convex surface segment $\mathbf{422}_7$ that is located at approximately the "nine o'clock" location of the side surface 422. The concave surface segment $\mathbf{422}_8$ that is located at approximate the "eleven o'clock" location of the side surface 422 is connected to the convex surface segment $\mathbf{422}_1$ that is located at approximately the "twelve o'clock" location of the side surface 422.

Although the exemplary side surface 422 of the body 416 of the plate portion 412 described above includes one substantially straight surface segment (see, e.g., the substantially straight surface segment $\mathbf{3422}_5$) and a plurality of arcuate surface segments (see, e.g., convex surface segments $\mathbf{422}_1$, $\mathbf{422}_3$, $\mathbf{422}_7$ and the concave surface segments $\mathbf{422}_2$, $\mathbf{422}_4$, $\mathbf{422}_6$, $\mathbf{422}_8$), the plurality of side surface segments $\mathbf{422}_1$-$\mathbf{422}_8$ may be selectively shaped to form a plate portion 412 having any desirable shape. In an example, the plurality of side surface segments $\mathbf{422}_1$-$\mathbf{422}_8$ may be selectively shaped such that the plurality of side surface segments $\mathbf{422}_1$-$\mathbf{422}_8$ are collectively bound by a substantially trapezoidal-shaped area (see, e.g., trapezoidal shaped dashed line TR surrounding the side surface 422 of the body 416 of the plate portion 412).

Furthermore, the exemplary side surface 422 of the body 416 of the plate portion 412 described above may shape the body 416 to define a plurality of body projections 416*a*-416*d* (or, alternatively, body portions) that extend away or are spaced apart from a substantially central body portion 416*e*. The plurality of body projections 416*a*-416*d* may include an upper right body projection 416*a*, a lower right body projection 416*b*, a lower left body projection 416*c* and an upper left body projection 416*d*. The upper right body projection

416*a* may be defined by the concave surface segment $\mathbf{422}_2$, a portion of the convex surface segment $\mathbf{422}_1$ and a portion of the convex surface segment $\mathbf{422}_3$. The lower right body projection 416*b* may be defined by the concave surface segment $\mathbf{422}_4$, a portion of the convex surface segment $\mathbf{422}_3$ and a portion of the substantially straight surface segment $\mathbf{422}_5$. The lower left body projection 416*c* may be defined by the concave surface segment $\mathbf{422}_6$, a portion of the substantially straight surface segment $\mathbf{422}_5$ and a portion of the convex surface segment $\mathbf{422}_7$. The upper left body projection 416*d* may be defined by the concave surface segment $\mathbf{422}_8$, a portion of the convex surface segment $\mathbf{422}_1$ and a portion of the convex surface segment $\mathbf{422}_7$.

With continued reference to FIG. 18, the plate container portion 414 (or, alternatively, a plate engaging member) includes a body 426 having a central body portion 426*a*, a right body portion 426*b* and a left body portion 426*c*. The right body portion 426*b* includes a lower right body portion $\mathbf{426}b_1$ and an upper right body portion $\mathbf{426}b_2$ that are connected to a right end $\mathbf{426}a_U$ of the central body portion 426*a*. The left body portion 426*c* includes a lower left body portion $\mathbf{426}c_1$ and an upper left body portion $\mathbf{426}c_2$ that are connected to a left end $\mathbf{426}a_L$ of the central body portion 426*a*. Each of the right body portion 426*b* and the left body portion 426*c* may be connected, respectively, to the right end $\mathbf{426}a_U$ and the left end $\mathbf{426}a_L$ of the central body portion 426*a* by stitching, glue, welding or the like.

In some instances, the central body portion 426*a* may include a stretchable fabric mesh material including a plurality of passages. In some examples, each of the right body portion 426*b* and the left body portion 426*c* may include a fabric material having an inner surface 428 and an outer surface 430. The inner surface 428 may be defined by a canvas material.

The right body portion 426*b* defines the plate container portion 414 to include a right pocket 434*a*; the right pocket 434*a* defines a lower right pocket portion $\mathbf{434}a_1$ formed by the lower right body portion $\mathbf{426}b_1$ and an upper right pocket portion $\mathbf{434}a_2$ formed by the upper right body portion $\mathbf{426}b_2$. The left body portion 426*c* defines the plate container portion 414 to include a left pocket 434*c*; the left pocket 434*c* defines a lower left pocket portion $\mathbf{434}c_1$ formed by the lower left body portion $\mathbf{426}c_1$ and an upper left pocket portion $\mathbf{434}c_2$ formed by the upper left body portion $\mathbf{426}c_2$.

The body 426 of the plate container portion 414 includes a substantially similar shape with respect to the body 416 of the plate portion 412. For example, the body 426 of the plate container portion 414 is defined by a side surface 436 that is substantially similar to the geometry of the side surface 422 of the body 416 of the plate portion 412 (i.e., the side surface 436 of the plate container portion 414 includes a similar combination of: (1) at least one concave surface segment (corresponding to the concave surface segments $\mathbf{422}_2$, $\mathbf{422}_4$, $\mathbf{422}_6$, $\mathbf{422}_8$ of the side surface 422 of the body 416 of the plate portion 412), at least one convex surface segment (corresponding to the convex surface segments $\mathbf{422}_1$, $\mathbf{422}_3$, $\mathbf{422}_7$ of the side surface 422 of the body 416 of the plate portion 412) and (3) at least one substantially straight surface segment (corresponding to the substantially straight surface segment $\mathbf{422}_5$ of the side surface 422 of the body 416 of the plate portion 412). Although the side surface 436 of the body 426 of the plate container portion 414 includes a substantially similar shape with respect to the side surface 422 of the body 416 of the plate portion 412, the side surface 436 of the body 426 of the plate container portion 414 is defined by slightly smaller dimensions (e.g., a vertical distance dimension $D_{414V}$ and a horizontal distance dimension $D_{414H}$) dimensions than dimensions (e.g., a vertical distance dimension $D_{412V}$ and a horizontal distance dimension $a_{412H}$) formed by the side surface 422 of the body 416 of the plate portion 412.

A method for assembling the exemplary torso load distribution assembly 400 is described. In some instances, the plate container portion 414 is configured to contain the plate portion 412. In other examples, the plate engaging member 414 is attached to the plate portion 412.

Firstly, both of the upper right body projection 416*a* and the lower right body projection 416*b* of the body 416 of the plate portion 412 are disposed within the right pocket 434*a* such that the lower right body projection 416*b* is disposed in the lower right pocket portion $\mathbf{434}a_1$ and the upper right body projection 416*a* is disposed in the upper right pocket portion $\mathbf{434}a_2$. Then, both of the lower left body projection 416*c* and the upper left body projection 416*d* of the body 416 of the plate portion 412 are disposed within the left pocket 434*c* such that the lower left body projection 416*c* is disposed in the lower left pocket portion $\mathbf{434}c_1$ and the upper left body projection 416*d* is disposed in the upper left pocket portion $\mathbf{434}c_2$. Once all of the plurality of body projections 416*a*-416*d* of the plate portion 412 are arranged within the pockets $\mathbf{434}a_1$, $\mathbf{434}a_2$, $\mathbf{434}c_1$, $\mathbf{434}c_2$ formed by the plate container portion 414 as described above, the plate portion 412 is selectively-contained within the plate container portion 414 (noting that, unlike the embodiments described above, the plate container portion 414 does not include an upper lip 38, 328 and a lower lip 40, 240).

As seen in FIG. 19, once at least four body projections (see, e.g., at least the upper right body projection 416*a*, the lower right body projection 416*b*, the lower left body projection 416*c* and the upper left body projection 416*d*) of the plurality of body projections 416*a*-416*d* are respectively arranged within four pockets (see, e.g., the lower right pocket portion $\mathbf{434}a_1$ of the right pocket 434*a*, the upper right pocket portion $\mathbf{434}a_2$ of the right pocket 434*a*, the lower left pocket portion $\mathbf{434}c_1$ of the left pocket 434*c*, the upper left pocket portion $\mathbf{434}c_2$ of the left pocket 434*c*) of the plate container portion 414, the body 416 of the plate portion 412 is manipulated from an at-rest, substantially flat orientation (as seen in, e.g., FIG. 18) to a flexed or bowed orientation (as seen in, e.g., FIG. 19) due to the side surface 436 of the body 426 of the plate container portion 414 being defined to be slightly smaller dimensionally (see, e.g., $D_{414V}$, $D_{414H}$) than dimensions (see, e.g., $D_{412V}$, $D_{412H}$) formed by the side surface 422 of the body 416 of the plate portion 412. Therefore, as seen in FIG. 19, as a result of the flexing or bowing of the plate portion 412, the rear surface 420 of the plate portion 412 is biased away from an inner surface 425 of the central body portion 426*a* of the body 426 of the plate container portion 414 for forming a spacing or air gap A there-between.

Although an implementation of the torso load distribution assembly 400 is directed to the plate portion 412 being contained within the plate container portion 414 by way of pockets 434*a*, 434*c* for attaching the plate portion 412 to the plate container portion 414, attachment of the plate portion 412 to the plate container portion 414 is not limited to disposing the plate portion 412 within pockets 434*a*, 434*c* formed by the plate container portion 414. Accordingly, the plate portion 412 may be attached to the plate container portion 414 utilizing any desirable mechanical and/or chemical means. In some instances, the plate portion 412 may be attached to the plate container portion 414 by way of one or more of, for example: straps, belts, clips, buttons, zippers, snap fasteners, adhesive, ultrasonic welding or the like.

Figure 20:
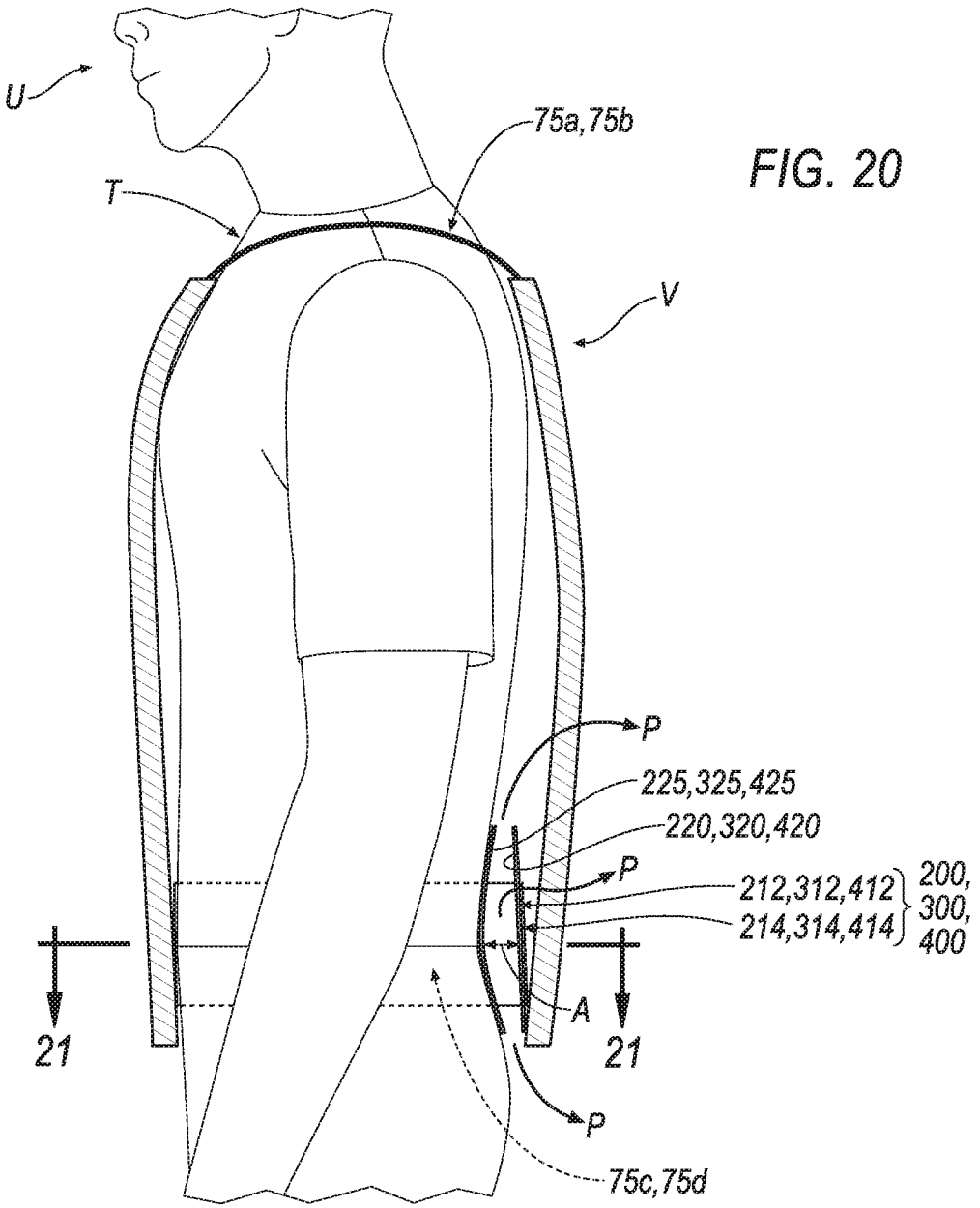
FIG. 20 is a side cross-sectional view of exemplary torso apparel disposed upon a torso of a user whereby the torso apparel includes: the torso load distribution assembly of FIG. 19 (with a cross-sectional view of the torso load distribution assembly of FIG. 20 referenced according to line 20-20 of the torso load distribution assembly of FIG. 19) arranged over a back portion of the user's torso.
Figure 21:
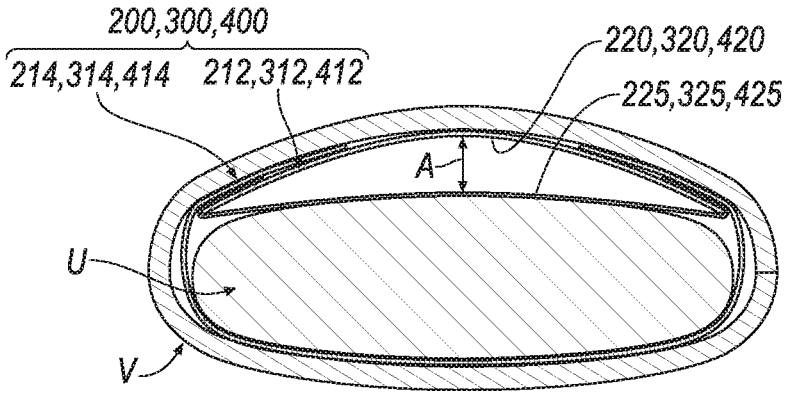
FIG. 21 is a cross-sectional view according to line 21-21 of FIG. 20.

Each of the exemplary torso load distribution assemblies 200, 300, 400 described above may be sized for arrangement as a "front torso load distribution assembly"/a "chest area torso load distribution assembly," or, alternatively, as a "rear torso load distribution assembly"/a "back area torso load distribution assembly." When sized as a "rear torso load distribution assembly"/a "back area torso load distribution assembly," however, the torso load distribution assemblies 200, 300, 400 may not necessarily be sized for arrangement over substantially all of the back area of the torso T of a user U; in an example the torso load distribution assemblies 200, 300, 400 may be sized for arrangement over a portion of the back area of the torso T of a user U such as, for example, a lumbar area of the torso T of a user U as seen in FIGS. 20-21.

Figure 22:
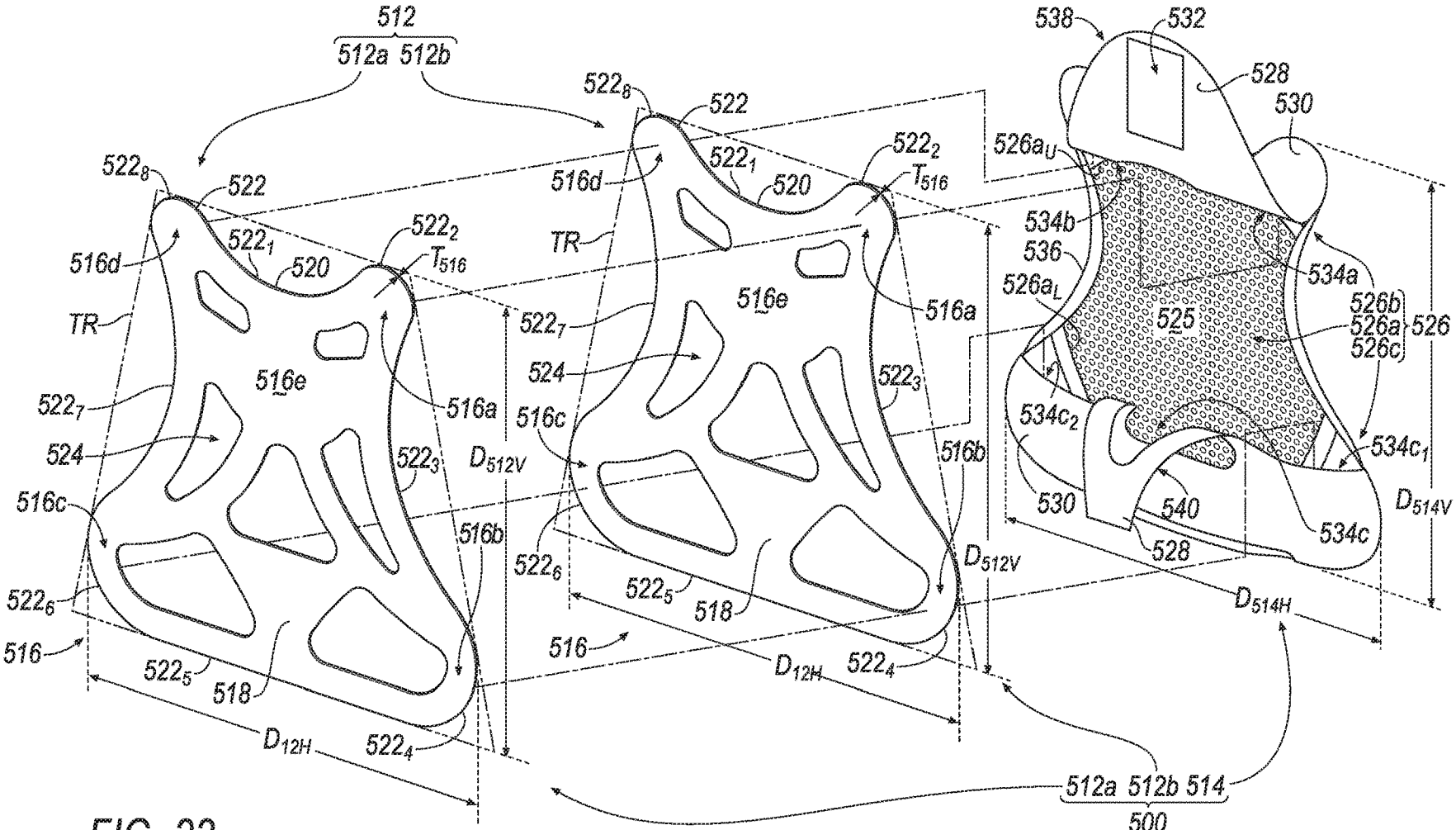
FIG. 22 is an exploded perspective view of an exemplary torso load distribution assembly.

FIG. 22 illustrates an exemplary torso load distribution assembly 500 (which may alternatively referred to as an impact reduction system). The torso load distribution assembly 500 is substantially similar to the torso load distribution assembly 10 described above; however, the torso load distribution assembly 500 includes at least two plate portions 512 (rather than one plate portion 12). In an example, the at least two plate portions 512 includes a first plate portion 512*a* and a second plate portion 512*b*. Although the torso load distribution assembly 500 illustrates only two plate portions 512*a*, 512*b*, the torso load distribution assembly 500 is not limited to including two plate portions 512*a*, 512*b* and therefore may include any desirable number of plate portions such as, for examples, three, four, five, six or more plate portions. Functionally, when the load distribution assembly 500 is assembled (by inserting the at least two plate portions 512 within the plate container portion 514), the inclusion of at least two plate portions 512 forms an air gap between each plate portion 512*a*, 512*b* within the plate container portion 514; as such, in the event that the torsion load distribution assembly 500 is attached to a carrier portion (see, e.g., reference numeral 75 described above) for forming torso apparel 100, a spacing or air gap between each plate portion 512*a*, 512*b* may further complement a spacing or air gap (see, e.g., reference numeral A described above) to further distribute an impact force from a projectile (see, e.g., reference numeral B described above) over a large area of the torso T of the user U. Furthermore, although at least two plate portions 512 are described at FIG. 22 for forming the load distribution assembly 500, the other above-described load distribution assemblies 200, 300, 400 may also include two or more plate portions 214, 314, 414, respectively.

The torso load distribution assembly 500 further includes a plate container portion 514. As described above in a substantially similar manner at FIG. 5, at least one (e.g., two) torso load distribution assembly 500 may be attached to a carrier portion (see, e.g., reference numeral 75 described above) for forming torso apparel 100. As described above at FIGS. 6-9B, when torso apparel 100 is disposed upon a torso T (see, e.g., FIG. 6) of a user U (see, e.g., FIG. 6), at least one torso load distribution assembly 500 included therein forms a spacing or air gap A (see, e.g., FIGS. 7A-7C, 8B, 9B) between a surface (see, e.g., reference numeral 520) of each plate portion 512*a*, 512*b* of the at least two plate portions 512 and a surface (see, e.g., reference numeral 525) of the plate container portion 514. In one example, the spacing or air gap A provides a plurality of air flow paths P (see, e.g., FIGS. 8B, 9B) that permit heat generated by the torso T of the user U to easily escape to surrounding atmosphere. Furthermore, as described above at FIGS. 10-13C, when torso apparel 100 is disposed upon a torso T (see, e.g., FIG. 10) of a user U (see, e.g., FIG. 10), the at least one torso load distribution assembly 500 included therein (which also includes a spacing or air gap A) assists in distributing an impact force imparted to an outboard surface of the at least one torso load distribution assembly 500 such that most of the impact force is distributed by the at least one torso load distribution assembly 500, and ultimately, over a large area (as seen in, e.g., FIGS. 11B, 12B) of the torso T of the user U rather than a concentrated area (as seen in, e.g., FIGS. 11A, 12A) of the torso T of the user U.

Each plate portion 512*a*, 512*b* of the at least two plate portions 512 includes a body 516 having a front surface 518 and a rear surface 520 and a side surface 522 that joins the front surface 518 to the rear surface 520. The body 516 is substantially flat; however, the body 516 may be formed by a flexible material (e.g., any desirable plastic material or KEVLAR®-impregnated resin) that permits the body 516 to be manipulated from an at-rest, substantially flat orientation (as seen similarly in, e.g., FIGS. 1A-1C) to a flexed or bowed orientation (as seen similarly in, e.g., FIGS. 1D-1E").

The body 516 is defined by a thickness $T_{516}$ extending between the front 518 surface and the rear surface 520. The body 516 forms a plurality (e.g., seven) of passages 524; the plurality of passages 524 extend through the thickness $T_{516}$ of the body 516. The plurality of passages 524 may reduce the weight of each plate portion 512*a*, 512*b* of the at least two plate portions 512 and provide additional air flow paths P.

The side surface 522 of the body 516 is defined by a plurality of side surface segments $\mathbf{522}_1$-$\mathbf{522}_8$. In one example, the plurality of side surface portions segments $\mathbf{522}_1$-$\mathbf{522}_8$ includes a combination of at least one concave surface segment (see, e.g., $\mathbf{522}_2$, $\mathbf{522}_4$, $\mathbf{522}_6$, $\mathbf{522}_8$), at least one convex surface segment (see, e.g., $\mathbf{522}_1$, $\mathbf{522}_3$, $\mathbf{522}_7$) and at least one substantially straight surface segment (see, e.g., $\mathbf{522}_5$).

In an example, an exemplary side surface 522 of the body 516 of each plate portion 512*a*, 512*b* of the at least two plate portions 512 may include the following geometry. At approximately a "twelve o'clock" location of the side surface 522, the side surface 522 includes a convex surface segment $\mathbf{522}_1$ that is connected to a concave surface segment $\mathbf{522}_2$ that is located at approximately a "one o'clock" location of the side surface 522. At approximately a "three o'clock" location of the side surface 522, the side surface 522 includes a convex surface segment $\mathbf{522}_3$ that is connected to the concave surface segment $\mathbf{522}_2$ that is located at approximately the "one o'clock" location of the side surface 522. At approximately a "four o'clock" location of the side surface 522, the side surface 522 includes a concave surface segment $\mathbf{522}_4$ that is connected to the convex surface segment $\mathbf{522}_3$ that is located at approximately the "three o'clock" location of the side surface 522. At approximately a "six o'clock" location of the side surface 522, the side surface 522 includes a substantially straight surface segment $\mathbf{522}_5$ that is connected to the concave surface segment $\mathbf{522}_4$ that is located at approximately the "four o'clock" location of the side surface 522. At approximately an "eight o'clock" location of the side surface 522, the side surface 522 includes a concave surface segment $\mathbf{522}_6$ that is connected to the substantially straight surface segment $\mathbf{522}_5$ that is located at approximately the "six o'clock" location of the side surface 522. At approximately a "nine o'clock" location of the side surface 522, the side surface 522 includes a convex surface segment $\mathbf{522}_7$ that is connected to the concave surface segment $522_6$ that is located at approximately the "eight o'clock" location of the side surface 522. At approximately an "eleven o'clock" location of the side surface 522, the side surface 522 includes a concave surface segment $522_8$ that is connected to the convex surface segment $522_7$ that is located at approximately the "nine o'clock" location of the side surface 522. The concave surface segment $522_8$ that is located at approximate the "eleven o'clock" location of the side surface 522 is connected to the convex surface segment $522_1$ that is located at approximately the "twelve o'clock" location of the side surface 522.

Although the exemplary side surface 522 of the body 516 of each plate portion 512*a*, 512*b* of the at least two plate portions 512 described above includes one substantially straight surface segment (see, e.g., the substantially straight surface segment $522_5$) and a plurality of arcuate surface segments (see, e.g., the convex surface segments $522_1$, $522_3$, $522_7$ and the concave surface segments $522_2$, $522_4$, $522_6$, $522_8$), the plurality of side surface segments $522_1$-$522_8$ may be selectively shaped to form each plate portion 512*a*, 512*b* of the at least two plate portions 512 having any desirable shape. In an example, the plurality of side surface segments $522_1$-$522_8$ may be selectively shaped such that the plurality of side surface segments $522_1$-$522_8$ are collectively bound by a substantially trapezoidal-shaped area (see, e.g., trapezoidal shaped dashed line TR surrounding the side surface 522 of the body 516 of each plate portion 512*a*, 512*b* of the at least two plate portions 512).

Furthermore, the exemplary side surface 522 of the body 516 of each plate portion 512*a*, 512*b* of the at least two plate portions 512 described above may shape the body 516 to define a plurality of body projections 516*a*-516*d* (or, alternatively, body portions) that extend away or are spaced apart from a substantially central body portion 516*e*. The plurality of body projections 516*a*-516*d* may include an upper right body projection 516*a*, a lower right body projection 516*b*, a lower left body projection 516*c* and an upper left body projection 516*d*. The upper right body projection 516*a* may be defined by a portion of the convex surface segment $522_1$, the concave surface segment $522_2$ and a portion of the convex surface segment $522_3$. The lower right body projection 516*b* may be defined by a portion of the convex surface segment $522_3$, the concave surface segment $522_4$ and a portion of the substantially straight surface segment $522_5$. The lower left body projection 516*c* may be defined by a portion of the substantially straight surface segment $522_5$, the concave surface segment $522_6$ and a portion of the convex surface segment $522_7$. The upper left body projection 516*d* may be defined by a portion of the convex surface segment $522_7$, the concave surface segment $522_8$ and a portion of the convex surface segment $522_1$.

The plate container portion 514 (or, alternatively, a plate engaging member) includes a body 526 having a central body portion 526*a*, an upper body portion 526*b* and a lower body portion 526*c*. The upper body portion 526*b* is connected to an upper end $526a_U$ of the central body portion 526*a*. The lower body portion 526*c* is connected to a lower end $526a_L$ of the central body portion 526*a*. Each of the upper body portion 526*b* and the lower body portion 526*c* may be connected, respectively, to the upper end $526a_U$ and the lower end $526a_L$ of the central body portion 526*a* by stitching, glue, welding or the like.

In some instances, the central body portion 526*a* may include a stretchable fabric mesh material including a plurality of passages. In some examples, each of the upper body portion 526*b* and the lower body portion 526*c* may include a fabric material having an inner surface 528 and an outer surface 530. The inner surface 528 may be defined by a canvas material. The outer surface 530 may be defined by a "loop" material that may cooperate with a "hook" material (see, e.g., reference numeral 532) to define to "hook-and-loop" connection (e.g., VELCRO®). In some examples, the inner surface 528 of at least one of the upper body portion 526*b* and the lower body portion 526*c* includes a patch of material 532; the patch of material 532 may be defined by a "hook" material that may cooperate with a "loop" material (see, e.g., reference numeral 530) to define to "hook-and-loop" connection (e.g., VELCRO®).

The upper body portion 526*b* defines the plate container portion 514 to include an upper right pocket 534*a* and an upper left pocket 534*b*. The lower body portion 526*c* defines the plate container portion 514 to include a lower pocket 534*c*; the lower pocket 534*c* defines a lower right pocket portion $534c_1$ and a lower left pocket portion $534c_2$.

The body 526 of the plate container portion 514 includes a substantially similar shape with respect to the body 516 of each plate portion 512*a*, 512*b* of the at least two plate portions 512. For example, the body 526 of the plate container portion 514 is defined by a side surface 536 that is substantially similar to the geometry of the side surface 522 of the body 516 of each plate portion 512*a*, 512*b* of the at least two plate portions 512 (i.e., the side surface 536 of the plate container portion 514 includes a similar combination of: (1) at least one concave surface segment (corresponding to the concave surface segments $522_2$, $522_4$, $522_6$, $522_8$ of the side surface 522 of the body 516 of each plate portion 512*a*, 512*b* of the at least two plate portions 512), (2) at least one convex surface segment (corresponding to the convex surface segments $522_1$, $522_3$, $522_7$ of the side surface 522 of the body 516 of each plate portion 512*a*, 512*b* of the at least two plate portions 512), and (3) at least one substantially straight surface segment (corresponding to the substantially straight surface segment $522_5$ of the side surface 522 of the body 516 of each plate portion 512*a*, 512*b* of the at least two plate portions 512). Although the side surface 536 of the body 526 of the plate container portion 514 includes a substantially similar shape with respect to the side surface 522 of the body 516 of each plate portion 512*a*, 512*b* of the at least two plate portions 512, the side surface 536 of the body 526 of the plate container portion 514 is defined by slightly smaller dimensions (e.g., a vertical distance dimension $D_{514V}$ and a horizontal distance dimension $D_{514H}$) than dimensions (e.g., a vertical distance dimension $D_{512V}$ and a horizontal distance dimension $D_{512H}$) formed by the side surface 522 of the body 516 of each plate portion 512*a*, 512*b* of the at least two plate portions 512.

The upper body portion 526*b* defines an upper lip 538 of the body 526 of the plate container portion 514. The lower body portion 526*c* defines a lower lip 540 of the body 526 of the plate container portion 514. The upper lip 538 of the upper body portion 526*b* is also defined by the inner surface 528 and the outer surface 530 as described above. In some examples, the inner surface 528 of the upper lip 538 may include the patch of material 532 that is defined by the "hook" material of a "hook-and-loop" connection; as will be described similarly above at FIGS. 1D-1E", the "hook" material provided by the patch of material 532 upon of the upper lip 538 may cooperate with the "loop" material provided by the outer surface 530 of the lower lip 540 of the body 526 of the plate container portion 514 to provide a "hook-and-loop" connection (e.g., VELCRO®) for selectively connecting the upper lip 538 to the lower lip 540.

As described similarly above at FIGS. 1B-1E", a method for assembling the exemplary torso load distribution assembly 500 is described. In some instances, the plate container portion 514 is configured to contain the plate portion 512. In other examples, the plate engaging member 514 is attached to the plate portion 512.

Firstly, as seen similarly above at FIG. 1B, the lower right body projection 516*b* of the body 516 of each plate portion 512*a*, 512*b* of the at least two plate portions 512 is disposed within the lower right pocket portion 534$c_1$ of the lower pocket 534*c* formed by the lower body portion 526*c* of the body 526 of the plate container portion 514. Then, as seen similarly above at FIG. 1C, the lower left body projection 516*c* of the body 516 of each plate portion 512*a*, 512*b* of the at least two plate portions 512 is disposed within the lower left pocket portion 534$c_2$ of the lower pocket 534*c* formed by the lower body portion 526*c* of the body 526 of the plate container portion 514.

Then, referring to FIG. 1D as seen similarly above, the upper right body projection 516*a* of the body 516 of each plate portion 512*a*, 512*b* of the at least two plate portions 512 is disposed within the upper right pocket 534*a* formed by the upper body portion 526*b* of the body 526 of the plate container portion 514. Then, referring to FIGS. 1D-1E' as seen similarly above, the upper left body projection 516*d* of the body 516 of each plate portion 512*a*, 512*b* of the at least two plate portions 512 is disposed within the upper left pocket 534*b* formed by the upper body portion 526*b* of the body 526 of the plate container portion 514.

With reference to FIGS. 1D and 1E'-1E" as seen similarly above, once all of the plurality of body projections 516*a*-16*d* of each plate portion 512*a*, 512*b* of the at least two plate portions 512 are arranged within the pockets 534*a*, 534*b*, 534$c_1$, 534$c_2$ formed by the plate container portion 514 as described above, the lower lip 540 of the lower body portion 526*c* of the body 526 of the plate container portion 514 is arranged over the substantially central body portion 516*e* of the body 516 of each plate portion 512*a*, 512*b* of the at least two plate portions 512. Then, the upper lip 538 of the upper body portion 526*b* of the body 526 of the plate container portion 514 is arranged over the lower lip 540 of the of the lower body portion 526*c* of the body 526 of the plate container portion 514 and the substantially central body portion 516*e* of the body 516 of each plate portion 512*a*, 512*b* of the at least two plate portions 512 such that the patch of material 532 including the "hook" material provided upon of the inner surface 528 of the upper lip 538 may cooperate with the "loop" material provided by the outer surface 530 of the lower lip 540 to provide a "hook-and-loop" connection (e.g., VELCRO®) for selectively connecting the upper lip 538 to the lower lip 540 (as seen similarly above in, e.g., FIG. 1E') and thereby selectively containing each plate portion 512*a*, 512*b* of the at least two plate portions 512 within the plate container portion 514.

As seen similarly above in FIGS. 1D-1F and 2B, once at least three body projections (see, e.g., at least the lower right body projection 516*b*, the lower left body projection 516*c* and the upper right body projection 516*a* as seen similarly above in FIG. 1D) of the plurality of body projections 516*a*-516*d* are respectively arranged within three pockets (see, e.g., the lower right pocket portion 534$c_1$ of the lower pocket 534*c*, the lower left pocket portion 534$c_2$ of the lower pocket 534*c* and the upper right pocket 534*a*) of the plate container portion 514, the body 516 of each plate portion 512*a*, 512*b* of the at least two plate portions 512 is manipulated from an at-rest, substantially flat orientation (as seen similarly above in, e.g., FIGS. 1A-1C) to a flexed or bowed orientation (as seen similarly above in, e.g., FIGS. 1D-1E") due to the side surface 536 of the body 526 of the plate container portion 514 being defined to be slightly smaller dimensionally (see, e.g., $D_{514V}$, $D_{514H}$) than dimensions (see, e.g., $D_{512V}$, $D_{512H}$) formed by the side surface 522 of the body 516 of each plate portion 512*a*, 512*b* of the at least two plate portions 512. Therefore, as seen similarly above in FIGS. 1D, 1E', 1E", 1F, and 2B, as a result of the flexing or bowing of each plate portion 512*a*, 512*b* of the at least two plate portions 512, the rear surface 520 of each plate portion 512*a*, 512*b* of the at least two plate portions 512 is biased away from an inner surface 525 of the central body portion 526*a* of the body 526 of the plate container portion 514 for forming a spacing or air gap A there-between.

Although an implementation of the torso load distribution assembly 500 is directed to the plate portion 512 being contained within the plate container portion 514 by way of pockets 534*a*, 534*c* for attaching the plate portion 512 to the plate container portion 514, attachment of the plate portion 512 to the plate container portion 514 is not limited to disposing the plate portion 512 within pockets 534*a*, 534*c* formed by the plate container portion 514. Accordingly, the plate portion 512 may be attached to the plate container portion 514 utilizing any desirable mechanical and/or chemical means. In some instances, the plate portion 512 may be attached to the plate container portion 514 by way of one or more of, for example: straps, belts, clips, buttons, zippers, snap fasteners, adhesive, ultrasonic welding or the like.

FIGS. 23A-24B illustrate an exemplary torso load distribution assembly 600 (which may alternatively referred to as an impact reduction system). The torso load distribution assembly 600 includes a plate portion 612 (see also, e.g., FIGS. 23A, 24A') and a plate container portion 614 (see also, e.g., FIGS. 23A, 24A"). As described above in a substantially similar manner at FIG. 5, at least one (e.g., two) torso load distribution assembly 600 may be attached to a carrier portion (see, e.g., reference numeral 75 described above) for forming torso apparel 100. As described above at FIGS. 6-9B, when torso apparel 100 is disposed upon a torso T (see, e.g., FIG. 6) of a user U (see, e.g., FIG. 6), at least one torso load distribution assembly 600 included therein forms a spacing or air gap A (see, e.g., FIGS. 7A-7C, 8B, 9B) between a surface (see, e.g., reference numeral 620) of the plate portion 612 and a surface (see, e.g., reference numeral 625) of the plate container portion 614. In one example, the spacing or air gap A provides a plurality of air flow paths P (see, e.g., FIGS. 8B, 9B) that permit heat generated by the torso T of the user U to easily escape to surrounding atmosphere. Furthermore, as will be described above at FIGS. 10-13C, when torso apparel 100 is disposed upon a torso T (see, e.g., FIG. 10) of a user U (see, e.g., FIG. 10), the at least one torso load distribution assembly 600 included therein (which also includes a spacing or air gap A) assists in distributing an impact force imparted to an outboard surface of the at least one torso load distribution assembly 600 such that most of the impact force is distributed by the at least one torso load distribution assembly 600, and ultimately, over a large area (as seen in, e.g., FIGS. 11B, 12B) of the torso T of the user U rather than a concentrated area (as seen in, e.g., FIGS. 11A, 12A) of the torso T of the user U.

Figure 23A:
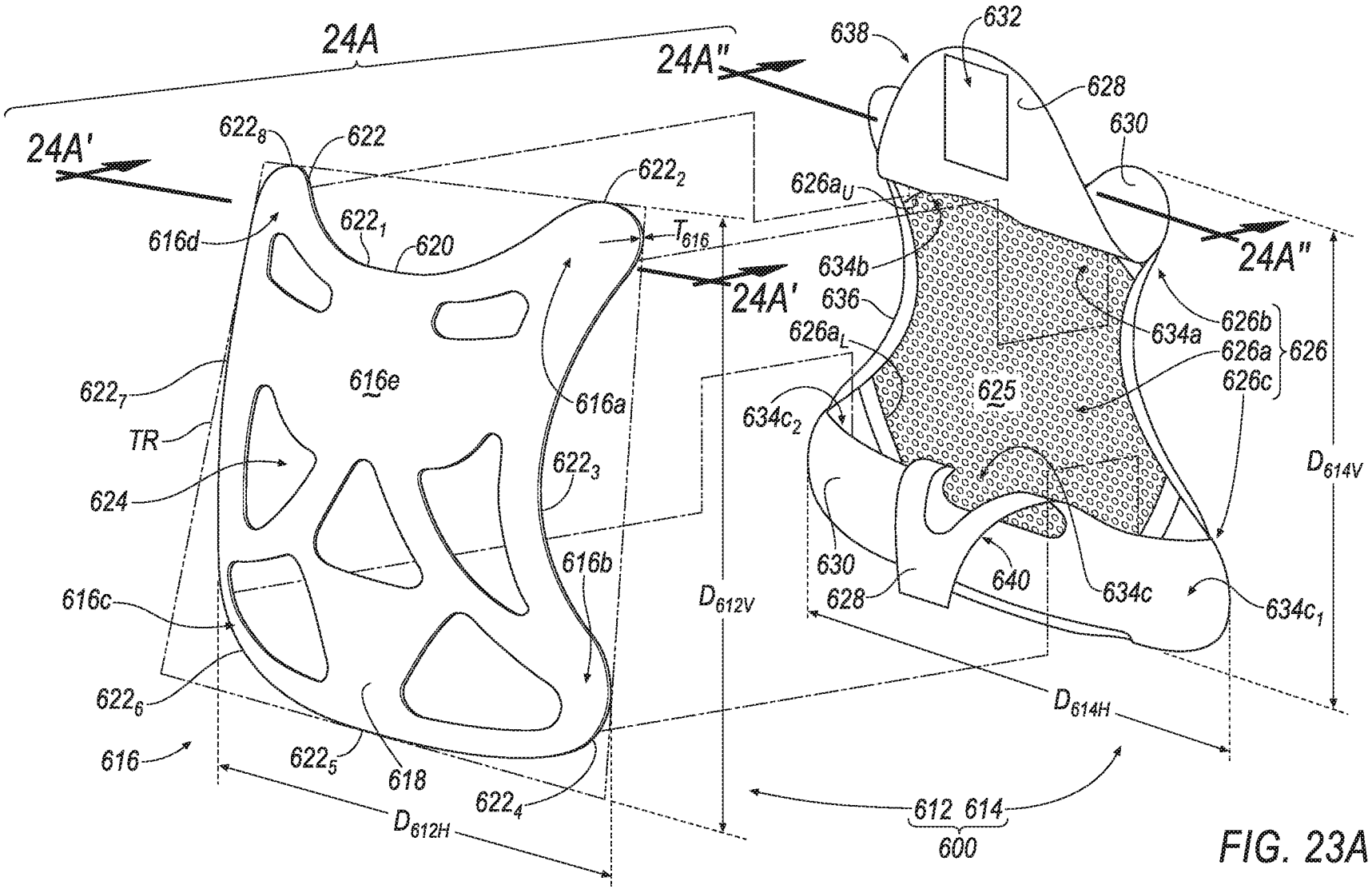
FIGS. 23A-23F illustrate views of an exemplary torso load distribution assembly.

Referring to FIG. 23A, the plate portion 612 includes a body 616 having a front surface 618 and a rear surface 620 and a side surface 622 that joins the front surface 618 to the rear surface 620. Unlike the exemplary embodiments described above disclosing, for example, an exemplary body (see, e.g., reference numeral 16 of FIG. 1A) being arranged in an at-rest, substantially flat orientation that is subsequently manipulated to a flexed or bowed orientation by an exemplary plate container portion (see, e.g., reference numeral 14 of FIG. 1A), the body 616 of the plate portion 612 is preformed to define an at-rest, non-flat, bowed orientation. As seen in FIG. 24B, when the body 616 of the plate portion 612 is disposed within the plate container portion 614, the plate container 614 is permitted to be stretched about the body 616 of the plate portion 612 (i.e., the plate container 614 is manipulated from an at-rest, substantially flat orientation (as seen in, e.g., FIG. 24A") to a flexed or bowed orientation (as seen in, e.g., FIG. 24B). In some implementations, the body 616 of the plate portion 612 may be formed by any desirable material (e.g., any plastic material or KEVLAR®-impregnated resin).

The body 616 is defined by a thickness $T_{616}$ extending between the front 618 surface and the rear surface 620. The body 616 forms a plurality (e.g., seven) of passages 624; the plurality of passages 624 extend through the thickness $T_{616}$ of the body 616. The plurality of passages 624 may reduce the weight of the plate portion 612 and provide additional air flow paths P.

The side surface 622 of the body 616 is defined by a plurality of side surface segments $\mathbf{622}_1$-$\mathbf{622}_8$. In one example, the plurality of side surface portions segments $\mathbf{622}_1$-$\mathbf{622}_8$ includes a combination of at least one concave surface segment (see, e.g., $\mathbf{622}_2$, $\mathbf{622}_4$, $\mathbf{622}_6$, $\mathbf{622}_8$), at least one convex surface segment (see, e.g., $\mathbf{622}_1$, $\mathbf{622}_3$, $\mathbf{622}_7$) and at least one substantially straight surface segment (see, e.g., $\mathbf{622}_5$).

In an example, an exemplary side surface 622 of the body 616 of the plate portion 612 may include the following geometry. At approximately a "twelve o'clock" location of the side surface 622, the side surface 622 includes a convex surface segment $\mathbf{622}_1$ that is connected to a concave surface segment $\mathbf{622}_2$ that is located at approximately a "one o'clock" location of the side surface 622. At approximately a "three o'clock" location of the side surface 622, the side surface 622 includes a convex surface segment $\mathbf{622}_3$ that is connected to the concave surface segment $\mathbf{622}_2$ that is located at approximately the "one o'clock" location of the side surface 622. At approximately a "four o'clock" location of the side surface 622, the side surface 622 includes a concave surface segment $\mathbf{622}_4$ that is connected to the convex surface segment $\mathbf{622}_3$ that is located at approximately the "three o'clock" location of the side surface 622. At approximately a "six o'clock" location of the side surface 622, the side surface 622 includes a substantially straight surface segment $\mathbf{622}_5$ that is connected to the concave surface segment $\mathbf{622}_4$ that is located at approximately the "four o'clock" location of the side surface 622. At approximately an "eight o'clock" location of the side surface 622, the side surface 622 includes a concave surface segment $\mathbf{622}_6$ that is connected to the substantially straight surface segment $\mathbf{622}_5$ that is located at approximately the "six o'clock" location of the side surface 622. At approximately a "nine o'clock" location of the side surface 622, the side surface 622 includes a convex surface segment $\mathbf{622}_7$ that is connected to the concave surface segment $\mathbf{622}_6$ that is located at approximately the "eight o'clock" location of the side surface 622. At approximately an "eleven o'clock" location of the side surface 622, the side surface 622 includes a concave surface segment $\mathbf{622}_8$ that is connected to the convex surface segment $\mathbf{622}_7$ that is located at approximately the "nine o'clock" location of the side surface 622. The concave surface segment $\mathbf{622}_8$ that is located at approximate the "eleven o'clock" location of the side surface 622 is connected to the convex surface segment $\mathbf{622}_1$ that is located at approximately the "twelve o'clock" location of the side surface 622.

Although the exemplary side surface 622 of the body 616 of the plate portion 612 described above includes one substantially straight surface segment (see, e.g., the substantially straight surface segment $\mathbf{622}_5$) and a plurality of arcuate surface segments (see, e.g., the convex surface segments $\mathbf{622}_1$, $\mathbf{622}_3$, $\mathbf{622}_7$ and the concave surface segments $\mathbf{622}_2$, $\mathbf{622}_4$, $\mathbf{622}_6$, $\mathbf{622}_8$), the plurality of side surface segments $\mathbf{622}_1$-$\mathbf{622}_8$ may be selectively shaped to form a plate portion 612 having any desirable shape. In an example, the plurality of side surface segments $\mathbf{622}_1$-$\mathbf{622}_8$ may be selectively shaped such that the plurality of side surface segments $\mathbf{622}_1$-$\mathbf{622}_8$ are collectively bound by a substantially trapezoidal-shaped area (see, e.g., trapezoidal shaped dashed line TR surrounding the side surface 622 of the body 616 of the plate portion 612).

Furthermore, the exemplary side surface 622 of the body 616 of the plate portion 612 described above may shape the body 616 to define a plurality of body projections 616*a*-616*d* (or, alternatively, body portions) that extend away or are spaced apart from a substantially central body portion 616*e*. The plurality of body projections 616*a*-616*d* may include an upper right body projection 616*a*, a lower right body projection 616*b*, a lower left body projection 616*c* and an upper left body projection 616*d*. The upper right body projection 616*a* may be defined by a portion of the convex surface segment $\mathbf{622}_1$, the concave surface segment $\mathbf{622}_2$ and a portion of the convex surface segment $\mathbf{622}_3$. The lower right body projection 616*b* may be defined by a portion of the convex surface segment $\mathbf{622}_3$, the concave surface segment $\mathbf{622}_4$ and a portion of the substantially straight surface segment $\mathbf{622}_5$. The lower left body projection 616*c* may be defined by a portion of the substantially straight surface segment $\mathbf{622}_5$, the concave surface segment $\mathbf{622}_6$ and a portion of the convex surface segment $\mathbf{622}_7$. The upper left body projection 616*d* may be defined by a portion of the convex surface segment $\mathbf{622}_7$, the concave surface segment $\mathbf{622}_8$ and a portion of the convex surface segment $\mathbf{622}_1$.

With continued reference to FIG. 23A, the plate container portion 614 (or, alternatively, a plate engaging member) includes a body 626 having a central body portion 626*a*, an upper body portion 626*b* and a lower body portion 626*c*. The upper body portion 626*b* is connected to an upper end $\mathbf{626}a_U$ of the central body portion 626*a*. The lower body portion 626*c* is connected to a lower end $\mathbf{626}a_L$ of the central body portion 626*a*. Each of the upper body portion 626*b* and the lower body portion 626*c* may be connected, respectively, to the upper end $\mathbf{626}a_U$ and the lower end $\mathbf{626}a_L$ of the central body portion 626*a* by stitching, glue, welding or the like.

In some instances, the central body portion 626*a* may include a stretchable fabric mesh material including a plurality of passages. In some examples, each of the upper body portion 626*b* and the lower body portion 626*c* may include a fabric material having an inner surface 628 and an outer surface 630. The inner surface 628 may be defined by a canvas material. The outer surface 630 may be defined by a "loop" material that may cooperate with a "hook" material (see, e.g., reference numeral 632) to define to "hook-and-loop" connection (e.g., VELCRO®). In some examples, the inner surface 628 of at least one of the upper body portion 626*b* and the lower body portion 626*c* includes a patch of material 632; the patch of material 632 may be defined by a "hook" material that may cooperate with a "loop" material (see, e.g., reference numeral 630) to define to "hook-and-loop" connection (e.g., VELCRO®).

The upper body portion 626*b* defines the plate container portion 614 to include an upper right pocket 634*a* and an upper left pocket 634*b*. The lower body portion 626*c* defines the plate container portion 614 to include a lower pocket 634*c*; the lower pocket 634*c* defines a lower right pocket portion 634$c_1$ and a lower left pocket portion 634$c_2$.

The body 626 of the plate container portion 614 includes a substantially similar shape with respect to the body 616 of the plate portion 612. For example, the body 626 of the plate container portion 614 is defined by a side surface 636 that is substantially similar to the geometry of the side surface 622 of the body 616 of the plate portion 612 (i.e., the side surface 636 of the plate container portion 614 includes a similar combination of: (1) at least one concave surface segment (corresponding to the concave surface segments 622$_2$, 622$_4$, 622$_6$, 622$_8$ of the side surface 622 of the body 616 of the plate portion 612), (2) at least one convex surface segment (corresponding to the convex surface segments 622$_1$, 622$_3$, 622$_7$ of the side surface 622 of the body 616 of the plate portion 612), and (3) at least one substantially straight surface segment (corresponding to the substantially straight surface segment 622$_5$ of the side surface 622 of the body 616 of the plate portion 612). Although the side surface 636 of the body 626 of the plate container portion 614 includes a substantially similar shape with respect to the side surface 622 of the body 616 of the plate portion 612, the side surface 636 of the body 626 of the plate container portion 614 may be defined by slightly smaller dimensions (e.g., a vertical distance dimension $D_{614V}$ and a horizontal distance dimension $D_{614H}$) than dimensions (e.g., a vertical distance dimension $D_{612V}$ and a horizontal distance dimension $D_{612H}$) formed by the side surface 622 of the body 616 of the plate portion 612; in some implementations, however, because the body 616 of the plate portion 612 is preformed to define an at-rest non-flat, bowed orientation, the side surface 636 of the body 626 of the plate container portion 614 may be defined by substantially similar but slightly larger dimensions (e.g., a vertical distance dimension $D_{614V}$ and a horizontal distance dimension $D_{614H}$) than dimensions (e.g., a vertical distance dimension $D_{612V}$ and a horizontal distance dimension $D_{612H}$) formed by the side surface 622 of the body 616 of the plate portion 612.

With continued reference to FIG. 23A, the upper body portion 626*b* defines an upper lip 638 of the body 626 of the plate container portion 614. The lower body portion 626*c* defines a lower lip 640 of the body 626 of the plate container portion 614. The upper lip 638 of the upper body portion 626*b* is also defined by the inner surface 628 and the outer surface 630 as described above. In some examples, the inner surface 628 of the upper lip 638 may include the patch of material 632 that is defined by the "hook" material of a "hook-and-loop" connection; as similarly described above at FIGS. 1D-1E", the "hook" material provided by the patch of material 632 upon of the upper lip 638 may cooperate with the "loop" material provided by the outer surface 630 of the lower lip 640 of the body 626 of the plate container portion 614 to provide a "hook-and-loop" connection (e.g., VELCRO®) for selectively connecting the upper lip 638 to the lower lip 640.

Referring to FIGS. 23B-23E", a method for assembling the exemplary torso load distribution assembly 600 is described. In some instances, the plate container portion 614 is configured to contain the plate portion 612. In other examples, the plate engaging member 614 is attached to the plate portion 612.

Figure 23B:
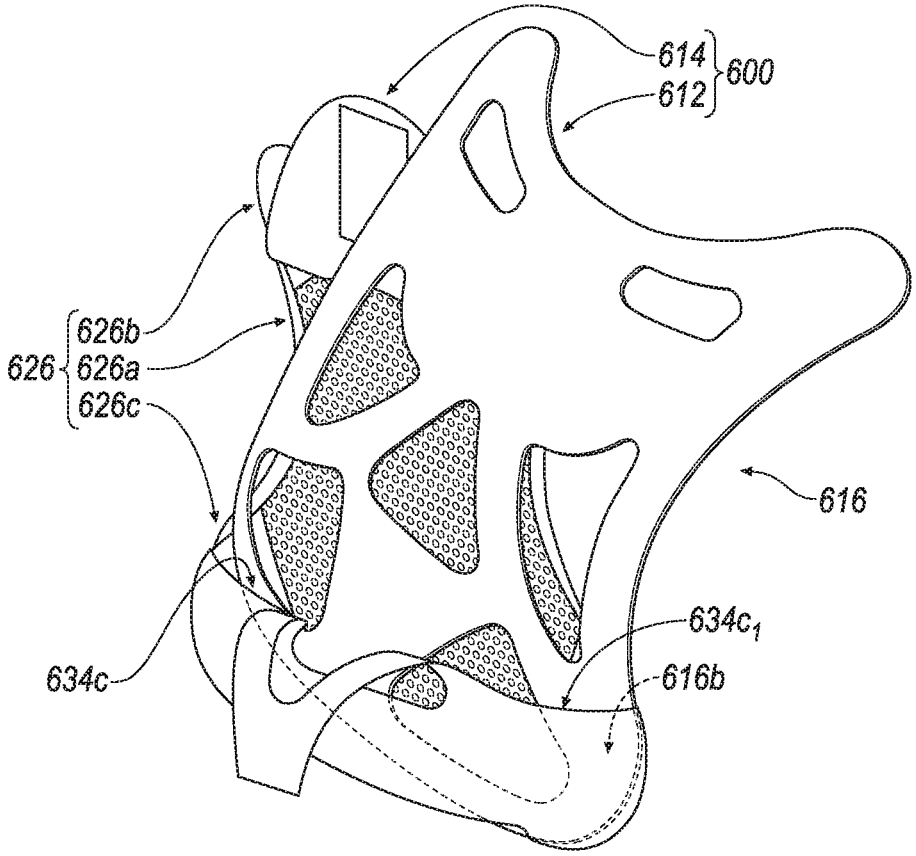
Figure 23C:
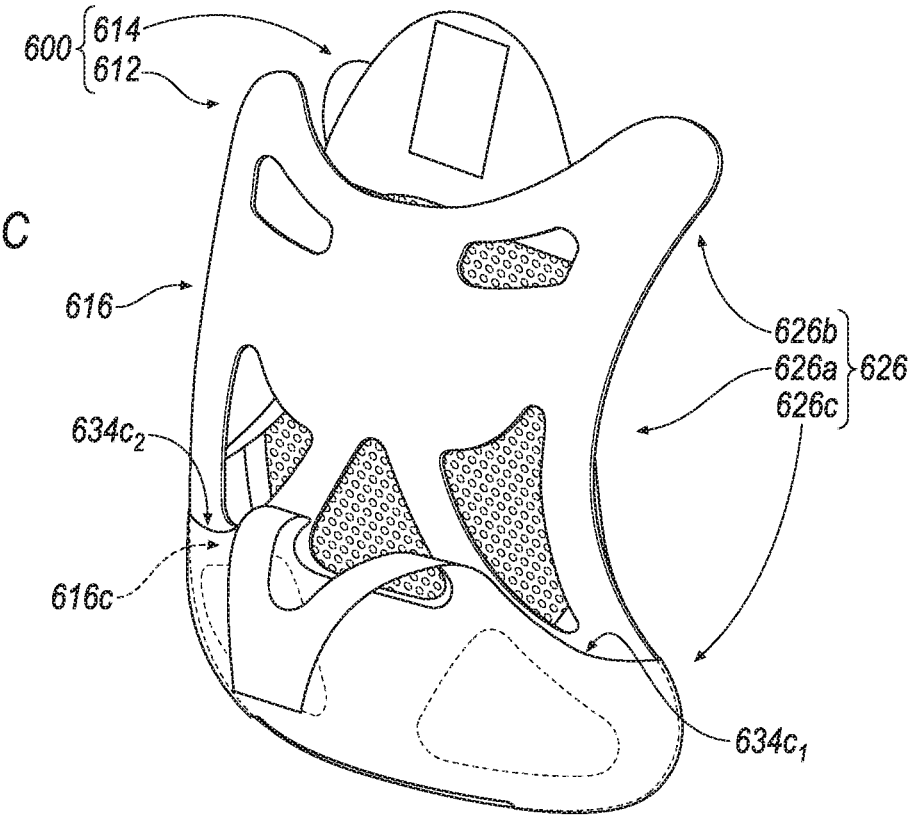

Firstly, as seen at FIG. 23B, the lower right body projection 616*b* of the body 616 of the plate portion 612 is disposed within the lower right pocket portion 634$c_1$ of the lower pocket 634*c* formed by the lower body portion 626*c* of the body 626 of the plate container portion 614. Then, as seen at FIG. 23C, the lower left body projection 616*c* of the body 616 of the plate portion 612 is disposed within the lower left pocket portion 634$c_2$ of the lower pocket 634*c* formed by the lower body portion 626*c* of the body 626 of the plate container portion 614.

Figure 23D:
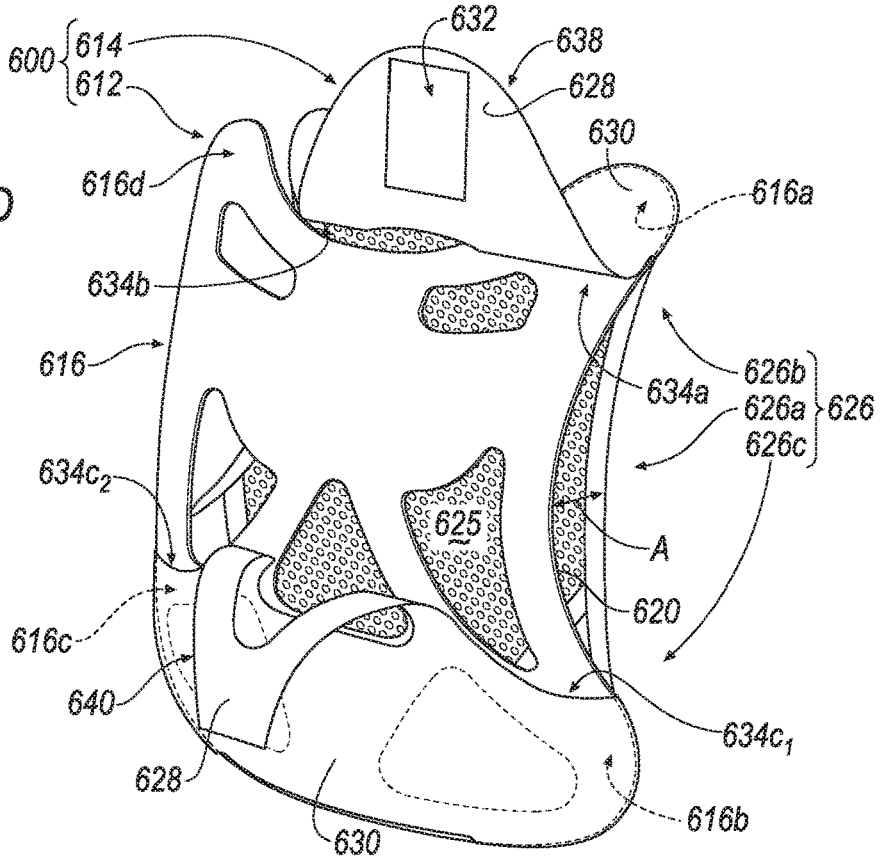

Then, referring to FIG. 23D, the upper right body projection 616*a* of the body 616 of the plate portion 612 is disposed within the upper right pocket 634*a* formed by the upper body portion 626*b* of the body 626 of the plate container portion 614. Then, referring to FIGS. 23D-23E', the upper left body projection 616*d* of the body 616 of the plate portion 612 is disposed within the upper left pocket 634*b* formed by the upper body portion 626*b* of the body 626 of the plate container portion 614.

Figure 23E:
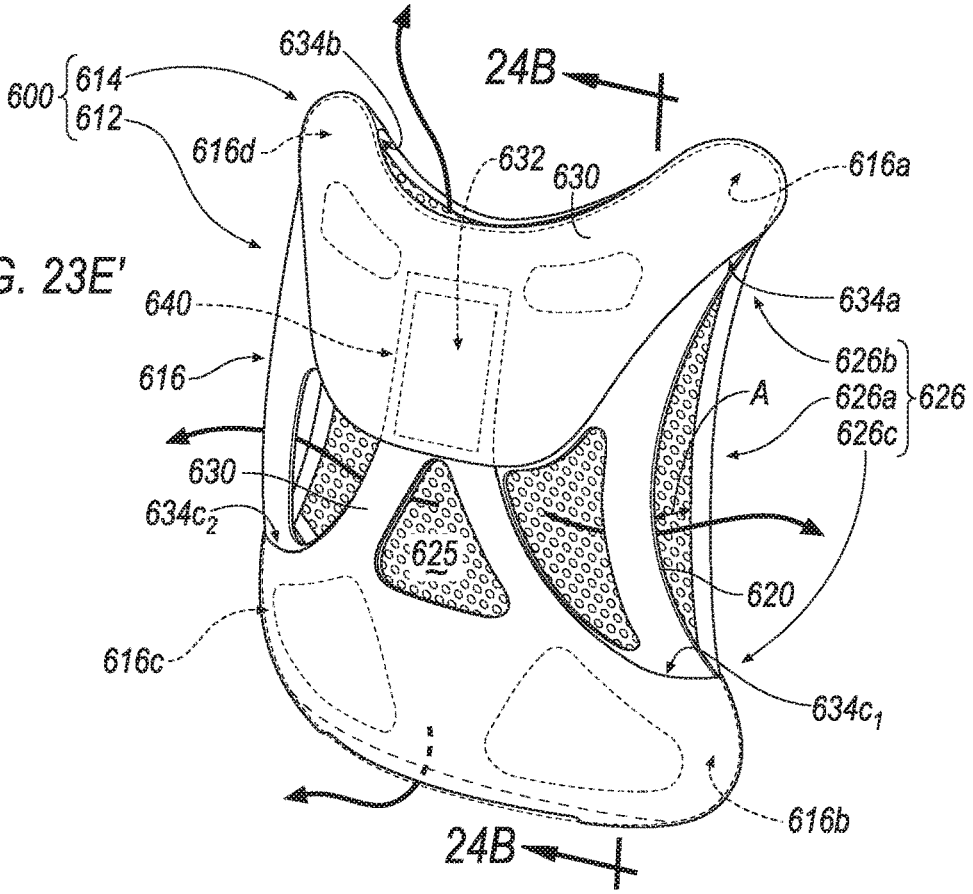
Figure 23F:
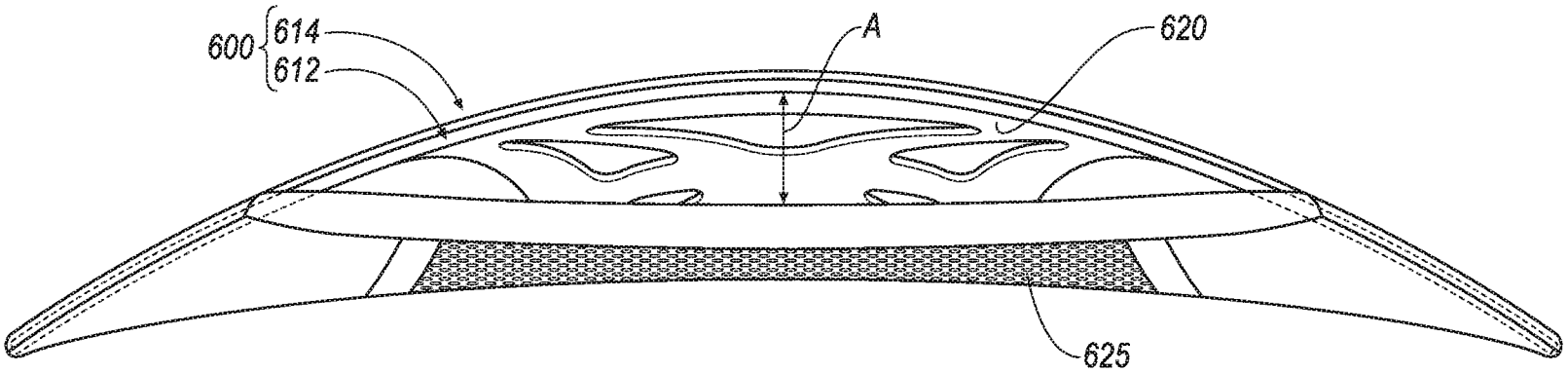

With reference to FIGS. 23D-23E", once all of the plurality of body projections 616*a*-616*d* of the plate portion 612 are arranged within the pockets 634*a*, 634*b*, 634$c_1$, 634$c_2$ formed by the plate container portion 614 as described above, the lower lip 640 of the lower body portion 626*c* of the body 626 of the plate container portion 614 is arranged over the substantially central body portion 616*e* of the body 616 of the plate portion 612. Then, the upper lip 638 of the upper body portion 626*b* of the body 626 of the plate container portion 614 is arranged over the lower lip 640 of the of the lower body portion 626*c* of the body 626 of the plate container portion 614 and the substantially central body portion 616*e* of the body 616 of the plate portion 612 such that the patch of material 632 including the "hook" material provided upon of the inner surface 628 of the upper lip 638 may cooperate with the "loop" material provided by the outer surface 630 of the lower lip 640 to provide a "hook-and-loop" connection (e.g., VELCRO®) for selectively connecting the upper lip 638 to the lower lip 640 (as seen in, e.g., FIG. 23E') and thereby selectively containing the plate portion 612 within the plate container portion 614.

As seen in FIGS. 23D-23F and 24B, once at least three body projections (see, e.g., at least the lower right body projection 616*b*, the lower left body projection 616*c* and the upper right body projection 616*a* in FIG. 23D) of the plurality of body projections 616*a*-616*d* are respectively arranged within three pockets (see, e.g., the lower right pocket portion 634$c_1$ of the lower pocket 634*c*, the lower left pocket portion 634$c_2$ of the lower pocket 634*c* and the upper right pocket 634*a*) of the plate container portion 614, the at-rest, non-flat, bowed orientation of the body 616 of the plate portion 612 manipulates the plate container portion 614 from an at-rest, substantially flat orientation (as seen in, e.g., FIG. 24A") to a flexed or bowed orientation (as seen in, e.g., FIG. 24B) as a result of the corresponding dimensional relationship of plate container portion 614 and the at-rest, non-flat, bowed plate portion 612 described above. Therefore, as seen in FIGS. 23D, 23E', 23E", 23F, and 24B, as a result of the at-rest, non-flat, bowed orientation of the plate portion 612 arranged within the plate container portion 614, the rear surface 620 of the plate portion 612 is arranged away from an inner surface 625 of the central body portion 626*a* of the body 626 of the plate container portion 614 for forming a spacing or air gap A there-between.

Although an implementation of the torso load distribution assembly 600 is directed to the plate portion 612 being contained within the plate container portion 614 by way of pockets 634*a*, 634*b*, 634*c* for attaching the plate portion 612 to the plate container portion 614, attachment of the plate portion 612 to the plate container portion 614 is not limited to disposing the plate portion 612 within pockets 634*a*, 634*b*, 634*c* formed by the plate container portion 614. Accordingly, the plate portion 612 may be attached to the plate container portion 614 utilizing any desirable mechanical and/or chemical means. In some instances, the plate portion 612 may be attached to the plate container portion 614 by way of one or more of, for example: straps, belts, clips, buttons, zippers, snap fasteners, adhesive, ultrasonic welding or the like.

Figure 25:
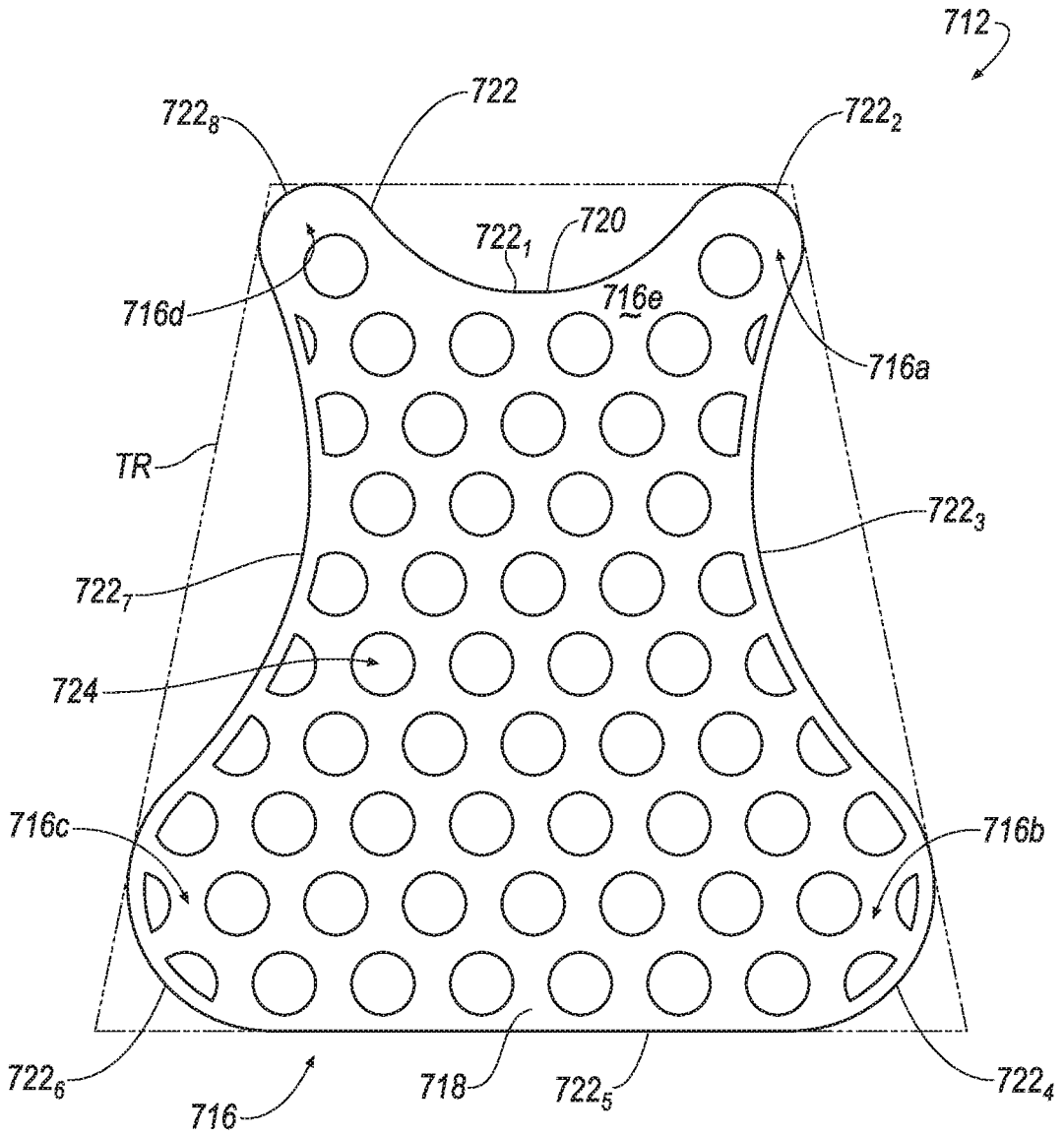
FIG. 25 is a front view or a rear view of an exemplary plate portion of a torso load distribution assembly.

FIG. 25 illustrate an exemplary plate portion 712. The plate portion 712 may be incorporated as an alternative plate portion (with respect to, for example, the plate portion 12 described above), or, an additional plate portion (with respect to, for example, the plate portion 12 described above) for forming the torso load distribution assembly 10. Furthermore, the plate portion 712 may be defined to include an at-rest, substantially flat orientation, or, alternatively, an at-rest, non-flat, bowed orientation.

In an example, the torso load distribution assembly 10 includes one or both of the plate portion 12, 712 (see also, e.g., FIGS. 2A', 3) and a plate container portion 14 (see also, e.g., FIGS. 2A", 4A-4B). As described above at FIG. 5, at least one (e.g., two) torso load distribution assembly 10 (including one or both of the plate portion 12, 712) may be attached to a carrier portion 75 for forming torso apparel 100. As described above at FIGS. 6-9B, when torso apparel 100 is disposed upon a torso T (see, e.g., FIG. 6) of a user U (see, e.g., FIG. 6), at least one torso load distribution assembly 10 (including one or both of the plate portion 12, 712) included therein forms a spacing or air gap A (see, e.g., FIGS. 7A-7C, 8B, 9B) between a surface (see, e.g., reference numeral 20, 720) of the plate portion 12, 712 and a surface (see, e.g., reference numeral 25) of the plate container portion 14. In one example, the spacing or air gap A provides a plurality of air flow paths P (see, e.g., FIGS. 8B, 9B) that permit heat generated by the torso T of the user U to easily escape to surrounding atmosphere. Furthermore, as described above at FIGS. 10-13C, when torso apparel 100 is disposed upon a torso T (see, e.g., FIG. 10) of a user U (see, e.g., FIG. 10), the at least one torso load distribution assembly 10 included therein (which also includes a spacing or air gap A) assists in distributing an impact force imparted to an outboard surface of the at least one torso load distribution assembly 10 (including one or both of the plate portion 12, 712) such that most of the impact force is distributed by the at least one torso load distribution assembly 10, and ultimately, over a large area (as seen in, e.g., FIGS. 11B, 12B) of the torso T of the user U rather than a concentrated area (as seen in, e.g., FIGS. 11A, 12A) of the torso T of the user U.

The plate portion 712 includes a body 716 having a front surface 718 and a rear surface 720 and a side surface 722 that joins the front surface 718 to the rear surface 720. In some implementations, the body 716 is arranged in an at-rest substantially flat orientation or an at-rest non-flat bowed orientation; if, for example, the body 716 is arranged in an at-rest, substantially flat orientation, the body 716 may be formed by a flexible material (e.g., any desirable plastic material or KEVLAR®-impregnated resin) that permits the body 716 to be manipulated from an at-rest, substantially flat orientation (as seen similarly in, e.g., FIGS. 1A-1C) to a flexed or bowed orientation (as seen similarly in, e.g., FIGS. 1D-1E").

Figure 3:
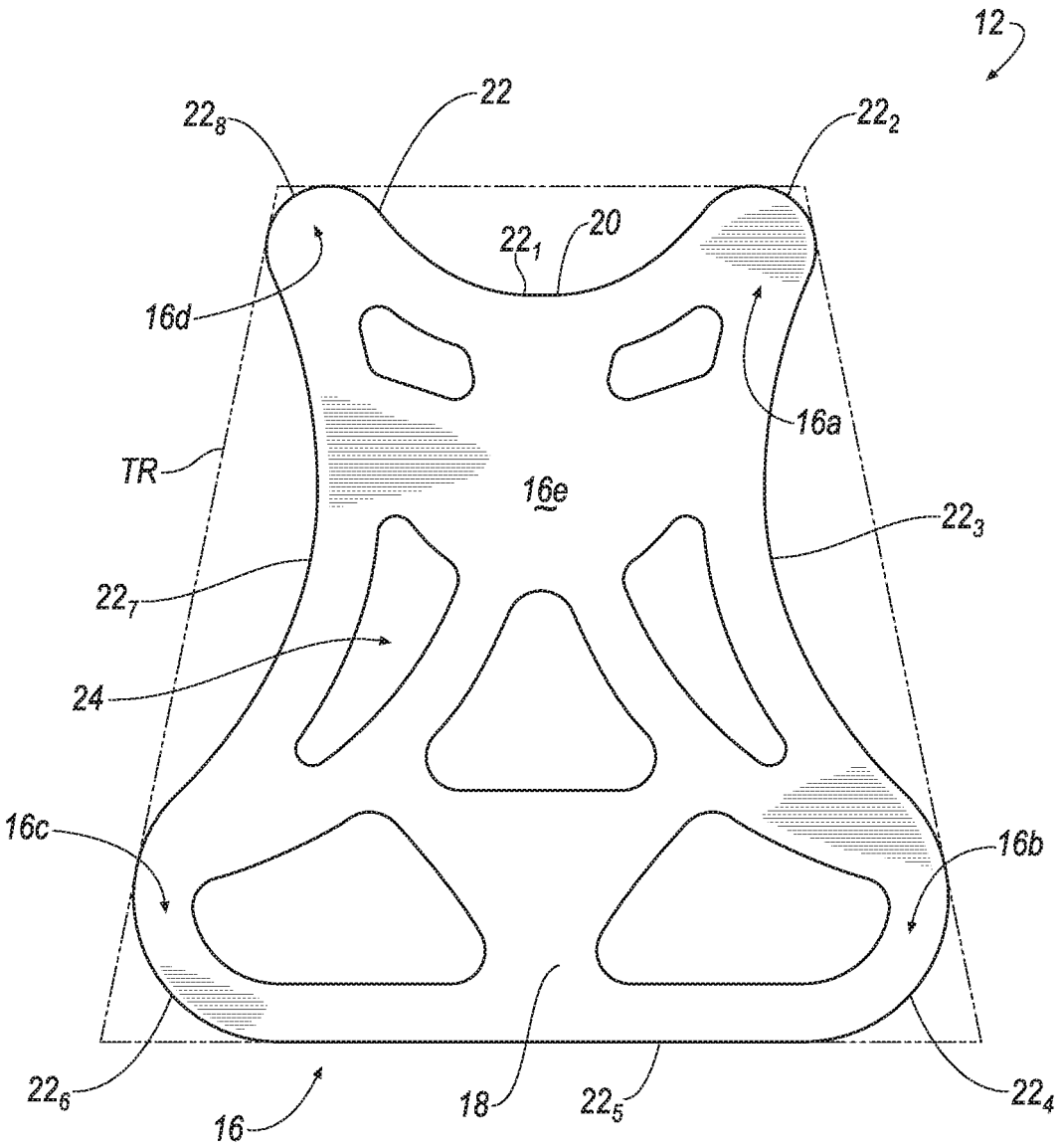
FIG. 3 is a front view or a rear view of a plate portion of the torso load distribution assembly of FIGS. 1A-1F.
Figure 4B:
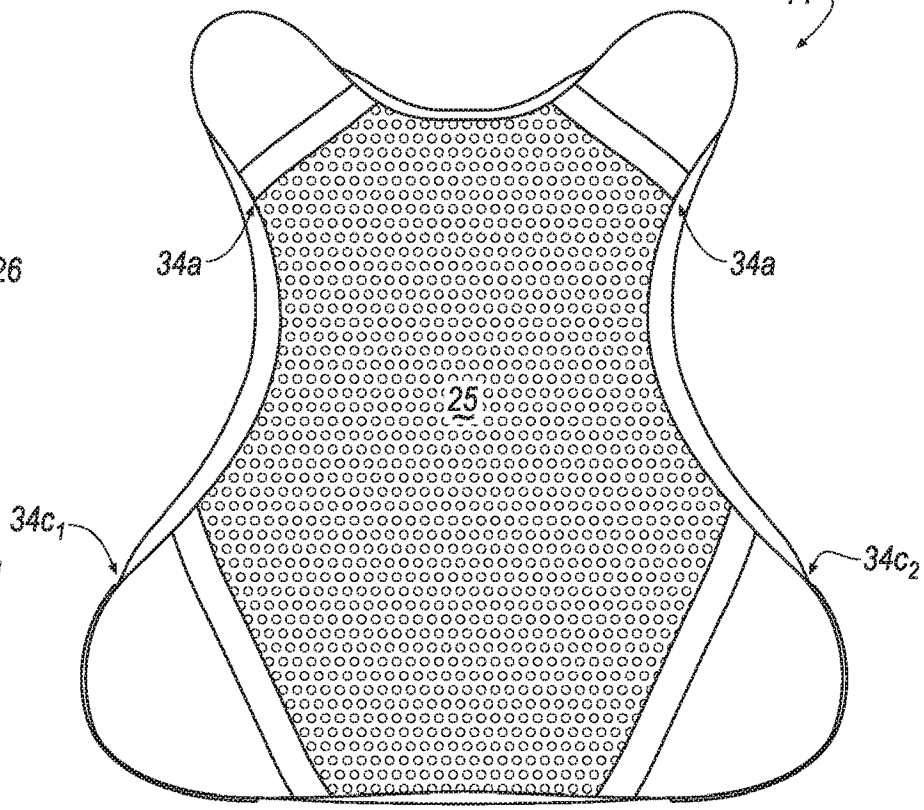
FIG. 4B is a rear view of the plate container portion of FIG. 4A.
Figure 4A:
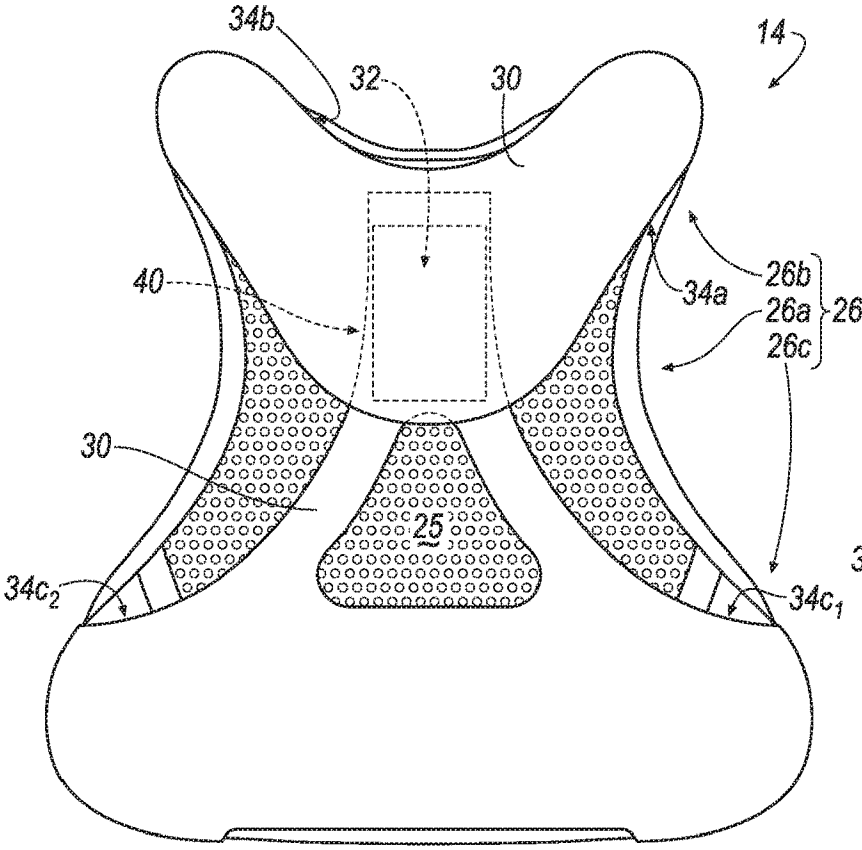
FIG. 4A is a front view of a plate container portion of the torso load distribution assembly of FIGS. 1A-1F.

The body 716 is defined by a thickness $T_{716}$ extending between the front 718 surface and the rear surface 720. Unlike the plate portion 12, which includes seven passages, the body 716 forms a greater plurality (e.g., sixty) of passages 724; the greater plurality of passages 724 extend through the thickness $T_{716}$ of the body 716. The greater plurality of passages 724 may yet even further reduce the weight of the plate portion 712 (in comparison to the plate portion 12) and provide additional air flow paths P in comparison to the plurality of passages 24 formed by the plate portion 12. Furthermore, as comparatively seen in each of, for example, FIGS. 3 and 25, the passages 24, 724 may be formed to include any desirable geometry such as, for example: substantially square-shaped geometries, substantially rectangular-shaped geometries, substantially triangular-shaped geometries, substantially circular geometries and the like. In view of the above-described structure of the passages 24, 724, the other above-described plate portions 212, 312, 412, 512 may also include any desirable number of passages 224, 324, 424, 524 as well as any desirable geometric shape of the passages 224, 324, 424, 524.

The side surface 722 of the body 716 is defined by a plurality of side surface segments $\mathbf{722}_1$-$\mathbf{722}_8$. In one example, the plurality of side surface portions segments $\mathbf{722}_1$-$\mathbf{722}_8$ includes a combination of at least one concave surface segment (see, e.g., $\mathbf{722}_2$, $\mathbf{722}_4$, $\mathbf{722}_6$, $\mathbf{722}_8$), at least one convex surface segment (see, e.g., $\mathbf{722}_1$, $\mathbf{722}_3$, $\mathbf{722}_7$) and at least one substantially straight surface segment (see, e.g., $\mathbf{722}_5$).

In an example, an exemplary side surface 722 of the body 716 of the plate portion 712 may include the following geometry. At approximately a "twelve o'clock" location of the side surface 722, the side surface 722 includes a convex surface segment $\mathbf{722}_1$ that is connected to a concave surface segment $\mathbf{722}_2$ that is located at approximately a "one o'clock" location of the side surface 722. At approximately a "three o'clock" location of the side surface 722, the side surface 722 includes a convex surface segment $\mathbf{722}_3$ that is connected to the concave surface segment $\mathbf{722}_2$ that is located at approximately the "one o'clock" location of the side surface 722. At approximately a "four o'clock" location of the side surface 722, the side surface 722 includes a concave surface segment $\mathbf{722}_4$ that is connected to the convex surface segment $\mathbf{722}_3$ that is located at approximately the "three o'clock" location of the side surface 722. At approximately a "six o'clock" location of the side surface 722, the side surface 722 includes a substantially straight surface segment $\mathbf{722}_5$ that is connected to the concave surface segment $\mathbf{722}_4$ that is located at approximately the "four o'clock" location of the side surface 722. At approximately an "eight o'clock" location of the side surface 722, the side surface 722 includes a concave surface segment $\mathbf{722}_6$ that is connected to the substantially straight surface segment $\mathbf{722}_5$ that is located at approximately the "six o'clock" location of the side surface 722. At approximately a "nine o'clock" location of the side surface 722, the side surface 722 includes a convex surface segment $\mathbf{722}_7$ that is connected to the concave surface segment $\mathbf{722}_6$ that is located at approximately the "eight o'clock" location of the side surface 722. At approximately an "eleven o'clock" location of the side surface 722, the side surface 722 includes a concave surface segment $\mathbf{722}_8$ that is connected to the convex surface segment $\mathbf{722}_7$ that is located at approximately the "nine o'clock" location of the side surface 722. The concave surface segment $\mathbf{722}_8$ that is located at approximate the "eleven o'clock" location of the side surface 722 is connected to the convex surface segment $\mathbf{722}_1$ that is located at approximately the "twelve o'clock" location of the side surface 722.

Although the exemplary side surface 722 of the body 716 of the plate portion 712 described above includes one substantially straight surface segment (see, e.g., the substantially straight surface segment $722_5$) and a plurality of arcuate surface segments (see, e.g., the convex surface segments $722_1$, $722_3$, $722_7$ and the concave surface segments $722_2$, $722_4$, $722_6$, $722_8$), the plurality of side surface segments $722_1$-$722_8$ may be selectively shaped to form a plate portion 712 having any desirable shape. In an example, the plurality of side surface segments $722_1$-$722_8$ may be selectively shaped such that the plurality of side surface segments $722_1$-$722_8$ are collectively bound by a substantially trapezoidal-shaped area (see, e.g., trapezoidal shaped dashed line TR surrounding the side surface 722 of the body 716 of the plate portion 712).

Furthermore, the exemplary side surface 722 of the body 716 of the plate portion 712 described above may shape the body 716 to define a plurality of body projections 716*a*-716*d* (or, alternatively, body portions) that extend away or are spaced apart from a substantially central body portion 716*e*. The plurality of body projections 716*a*-716*d* may include an upper right body projection 716*a*, a lower right body projection 716*b*, a lower left body projection 716*c* and an upper left body projection 716*d*. The upper right body projection 716*a* may be defined by a portion of the convex surface segment $722_1$, the concave surface segment $722_2$ and a portion of the convex surface segment $722_3$. The lower right body projection 716*b* may be defined by a portion of the convex surface segment $722_3$, the concave surface segment $722_4$ and a portion of the substantially straight surface segment $722_5$. The lower left body projection 716*c* may be defined by a portion of the substantially straight surface segment $722_5$, the concave surface segment $722_6$ and a portion of the convex surface segment $722_7$. The upper left body projection 716*d* may be defined by a portion of the convex surface segment $722_7$, the concave surface segment $722_8$ and a portion of the convex surface segment $722_1$.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A torso load distribution assembly comprising:

one or more plate portions having a flat configuration and including a body having a front surface, a rear surface and a side surface that joins the front surface to the rear surface, wherein the body includes a plurality of body portions that are spaced apart from a central body portion, the plurality of body portions including an upper right body projection, a lower right body projection, a lower left body projection, and an upper left body projection; and a plate engaging member including a body having a central body portion, an upper body portion connected to the central body portion of the body of the plate engaging member and forming an upper right pocket configured to receive the upper right body projection and an upper left pocket configured to receive the upper left body projection, and a lower body portion connected to the central body portion of the body of the plate engaging member; and forming a lower right pocket configured to receive the lower right body projection and a lower left pocket configured to receive the lower left body projection, wherein each of the upper body portion and the lower body portion of the plate engaging member are attached to a respective one of the plurality of body portions of the one or more plate portions, wherein the body of the plate engaging member is smaller dimensionally than dimensions formed by the side surface of the body of the one or more plate portions for maintaining the body of the one or more plate portions in a bowed orientation when the plurality of body portions of the one or more plate portions are attached to the plate engaging member.

2. The torso load distribution assembly of claim 1, wherein the upper body portion further defines an upper lip, wherein the lower body portion further defines a lower lip, wherein the upper lip is secured to the lower lip for selectively containing the one or more plate portions within the plate engaging member.

3. The torso load distribution assembly of claim 2, wherein an inner surface of the upper body portion defining the upper lip includes a patch of one of a hook material and a loop material that engages the other of the hook material and the loop material provided by an outer surface of the lower body portion defining the lower lip to provide a hook-and-loop connection of the upper lip and the lower lip.

4. The torso load distribution assembly of claim 1, wherein the upper body portion further defines an upper lip, wherein the lower body portion further defines a lower lip, wherein the upper lip is secured to the lower lip for selectively containing the one or more plate portions within the plate engaging member.

5. The torso load distribution assembly of claim 4, wherein an inner surface of the upper body portion defining the upper lip includes a patch of one of a hook material and a loop material that engages the other of the hook material and the loop material provided by an outer surface of the lower body portion defining the lower lip to provide a hook-and-loop connection of the upper lip and the lower lip.

6. An assembly comprising:

torso apparel including:

at least one torso load distribution assembly of claim 1, and a carrier portion including at least one strap, wherein the at least one strap includes a body having an inner surface and an outer surface, wherein the inner surface of the body of the at least one strap proximate a first end of the body of the at least one strap is attached to a first portion of an outer surface of the plate engaging member of the at least one torso load distribution assembly, wherein the inner surface of the body of the at least one strap proximate a second end of the body of the at least one strap is attached to a second portion of an outer surface of the plate engaging member of the at least one torso load distribution assembly.

7. The assembly of claim 6, wherein the inner surface of the body of the at least one strap proximate the first end of the body of the at least one strap includes a first patch of one of a hook material and a loop material that engages the other of the hook material and the loop material provided by the first portion of the outer surface of the plate engaging member to provide a hook-and-loop connection of the first end of the body of the at least one strap to the first portion of the outer surface of the plate engaging member, and wherein the inner surface of the body of the at least one strap proximate the second end of the body of the at least one strap includes a second patch of one of a hook material and a loop material that engages the other of the hook material and the loop material provided by the second portion of the outer surface of the plate engaging member to provide a hook-and-loop connection of the second end of the body of the at least one strap to the second portion of the outer surface of the plate engaging member.

8. The assembly of claim 6, wherein the at least one strap includes:

at least one shoulder strap.

9. The assembly of claim 8, wherein the at least one shoulder strap includes:

a first shoulder strap, and a second shoulder strap.

10. The assembly of claim 6, wherein the at least one strap includes:

at least one waist strap.

11. The assembly of claim 10, wherein the at least one waist strap includes:

a first waist strap, and a second waist strap.

12. A torso load distribution assembly comprising;

one or more plate portions having a flat configuration and including a body having a front surface, a rear surface, and a side surface that joins the front surface to the rear surface, wherein the body includes a plurality of body portions that are spaced apart from a central body portion, the plurality of body portions including an upper right body projection, a lower right body projection, a lower left body projection, and an upper left body projection; and a plate engaging member including a body having a central body portion, a right body portion forming a lower right pocket that is configure to receive the lower right body projection and an upper right pocket portion that is configured to receive the upper right body projection, and a left body portion forming a lower left pocket portion that is configured to receive the lower left body projection and an upper left pocket portion that is configured to receive the upper left body projection, wherein each of the right body portion and the left body portion of the plate engaging member are attached to a respective one of the plurality of body portions of the one or more plate portions, wherein the body of the plate engaging member is smaller dimensionally than dimensions formed by the side surface of the body portion of the one or more plate portions for maintaining the body of the one or more plate portions in a bowed orientation when the plurality of body portions of the one or more plate portions are attached to the plate engaging member.

13. A torso load distribution assembly comprising:

one or more plate portions including a body having a front surface, a rear surface and a side surface that joins the front surface to the rear surface, wherein the body includes a plurality of body portions that are spaced apart from a central body portion, wherein the body is preformed to define an at-rest, non-flat, bowed orientation;

a plate engaging member including a body having a central body portion, a first body portion connected to the central body portion of the body of the plate engaging member and a second body portion connected to the central body portion of the body of the plate engaging member, wherein each of the first body portion and the second body portion are attached to the plurality of body portions of the one or more plate portions, wherein the body of the plate engaging member is configured to be stretched about the body of the one or more plate portions when the plurality of body portions of the one or more plate portions are attached to each of the first body portion and the second body portion of the plate engaging member, wherein the plurality of body portions that are spaced apart from the central body portion of the body of the one or more plate portions includes:

an upper right body projection, a lower right body projection, a lower left body projection, and an upper left body projection, wherein the first body portion of the body of the plate engaging member is an upper body portion, wherein the second body portion of the body of the plate engaging member is a lower body portion, wherein the upper body portion forms an upper pocket and the lower body portion forms a lower pocket spaced apart from the upper pocket, wherein the upper pocket includes: an upper right pocket portion formed by the upper body portion that is configured to receive the upper right body projection, an upper left pocket portion formed by the upper body portion that is configured to receive the upper left body projection, wherein the lower pocket includes: a lower right pocket portion that is configured to receive the lower right body projection, and a lower left pocket portion that is configured to receive the lower left body projection.

14. The torso load distribution assembly of claim 13, wherein the upper body portion further defines an upper lip, wherein the lower body portion further defines a lower lip, wherein the upper lip is secured to the lower lip for selectively containing the one or more plate portions within the plate engaging member.

15. The torso load distribution assembly of claim 14, wherein the inner surface of the upper body portion defining the upper lip includes a patch of one of a hook material and a loop material that engages the other of the hook material and the loop material provided by the outer surface of the lower body portion defining the lower lip to provide a hook-and-loop connection of the upper lip and the lower lip.

16. An assembly comprising:

torso apparel including:

at least one torso load distribution assembly of claim 13, and a carrier portion including at least one strap, wherein the at least one strap includes a body having an inner surface and an outer surface, wherein the inner surface of the body of the at least one strap proximate a first end of the body of the at least one strap is attached to a first portion of an outer surface of the plate engaging member of the at least one torso load distribution assembly, wherein the inner surface of the body of the at least one strap proximate a second end of the body of the at least one strap is attached to a second portion of an outer surface of the plate engaging member of the at least one torso load distribution assembly.

17. The assembly of claim 16, wherein the inner surface of the body of the at least one strap proximate the first end of the body of the at least one strap includes a first patch of one of a hook material and a loop material that engages the other of the hook material and the loop material provided by the first portion of the outer surface of the plate engaging member to provide a hook-and-loop connection of the first end of the body of the at least one strap to the first portion of the outer surface of the plate engaging member, and wherein the inner surface of the body of the at least one strap proximate the second end of the body of the at least one strap includes a second patch of one of a hook material and a loop material that engages the other of the hook material and the loop material provided by the second portion of the outer surface of the plate engaging member to provide a hook-and-loop connection of the second end of the body of the at least one strap to the second portion of the outer surface of the plate engaging member.

18. The assembly of claim 16, wherein the at least one strap includes:

at least one shoulder strap.

19. The assembly of claim 18, wherein the at least one shoulder strap includes:

a first shoulder strap, and a second shoulder strap.

20. The assembly of claim 16, wherein the at least one strap includes:

at least one waist strap.

21. The assembly of claim 20, wherein the at least one waist strap includes:

a first waist strap, and a second waist strap.

* * * * *